US011155112B2

(12) United States Patent
Brehm et al.

(10) Patent No.: US 11,155,112 B2
(45) Date of Patent: Oct. 26, 2021

(54) SECURITY ELEMENT, AND METHOD FOR PRODUCING A SECURITY ELEMENT

(71) Applicants: LEONHARD KURZ Stiftung & Co. KG, Fürth (DE); OVD Kinegram AG, Zug (CH)

(72) Inventors: Ludwig Brehm, Adelsdorf (DE); Anja Cathomen, Morschach (CH); Christian Schulz, Fürth (DE); René Staub, Hagendorn (CH); Harald Walter, Horgen (CH)

(73) Assignees: LEONHARD KURZ STIFTUNG & CO. KG, Fürth (DE); OVD KINEGRAM AG, Zug (CH)

( * ) Notice: Subject to any disclaimer, the term of this patent is extended or adjusted under 35 U.S.C. 154(b) by 0 days.

(21) Appl. No.: 16/968,256

(22) PCT Filed: Feb. 14, 2019

(86) PCT No.: PCT/EP2019/053627
§ 371 (c)(1),
(2) Date: Aug. 7, 2020

(87) PCT Pub. No.: WO2019/158625
PCT Pub. Date: Aug. 22, 2019

(65) Prior Publication Data

US 2021/0031553 A1 Feb. 4, 2021

(30) Foreign Application Priority Data

Feb. 14, 2018 (DE) ..... 102018103236.6

(51) Int. Cl.
*B42D 25/324* (2014.01)
*B42D 25/328* (2014.01)
(Continued)

(52) U.S. Cl.
CPC ..... *B42D 25/324* (2014.10); *B42D 25/328* (2014.10); *B42D 25/351* (2014.10); *B42D 25/373* (2014.10)

(58) Field of Classification Search
CPC .. B42D 25/324; B42D 25/328; B42D 25/351; B42D 25/373; B42D 25/36
(Continued)

(56) References Cited

U.S. PATENT DOCUMENTS

2005/0104364 A1 5/2005 Keller et al.
2005/0175815 A1 8/2005 Wild et al.
(Continued)

FOREIGN PATENT DOCUMENTS

DE 102005061749 A1 7/2007
DE 102008005019 A1 7/2009
(Continued)

OTHER PUBLICATIONS van Renesse, Rudolf L., "Optical Document Security (Third Edition)", Artech House, 26 pages (2005).

*Primary Examiner* — Justin V Lewis
(74) *Attorney, Agent, or Firm* — Hoffmann & Baron, LLP

(57) ABSTRACT

A method and a security element with a front side and a rear side lying opposite the front side, wherein the security element has two or more security features, wherein a first security feature of the two or more security features has one or more first layers and a second security feature of the two or more security features has one or more second layers, wherein the first security feature and the second security feature are in particular arranged in register with each other, wherein the first security feature generates at least one first optically variable effect and the second security feature generates at least one second optically variable effect, wherein the at least one first optically variable effect has a
(Continued)

first color and the at least one second optically variable effect has a second color, wherein the first color and the second color differ from each other, as well as a method for producing a security element.

33 Claims, 39 Drawing Sheets

(51) Int. Cl.
*B42D 25/351* (2014.01)
*B42D 25/373* (2014.01)
*B42D 25/36* (2014.01)

(58) Field of Classification Search
USPC ..... 283/67, 70, 72, 94, 98, 901
See application file for complete search history.

(56) References Cited

U.S. PATENT DOCUMENTS

| | | | | |
|---|---|---|---|---|
| 2006/0072225 | A1 | 4/2006 | Schilling | |
| 2008/0258456 | A1 | 10/2008 | Rahm et al. | |
| 2010/0254007 | A1 | 10/2010 | Toda | |
| 2011/0127762 | A1 | 6/2011 | Hoffmuller et al. | |
| 2012/0025514 | A1 | 2/2012 | Camus | |
| 2012/0038988 | A1 | 2/2012 | Staub et al. | |
| 2012/0174447 | A1 | 7/2012 | Vincent | |
| 2012/0193905 | A1 | 8/2012 | Schilling et al. | |
| 2012/0281294 | A1* | 11/2012 | Camus ..... | G02B 3/0056 359/619 |
| 2013/0003150 | A1 | 1/2013 | Camus et al. | |
| 2014/0002873 | A1 | 1/2014 | Tompkin et al. | |
| 2016/0023495 | A1 | 1/2016 | Fuhse et al. | |
| 2016/0161646 | A1 | 6/2016 | Tompkin et al. | |
| 2016/0257159 | A1 | 9/2016 | Attner et al. | |
| 2017/0322515 | A1 | 11/2017 | Pforte et al. | |
| 2018/0134065 | A1 | 5/2018 | Tompkin et al. | |

FOREIGN PATENT DOCUMENTS

| | | | |
|---|---|---|---|
| DE | 102008036481 | A1 | 2/2010 |
| DE | 102011100979 | A1 | 11/2012 |
| DE | 102013002137 | A1 | 8/2014 |
| DE | 102014116940 | A1 | 5/2016 |
| EP | 2790042 | A1 | 10/2014 |
| EP | 2960690 | A1 | 12/2015 |
| EP | 3220171 | A1 | 9/2017 |
| FR | 2941649 | A1 | 8/2010 |
| FR | 2953965 | A1 | 6/2011 |
| WO | 97/47478 | A1 | 12/1997 |
| WO | 98/23979 | A1 | 6/1998 |
| WO | 01/03945 | A1 | 1/2001 |
| WO | 03/053713 | A1 | 7/2003 |
| WO | 2004/049250 | A1 | 6/2004 |
| WO | 2006/084686 | A2 | 8/2006 |
| WO | 2008/008635 | A2 | 1/2008 |
| WO | 2008/095698 | A1 | 8/2008 |
| WO | 2009/010714 | A1 | 1/2009 |
| WO | 2011/007344 | A1 | 1/2011 |
| WO | 2011/029602 | A2 | 3/2011 |
| WO | 2011/116425 | A1 | 9/2011 |
| WO | 2015/107347 | A1 | 7/2015 |
| WO | 2016/087485 | A1 | 6/2016 |
| WO | 2016/181109 | A1 | 11/2016 |

* cited by examiner

SECURITY ELEMENT, AND METHOD FOR PRODUCING A SECURITY ELEMENT

This application claims priority based on an International Application filed under the Patent Cooperation Treaty, PCT/EP2019/053627, filed Feb. 14, 2019, which claims priority to DE 102018103236.6, filed Feb. 14, 2018.

BACKGROUND OF THE INVENTION

The invention relates to a security element and a method for producing a security element.

SUMMARY OF THE INVENTION

Security elements for marking security documents, in particular value documents and/or ID documents, are known, which serve the purpose of improving the protection against forgery of the corresponding security documents. For this purpose, security elements are further known, which show the human observer optically variable effects, i.e. effects dependent on the illumination angle and/or the observation angle, and thus have a much higher protection against forgery than non-optically variable security features, for example a multi-color security print which exhibits the same optical appearance at almost all observation and/or illumination angles.

A security element with such an optically variable security feature, which has a specific relief structure covered with a reflective layer in order to generate such an optically variable effect by means of optically diffractive effects, is known from WO 2004/049250 A1. This relief structure is further molded in a dyed layer, with the result that the chromaticity of the optically variable effect of the relief structure is further altered by this dyeing, and thus the protection against forgery is still further improved.

The object of the invention is to specify an improved security element as well as an improved method for producing a security element.

The object is achieved by a security element with a front side and a rear side lying opposite the front side, wherein the security element has two or more security features, wherein a first security feature of the two or more security features comprises one or more first layers and a second security feature of the two or more security features comprises one or more second layers, wherein the first security feature and the second security feature are in particular arranged in register with each other, wherein the first security feature generates at least one first optically variable effect and the second security feature generates at least one second optically variable effect, wherein the at least one first optically variable effect has a first color and the at least one second optically variable effect has a second color, wherein the first color and the second color differ from each other.

In particular, the first and/or second color is determined by the coloration of a dyed layer. It is also possible for the first and/or second color to be formed by optical interference effects in a thin-film structure, in particular in a so-called Fabry-Perot three-layer structure consisting of a semi-transparent absorber layer, preferably made of metal, a transparent dielectric spacer layer and a second semi-transparent absorber layer, preferably made of metal, or an opaque mirror layer, in particular made of metal. In particular, the first and/or second color here exhibits a change perceptible to the human eye or a barely perceptible or noticeable change or no perceptible change when the security element is tilted. Further preferably, the change in the first and/or second color upon tilting is the first and/or second optically variable effect.

The object is further achieved by a method for producing a security element with one or more first areas and one or more second areas, wherein the method comprises the following steps:

a) applying a first security feature comprising one or more first layers to a carrier ply, wherein the first security feature generates at least one first optically variable effect, wherein the at least one first optically variable effect has a first color, b) applying a second security feature comprising one or more second layers to the carrier ply and/or the first security feature such that the first security feature is in particular arranged in register with the second security feature, wherein the second security feature generates at least one second optically variable effect, wherein the at least one second optically variable effect has a second color, and wherein the first color and the second color differ from each other.

Such a security element and/or such a method is characterized by a particularly high protection against forgery. Thus, it is brought about through the different coloring and the arrangement, in particular the register-accurate arrangement, of the security features that the distinguishable optically variable security features that are otherwise perceptible, in particular at all observation angles, often only in a way where they are difficult to separate from each other because of their "nature" are clearly distinguishable even under poor illumination conditions and thus register inaccuracies become clearly recognizable for the observer. Through the register-accurate arrangement of both the different optically variable structures and the dyed layers or thin-film structures to be used for the corresponding coloring, high demands are further made on the process-technological production of the security element, with the result that a forgery by a forger is only possible with difficulty. The above-mentioned correlations are also clearly recognizable for the human observer.

It is hereby achieved that the first optically variable effect, which has the first color, and the second optically variable effect, which has the second color, are detectable, clearly and sharply delimited from each other, for an observer.

One or more first layers of the one or more first layers and/or one or more second layers of the one or more second layers are preferably in each case or collectively assigned a plurality of functions in the security element, wherein these first layers and/or second layers are in particular selected from: detachment layer, adhesion-promoter layer, planarization layer, leveling layer, stabilizing layer, barrier layer, mask layer, color layer, highly refractive layer, opaque layer, metal layer, in particular partially shaped metal layer, preferably reflective layer, replication layer or protective layer. The layer thicknesses thereof in particular range from a few nanometers to a few micrometers.

It is possible for the material compositions to vary depending on the respective functions or requirements of the one or more first layers and/or of the one or more second layers, wherein these first layers and/or second layers are preferably composed of and/or consist of one or more binders, additives and/or fillers.

By binders is preferably meant polymer-based systems and mixtures thereof, such as for example polyester, polyacrylate, polymethacrylate, polyurethane, polystyrene, polybutyrate, nitrocellulose or similar polymers.

By additives is preferably meant organic or inorganic substances which the processing properties achieve a predetermined effect, for example when a color layer is applied in the above method or when the security element itself is used.

By fillers is preferably meant all further materials added to a system, in particular a polymer-based system, such as for example silica, pigments, dyes, UV blockers (UV=UV radiation=ultraviolet radiation=electromagnetic radiation from the ultraviolet part of the electromagnetic radiation spectrum or from one or more partial areas from the ultraviolet part of the electromagnetic radiation spectrum), tracers, in particular taggants, and/or similar materials.

The application of one or more first layers of the one or more first layers and/or of one or more second layers of the one or more second layers is preferably effected by means of a printing method, such as for example gravure printing, screen printing, offset printing, digital printing, in particular inkjet printing or xerographic printing, slot casting, and/or similar printing methods or by further coating methods, such as for example metallization, sputtering, chemical deposition methods, in particular chemical vapor deposition (CVD) and/or plasma-enhanced chemical vapor deposition (PECVD).

The layer thicknesses for the one or more first layers and/or the one or more second layers preferably lie in a range of from 0.001 μm to 50 μm, in particular in a range of from 0.005 μm to 20 μm.

By a carrier ply is preferably meant a single-layered or multi-layered film, the one or more layers of which in particular consist of the following materials or combinations PET (polyethylene terephthalate), PP (polypropylene), PE (polyethylene), PEN (polyethylene naphthalate), PC (polycarbonate), PVC (polyvinyl chloride), Kapton (poly-oxydiphenylene-pyromellitimide) or other polyimides, PLA (polylactate), PMMA (polymethyl methacrylate) or ABS (acrylonitrile butadiene styrene), wherein the layer thickness is in particular between 1 μm and 500 μm, preferably between 6 μm and 75 μm, further preferably between 12 μm and 50 μm.

By register or registration, or register accuracy or registration accuracy, or positional accuracy is meant a positional accuracy of two or more layers and/or elements and/or features relative to each other. The register accuracy is to vary within a predefined tolerance and is to be as high as possible. At the same time, the register accuracy of several elements and/or layers relative to each other is an important feature for increasing the process reliability. The positionally accurate positioning can be effected in particular by means of sensory, preferably optically detectable, registration marks or the position markings. These registration marks or position markings can either represent special separate elements or areas or layers or themselves be part of the elements or areas or layers to be positioned.

It is possible for the first security feature and the second security feature to be formed or shaped as two unregistered, continuous endless patterns or design elements which are preferably not coordinated with each other, but rather overlap in particular randomly, or to be formed or shaped as two registered, continuous endless patterns or design elements which are preferably coordinated with each other and overlap in particular in a predetermined manner.

Further, it is also possible for the first security feature to be formed or shaped as at least one registered individual image or design element and the second security feature to be formed or shaped as at least one unregistered, continuous endless pattern or design element or vice versa, wherein the second security feature is preferably not coordinated with the relative position of the first security feature, but rather overlaps with it in particular randomly, or for the first security feature to be formed or shaped as at least one unregistered individual image or design element and the second security feature to be formed or shaped as at least one registered, continuous endless pattern or design element, wherein the first security feature is preferably not coordinated with the relative position of the second security feature and overlaps with it in particular randomly.

Further, it is possible for the first security feature to be formed or shaped as at least one unregistered individual image or design element and the second security feature to be formed or shaped as at least one unregistered, continuous endless pattern or design element or vice versa, wherein these are preferably not coordinated with each other, but rather overlap in particular randomly, or for the first security feature to be formed or shaped as at least one registered individual image or design element and the second security feature to be formed or shaped as at least one registered, continuous endless pattern or design element, wherein these are preferably coordinated with each other and overlap in particular in a predetermined manner.

The endless patterns or design elements and/or the individual images or design elements are preferably registered relative to each other and/or relative to a substrate onto which the first security feature and/or the second security feature are preferably transferred.

Further, it is also possible for the first security feature and the second security feature to be aligned relative to each other such that the two security features together make up an overall pattern or design element.

In particular, the first security feature and/or the second security feature are composed of a plurality of design elements which do not overlap one another at least partially and/or are adjacent to one another at least partially when observed from the front side and/or the rear side.

Advantageous embodiments of the invention are described in the dependent claims.

It is possible for one or more first layers of the one or more first layers and/or one or more second layers of the one or more second layers to be arranged next to each other, in particular in one plane, or to be arranged one underneath the other, in particular in several planes. Such a plane can be defined, for example, by the plane spanned by the security element.

The one or more first layers are preferably arranged above the one or more second layers when the security element is observed from the front side or the rear side.

Further, the one or more second layers in particular completely, partially or do not overlap the one or more first layers when the security element is observed from the rear side or the front side.

Further, the first security feature is visible in one or more first areas of the security element and the second security feature is visible in one or more second areas of the security element when observed in reflected light and/or when observed in transmitted light from the front side and/or the rear side.

It is possible for the one or more first areas and/or the one or more second areas to be adjacent to one another, at least in sections, for an observer who detects the security element from the front side or rear side.

Thus, it is also possible for the one or more first areas and/or the one or more second areas in each case to be shaped in the form of a design element, in particular as an alphanumeric character, a coding such as for example a barcode, a character, a symbol, a microprint, an image, a portrait, a logo, an emblem and/or a motif. Examples of such motifs are a flag, the outline of the borders of a country or island or a continent, or a structure such as a bridge or a building.

Further, it is possible for one or more first areas of the one or more first areas and/or one or more second areas of the one or more second areas to be arranged to form at least one design element. Such design elements are preferably formed of one or more components selected from: alphanumeric characters, codings, symbols, microprints, logos, emblems, motifs, images, texts, portraits and/or characters. Any desired combinations of the above design elements and/or the above components are also possible. Thus, for example, the outer contour of an alphanumeric character can be made up of one or more first areas of the one or more first areas and the surface area enclosed by an outer contour of the alphanumeric character can be provided by one or more second areas of the one or more second areas.

Furthermore, it is also possible here for one or more first areas of the one or more first areas to form a first design element, for example a line motif of a number, with the first color and one or more second areas of the one or more second areas to form a second design element, for example the letters of the word "euro", in the second color, wherein the first and the second design element can overlap and/or are arranged in register with each other and/or are rastered in each other. The protection against forgery of a corresponding security element and/or security document is significantly increased hereby.

It is possible for the first and/or second color to be decisively determined by the coloration of a dyed layer, in particular of one or more first layers of the one or more first layers and/or of one or more second layers of the one or more second layers.

The first security feature is preferably formed opaque in the one or more first areas and formed transparent or translucent in the one or more second areas. However, it is also possible for the first security feature to be formed opaque in the one or more second areas and to be formed opaque, transparent or translucent in the one or more first areas.

By transparent is in particular meant a property, in particular an optical property, which is a measure of the ability of a substance and/or material and/or layer, in particular the first security feature and/or the second security feature, to allow one or more spectral components of the electromagnetic spectrum to pass through. The spectral component, in particular of visible radiation, which is easily recognizable for the human eye preferably lies in a wavelength range between 430 nm and 690 nm.

By transmittance or optical density is preferably meant a percentage or dimensionless quantity which specifies how much intensity of an electromagnetic wave or electromagnetic radiation remains when the latter passes through a substance and/or a material and/or a layer.

By translucent is in particular meant a property, in particular an optical property, which is a measure of the ability of a substance and/or material and/or layer, in particular the first security feature and/or the second security feature, to allow one or more spectral components of the electromagnetic spectrum to pass through. To distinguish it from transparency (=ability to allow an image or look to pass through), by translucency is in particular meant an ability to allow light to pass through. Translucent materials, unlike transparent materials, preferably have a proportion of light scattering that is significant for the eye.

By opaque is in particular meant a property, in particular an optical property, which is a measure of the inability of a substance and/or material and/or layer, in particular the first security feature and/or the second security feature, to allow one or more spectral components of the electromagnetic spectrum to pass through. The opacity of a substance, such as for example a layer and/or a security feature, is preferably described by a measure referred to as absorption capacity. In particular, a substance is referred to as opaque if its optical density is greater than 1, preferably greater than 1.5.

By absorption capacity or absorption coefficient is in particular meant a measure of the decrease in the intensity of electromagnetic waves or electromagnetic radiation when they pass through a substance and/or through a material and/or through a layer, wherein the dimension of the absorption capacity and/or the absorption coefficient is in particular 1/unit of length, preferably 1/measure of length. For example, an opaque layer has a greater absorption coefficient for visible radiation than air.

Further, it is possible for one or more of the first layers to be formed as opaque layer, in particular as opaque metal layer, wherein the opaque layer is provided in the one or more first areas, but is not provided in the one or more second areas.

By an opaque layer, which is in particular formed as metal layer, is preferably meant a specific, functional layer which fulfills the function of scattering, in particular reflecting and/or absorbing, electromagnetic radiation, such as for example visible light, at a boundary surface. Such a layer can be formed, for example, by vapor deposition or sputtering of a metal, in particular aluminum, silver, chromium, copper, gold, tin, zinc. Such an opaque layer preferably functions as metallic mirror layer or as absorber layer. The layer thickness of such an opaque layer is preferably between 1 nm and 500 nm, further preferably between 5 nm and 100 nm. Such an opaque layer in particular serves as metallic mirror layer typically from a layer thickness of approx. 15 nm. In the case of a layer thickness less than 15 nm, such an opaque layer preferably functions as absorber layer. It is also possible for such an opaque layer to be formed by applying metal pigment-containing varnishes, wherein the layer thickness is in particular between 0.1 μm and 50 μm, preferably from 1 μm to 20 μm.

It is further possible for one or more first layers of the one or more first layers to form and/or have a first optically variable structure and/or for one or more second layers of the one or more second layers to form and/or have a second optically variable structure. Preferably, the first optically variable structure is provided in the one or more first areas and, however, not provided in particular in the one or more second areas.

By optically variable structures is preferably meant structures, the optical effects of which are preferably determined by relief structures. In particular, such optically variable structures, which have a low inherent coloration, are particularly suitable for combination with colors, for example contained in color layers. These are in particular optically variable structures which preferably have a low inherent coloration. These structures thus preferably exhibit no distinctive rainbow effects known from conventional grating structures. These optically variable structures preferably have a substantially achromatic effect.

Such optically variable structures, which have weak or no diffractive color effects, are in particular selected from: mirrors, isotropically or anisotropically scattering structures, in particular matte structures, grating structures with low numbers of lines and a large grating depth, asymmetrical achromatic grating structures, refractive structures, coarse sinusoidal gratings, blazed-type gratings or blazed gratings, in particular with grating periods of greater than 3 μm, preferably more than 6 μm, preferably Fresnel-type freeform surfaces, in particular with periodic, only locally periodic or aperiodic, blazed-type gratings comprising varying grating spacings, preferably with grating spacings of greater than 3 μm, preferably greater than 6 μm, micromirror arrangements and/or retroreflector arrangements. It is also possible to select optically variable structures with a stochastic variation in the number of grating lines and/or in the orientation of the grating lines, which scatter, in particular reflect, incident electromagnetic radiation, in particular light, at a predetermined range of angles or solid angle, in particular range of solid angles. It is further possible to select computer-generated holograms, in particular one or more kinoforms, as optically variable structures.

It is preferably possible to select those optically variable structures which absorb the incident light in a targeted manner, which are in particular suitable for generating dark or colored areas in the area of the optically variable structures or for varying the lightness in areas of the optically variable structures to a predetermined extent. Such structures include, in particular, linear or two-dimensional grating structures, for example crossed and/or hexagonal grating structures, with high numbers of lines, the typical periods of which are smaller than 500 nm, in particular smaller than 400 nm, randomly or pseudo-randomly arranged microstructures with average spacings of the microstructures of smaller than 500 nm, in particular smaller than 400 nm, as well as microstructures and/or nanostructures that absorb light by means of plasmon excitation.

Further preferably, in addition to the production of planar movement effects through such optically variable structures, line-based, but achromatic movement effects are also possible. Such optically variable structures are known by the term "circle movement", wherein a monochromatic movement is generated in particular through the overlaying of these optically variable structures with at least one transparent color layer.

Further, it is possible for the first optically variable structure to be formed as optically variable relief structure, which is molded into a replication layer, and for the optically variable relief structure not to be molded into the replication layer in the one or more second areas and/or to be optically obliterated by applying a varnish layer with a refractive index which differs from the refractive index of the replication layer by not more than 0.3, in particular not more than 0.1.

By a replication layer is preferably meant here a specific, functional layer into which optically variable structures are introduced and/or fixed in particular by means of thermal replication and/or UV replication. A replication layer is in particular a hybrid layer which are, for example, thermally replicated and is then cured by means of radiation, for example by means of UV radiation and/or at least one electron beam. For example, it is possible for the varnish to become warm during a UV replication. This replication layer in particular has a layer thickness of between 0.1 μm and 10 μm, preferably between 0.3 μm and 8 μm.

The varnish layer, which in particular preferably partially optically obliterates the first optically variable relief structure molded into a replication layer, is preferably made up of a second layer of the one or more second layers. Further, it is possible for the second optically variable structure to be provided both in the one or more first areas and in the one or more second areas.

Further, it is possible for the one or more first layers, which form the first optically variable structure, and/or the one or more second layers, which form the second optically variable structure, to comprise at least one reflective layer, wherein the reflective layer is preferably provided in the one or more second areas and/or in or on the one or more second layers, but is not provided in the one or more first areas and/or in or on the one or more first layers. The reflective layer is preferably formed as opaque, translucent or transparent reflective layer and is in particular selected from: a metal layer, a partially shaped metal layer, a layer of metallic raster elements, in particular raster dots, preferably raster lines, an HRI layer, an LRI layer (LRI=Low Refractive Index), and/or a combination of two or more HRI layers and/or LRI layers. In particular, the first optically variable structure and/or the second optically variable structure generate an achromatic optically variable effect. In a particular embodiment, the reflective layer consists of a Fabry-Perot interference layer system, in particular a three-layer system comprising a semi-transparent absorption layer, transparent dielectric spacer layer and a second semi-transparent absorption layer, or preferably an opaque mirror layer. As already mentioned above, such a layer structure preferably produces the first and/or the second color.

The reflective layer is preferably made up of a metal layer, in particular aluminum, silver, chromium, copper, gold. In an alternative embodiment, the reflective layer is preferably made up of an HRI layer (HRI=High Refractive Index), in particular a layer made of ZnS (zinc sulfide) and/or $TiO_2$ (titanium dioxide), $ZrO_2$ (zirconium oxide) or specific polymers, or of an LRI layer. It is also advantageous to use the inorganic HRI materials in pigment form, wherein these are in particular embedded in a binder matrix.

It is possible for the first optically variable structure and/or the second optically variable structure to comprise a volume hologram and/or an optically active relief structure, in particular selected from: mirror, diffraction grating, hologram, kinoform, asymmetrical diffraction structure, matte structure, in particular anisotropic matte structure, blazed grating, zero-order diffraction structure, Fresnel-type freeform surface, refractive structure, in particular micromirror arrangement, light-refracting or focusing structure, in particular microlens arrangement.

The first optically variable structure preferably differs from the second optically variable structure, wherein the first optically variable structure in particular differs from the second optically variable structure in one or more structure parameters, in particular in alignment, grating period, grating depth, randomness of structure parameters, and/or are allocated to different classes of optically variable structures.

It is possible for at least one first layer of the one or more first layers to be formed as first color layer and/or for at least one second layer of the one or more second layers to be formed as second color layer.

By color layer is preferably meant a specific, functional layer which in particular produces a color impression detectable for an observer and/or is further preferably used as mask layer.

By color is in particular meant a dyeing which preferably comprises transparently dyed as clear as glass, transparently dyed scattering or also dyed opaque with respect to the transparency and/or the clarity or the scattering power. The color preferably occurs as inherent color of a material and/or is arranged as additional dyed layer in front of a layer in the direction of view, wherein the layer lying underneath it is in particular modified in its colored appearance for an observer. The color here preferably appears optically constant or invariable in its hue and/or its color saturation and/or in its transparency at almost all, in particular at all, observation and/or illumination angles. It is further possible for the color itself to be optically variable, wherein the hue and/or the color saturation and/or the transparency of the color in particular changes as the observation and/or illumination angle changes.

The color layer is preferably formed as transparent color layer, in particular as transparent or translucent diaphanous color layer. Further preferably, the color layer preferably contains an additive, which preferably absorbs light in the ultraviolet wavelength range, in particular in a wavelength range between 200 nm and 380 nm. Such UV blockers preferably enhance the function of the color layer as mask layer. In particular, the UV blockers have no or only a very low absorption in the wavelength range of from 380 nm to 780 nm visible to the human eye, in order in particular not to modify the color impression of the color layer.

The colors of the first and/or second color layer are in particular transparent or at least translucent, wherein the transmittance is preferably between 5% and 99%, in particular over a partial range of the wavelength range of from 380 nm to 780 nm visible to the human eye, preferably in the range of from 430 nm to 690 nm. In particular, optically variable effects of the first and/or second optically variable structures arranged underneath the first and/or second color layer from the direction of view of the observer are detectable.

Dyes and/or pigments are preferably suitable as chromophoric substances of the first and/or second color layer. Pigments are preferably virtually insoluble, in particular insoluble, in the medium in which they are integrated. Dyes preferably dissolve during their use and in particular lose their crystal and/or particle structure. Possible classes of dyes are basic dyes, fat-soluble dyes or metal complex dyes. Possible classes of pigments are organic and inorganic pigments. Pigments are preferably composed of a material existing in one piece or, in particular alternatively, have complex structures, for example as a layer structure with a plurality of layers made of different materials and/or for example as capsules made of different materials, in particular with core and shell.

The first and/or second color layer has, in particular, further substances and/or materials, preferably selected from: IR upconverters (IR=infrared radiation=electromagnetic radiation from the infrared part of the electromagnetic radiation spectrum or from one or more partial areas from the infrared part of the electromagnetic radiation spectrum), UV-fluorescent or phosphorescent dyes, effect pigments, nanoparticles, IR-transparent components, magnetic particles which can be used for the further authenticity check of the security element.

By IR upconverter is preferably meant a substance and/or a material and/or an additive, which in particular glows in the visible wavelength range of the electromagnetic spectrum if this IR upconverter is exposed to infrared radiation.

It is also possible for the first and/or the second color layer to have covering or opaque colors in at least one of the first areas and/or in at least one of the second areas and/or over the whole surface in addition to or instead of the transparent or translucent colors.

Further, it is possible for one or more first layers of the one or more first layers and/or one or more second layers of the one or more second layers to be transparent or translucent in one or more parts of the electromagnetic spectrum, such as for example in the UV range and/or in the IR range, which is not detectable for the human eye. However, it is possible for the one or more parts of the electromagnetic spectrum to be detected by means of technical aids, such as for example by at least one sensor, in particular by a CMOS sensor (CMOS=Complementary Metal-Oxide Semiconductor) and/or CCD sensor (CCD="Charge-Coupled Device"), preferably by an imaging spectrometer.

One or more first layers of the one or more first layers and/or one or more second layers of the one or more second layers preferably have one or more colors, in particular the first and/or the second color, over the whole surface or in the pattern.

Further, it is possible for the first color layer and/or the second color layer to be formed and/or to consist of several different colors, wherein here these preferably also have areas with a color mixture of the first and second colors, which are formed by means of overlapping of the first and second color layers and/or through screening of the first and second color layers. In particular, the color saturation varies in the first and/or second color layer.

An observer preferably detects individual colors or mixed colors when the first color layer and/or the second color layer are observed, wherein complex optically variable, multi-colored images can in particular be generated through corresponding additive and subtractive color mixtures as well as optical overlaying of the optically variable effects. Here, the colors or the mixed colors are preferably combined with a variation in lightness and/or other optically variable effects of the one or more first and/or second optically variable structures.

It is possible for the varnish layer, which in particular preferably partially optically obliterates the first optically variable relief structure molded into a replication layer, to be made up of the second color layer or a replication layer of the second optically variable structure.

In particular, the first color layer is provided in the one or more first areas, wherein, however, the first color layer is not provided in the one or more second areas. The second color layer is preferably provided both in the one or more first areas and in the one or more second areas. It is further possible for the second color layer to be provided in the one or more second areas and not to be provided in the one or more first areas.

The first color layer and the second color layer preferably have different colors, wherein the first color layer in particular has the first color as color and the second color layer has the second color as color. In particular, the first color layer and/or the second color layer are formed as transparent or translucent layer, wherein the first and/or second color layer preferably in each case make up or form a transparent color layer.

Further, it is possible for the first color layer and/or the second color layer to be selected from: layer containing dyes and/or pigments, in particular optically variable pigments, liquid crystal pigments, interference layer pigments, interference layer system, in particular consisting of two or more layers with different refractive indices or an absorption layer, a spacer layer and a reflective layer, layer consisting of a liquid crystal material, in particular cholesteric liquid crystal material, volume hologram layer, metal layer.

It has proved to be advantageous if the first color layer and/or the second color layer has a color progression and/or a color gradient in at least one predetermined direction, since the forgery effort to copy such a security element is further increased here.

The first color layer and/or the second color layer and/or the reflective layer are particularly preferably arranged in register with each other.

It is possible for at least one first layer of the one or more first layers to be made up of a transparent or translucent replication layer, preferably formed over the whole surface, for an optically active relief structure to be molded at least into a surface of the replication layer and in the one or more first areas to be covered with one of the one or more first layers, which are formed as opaque metallic reflective layer, but for the surface of the replication layer in the one or more second areas, which in particular do not comprise the first areas, not to be covered with the opaque metallic reflective layer.

Further, it is possible for at least one second layer of the one or more second layers to be made up of a transparent or translucent replication layer, preferably formed over the whole surface, for an optically active relief structure to be molded at least into a surface of the replication layer and in the one or more second areas to be covered with one of the one or more second layers, which are formed as reflective layer.

It is also possible for at least one first layer of the one or more first layers, preferably in the one or more first areas, to have one or more first openings and/or for at least one second layer of the one or more second layers, preferably in the one or more second areas, to have one or more second openings, wherein the first openings and/or the second openings in particular have a transmittance of greater than 50%, preferably of greater than 90%, and wherein the at least one first layer of the one or more first layers outside the first openings in particular have a transmittance of less than 10%, preferably of less than 5%.

It is possible for an opening to be made up of one or more openings which are in particular highly transparent and/or have a transmittance of greater than 90%. An opening is preferably made up of a combination of a plurality of perforations and/or other smaller cutouts, in particular in raster form. Depending on the surface coverage of the opening, in particular comprising cutouts and/or closed areas of surface, such a composite opening preferably has a transmittance of greater than 2%, further preferably of greater than 5%, still further preferably of greater than 20%, and/or of less than 95%, preferably less than 80%, further preferably of less than 50%.

It has been shown to be advantageous that the one or more first openings and/or the one or more second openings are provided as first rasterizations and/or as second rasterizations, wherein the spacings of the first rasterizations and/or of the second rasterizations from each other, in particular the average spacings of the first rasterizations and/or of the second rasterizations from each other, are preferably less than or equal to 300 μm, in particular less than or equal to 150 μm. Here, it is not possible for a human observer to optically resolve the first and/or second rasterizations.

In particular, the first and/or the second rasterizations in each case comprise one or more raster lines, wherein the raster lines preferably run in a straight line or curved at least in sections. It is also possible for the first and/or the second rasterizations to be formed as rasters, in particular amplitude-modulated or frequency-modulated dot rasters, element rasters and/or line rasters.

It is possible for at least one first area of the one or more first areas having a first rasterization and at least one second area of the one or more second areas to overlap such that the at least one first optically variable effect and the at least one second optically variable effect is detectable by an observer from the front side, in particular in reflected light and/or in transmitted light. Preferably, the first optically variable effect is detectable or detected by an observer in the first color and the second optically variable effect is detectable or detected by an observer in the second color.

Further, it is possible for at least one first area of the one or more first areas and at least one second area of the one or more second areas having a second rasterization to overlap such that the at least one first optically variable effect and the at least one second optically variable effect is detectable by an observer from the front side, in particular in reflected light and/or in transmitted light.

It is also possible for the at least one first optically variable effect and/or the at least one second optically variable effect, when the security element is tilted and/or bent and/or rotated, to provide a sequence of colors, in particular a sequence of color values and/or a sequence of color lightnesses and/or a sequence of color saturations, and/or a color change, in particular a color value change and/or a color lightness change and/or a color saturation change, which produce a movement effect, a morphing effect and/or a flip effect, in particular a color flip effect and/or a 3D form virtually jumping out or jumping back.

By a morphing effect is preferably meant a metamorphosis, transformation or transition of one motif into another motif. Such a metamorphosis, transformation or such a transition has one or more intermediate stages.

By a flip effect is preferably meant a changeover of one motif to another motif. The changeover takes place in particular without intermediate stages.

By a color flip effect is preferably meant a changeover of one motif and/or one color of a colored motif to another colored motif and/or another color of the motif. The changeover takes place in particular without intermediate stages.

In particular, colors are substantially described by the color value, the color saturation and the color lightness, wherein the color value, the color saturation and the color lightness are preferably represented in a three-dimensional color space, such as for example the RGB color space or the L*a*b* color space, by means of correspondingly assigned coordinates. In the L*a*b* color space, on the a* axis the colors green and red preferably lie opposite each other, on the b* axis the colors yellow and blue preferably lie opposite each other and L* describes the color lightness via a lightness value between 0 and 100.

Preferred embodiments of the method are mentioned in the following.

The first security feature and/or the second security feature and/or the security element comprising the first and/or second security feature is preferably transferred, in particular without the carrier ply, by means of hot stamping or cold transfer onto a security document, in particular an ID document and/or a value document, such as for example a banknote. Here, the shape of the security feature and/or security element to be transferred is preferably determined by the choice of the die shape in the case of a hot stamping or by the choice of the adhesive print in the case of a cold transfer.

It is also possible for the first security feature and/or the second security feature and/or the security element comprising the first and/or second security feature to be transferred onto the security document as a laminating film or as a patch or laminating patch. Further, the first security feature and/or the second security feature and/or the security element comprising the first and/or second security feature is in particular provided as a die-cut label with at least one cold adhesive layer for the transfer onto a substrate.

Furthermore, it is possible for the first security feature and/or the second security feature and/or for security element comprising the first security feature and/or the second security feature to be incorporated into a security document as a thread. For example, this can be effected by embedding the thread into the still-wet or -moist paper material in the paper machine. This is preferably effected by laminating the thread into a document, part-document or substrate during the laminating operation, wherein these in particular consist of several plies. It is also possible for this to be effected by introducing the thread into an extrusion process, wherein the thread is preferably arranged inside an extruded plastic substrate. In particular, combinations of the above-named examples are also possible.

Further, it is possible in a transfer method to transfer the first security feature and/or the second security feature and/or the security element comprising the first and/or second security feature onto a substrate which is then joined to further plies and/or layers to form a document body. Such transfer methods are used in particular in the production of documents, such as for example cards or data pages of passports, wherein the materials are preferably selected from: paper, PVC, PC, PET, Teslin®, ABS, and/or combinations of these materials. In these transfer methods, the carrier ply of the security element preferably remains in the or on the document or is removed after the transfer.

In particular, it is possible for the first security feature and/or the second security feature and/or the security element comprising the first and/or second security feature to be produced alone and/or transferred or to be a part of a security feature, such as for example a KINEGRAM®.

In the method, the first security feature and/or the second security feature and/or the security element comprising the first and/or second security feature is advantageously built up or produced together with a KINEGRAM® on the same carrier ply.

It is also possible for the first security feature and/or the second security feature and/or the security element comprising the first and/or second security feature to be produced separately and to be transferred onto the carrier ply of a KINEGRAM®, for example by means of a laminating method or stamping method, in particular a hot-stamping method and/or a cold-stamping method. Here, the first security feature and/or the second security feature and/or the security element comprising the first and/or second security feature is in particular transferred onto or formed on either the front side or the rear side of the carrier ply or the side on which the KINEGRAM® layers are formed.

In step a) at least one first color layer and/or one or more layers which form and/or have one or more first optically variable structures are preferably applied to the carrier ply as first layer or first layers. It is possible for the one or more first optically variable structures to be formed in the one or more first areas, but not to be formed in the one or more second areas. Further, it is possible in step a) for the at least one first color layer to be applied in the one or more first areas, but not to be applied in the one or more second areas or to be removed again there after it has been applied.

In particular, in step a) at least one first replication layer is applied, in particular over the whole surface or in areas, as one of the first layers and in step a) a relief structure is preferably molded into the at least one first replication layer as first optically variable structure.

It is possible in step a) for at least one first opaque layer, in particular a first opaque metal layer, to be applied to the first replication layer as first layer, wherein the first opaque layer is preferably applied in the one or more first areas, but is not applied in the one or more second areas or is removed again there after it has been applied or after the application, is preferably removed using the first color layer as exposure mask registration-accurate relative to the first color layer.

Further, it is possible in step b) for at least one second color layer and/or one or more layers which form and/or have one or more second optically variable structures to be applied, preferably to the carrier ply and/or the at least first color layer, as second layer or second layers.

In step b) the at least one second color layer is preferably applied in the one or more second areas and in the one or more first areas. It is also possible in step b) for the at least one second color layer to be applied in the one or more second areas and not to be applied in the one or more first areas.

Preferably, in step b) at least one second replication layer is applied, in particular over the whole surface or in areas, as one of the second layers and in step b) a relief structure is molded onto and/or into the at least one second replication layer as second optically variable structure.

The second optically variable structure is preferably molded both in the one or more first areas and in the one or more second areas.

In particular, in step b) at least one second opaque layer, in particular a second opaque metal layer, is applied to the second replication layer as second layer, wherein the second opaque layer is preferably applied in the one or more second areas, but is preferably not applied in the one or more first areas or is removed again there after it has been applied or after application.

It is possible in steps a) and/or b) for one or more first color layers of the one or more first color layers and/or for one or more second color layers of the one or more second color layers to be applied by a printing or coating method, in particular digital printing, in particular inkjet printing, xerographic printing, or gravure printing, screen printing, offset printing, slot casting, metallization, and/or sputtering.

Further, it is possible for the one or more first layers, which form the first optically variable structure, and/or the one or more second layers, which form the second optically variable structure, to comprise at least one reflective layer. The at least one reflective layer is preferably formed as opaque, translucent or transparent reflective layer and in particular selected from: a metal layer, a partially shaped metal layer, a layer of metallic raster dots and/or raster lines and/or differently shaped raster elements, an HRI layer, an LRI layer and/or a combination of two or more HRI layers and/or LRI layers.

It is also possible in steps a) and/or b) for one or more first color layers of the one or more first color layers and/or for one or more second color layers of the one or more second color layers and/or the at least one reflective layer to be arranged in register with each other.

In particular, in step b) one or more second layers of the one or more second layers are applied, as one or more second opaque, translucent or transparent layers, in particular selected from: metal layer, partially shaped metal layer, reflective layer, layer of metallic raster dots, HRI layer, LRI layer, and/or a combination of two or more HRI layers and/or LRI layers, to the at least one first replication layer and/or the at least one first opaque layer and/or the at least one second replication layer in one or more first areas of the one or more first areas and/or in one or more second areas of the one or more second areas.

It is possible for a positive photoresist and/or a negative photoresist and/or an image reversal photoresist to be used for the formation of the at least one first opaque layer and/or for the formation of the at least one second opaque layer, wherein the positive photoresist and/or the negative photoresist in particular consists of one or more first color layers of the one or more first color layers and/or of one or more second color layers of the one or more second color layers, wherein the one or more first color layers and/or the one or more second color layers are used as first etching masks and/or second etching masks.

By a positive photoresist is preferably meant a photosensitive varnish, in which the solubility in a solvent, preferably a developer solution, increases in particular under the influence of electromagnetic radiation, in particular UV radiation.

By an image reversal photoresist is preferably meant a positive photoresist, in which the solubility of the exposed areas is preferably selectively reduced under the influence of heat, with the result that they in particular resist a renewed flood exposure of the developer solution.

By a negative photoresist is preferably meant a photosensitive varnish, in which the solubility in a solvent decreases under the influence of electromagnetic radiation, in particular UV radiation.

It is possible for the at least one first replication layer and/or the at least one first opaque layer and/or the one or more first color layers and/or the at least one second replication layer and/or the at least one second opaque layer and/or the one or more second color layers and/or the at least one reflective layer to have radiation-curable constituents which, after they have been applied, or after the application, and/or stamped and/or printed onto the carrier ply and/or the at least one first replication layer and/or the at least one first opaque layer and/or the one or more first color layers and/or the at least one second replication layer and/or the at least one second opaque layer and/or the one or more second color layers and/or the at least one reflective layer, are preferably cured by electromagnetic radiation.

Further, it is possible for the one or more first color layers to be provided as first exposure masks and/or the one or more second color layers to be provided as second exposure masks during the structuring and/or curing of the at least one first replication layer and/or the at least one first opaque layer and/or the one or more first color layers and/or the at least one second replication layer and/or the at least one second opaque layer and/or the one or more second color layers and/or the at least one reflective layer by the electromagnetic radiation.

It is also possible in step a) and/or b) for one or more first openings and/or second openings to be introduced into the at least one first replication layer and/or the at least one first opaque layer and/or the one or more first color layers and/or the at least one second replication layer and/or the at least one second opaque, translucent or transparent layer and/or the one or more second color layers and/or the at least one reflective layer, wherein the one or more openings preferably have a transmittance of greater than 50%, in particular of greater than 90%, and/or preferably of less than 10%, in particular of less than 5%.

It is further possible for the security element and/or the first security feature and/or the second security feature to comprise a functional layer, preferably a detachment layer, for example made of hot-melting material, which in particular makes it easier to detach the carrier ply from the other layers of the multilayer body, which are arranged on a side of the detachment layer facing away from the carrier ply. This is in particular advantageous if the multilayer body is formed as a transfer ply, such as is used for example in a hot-stamping method, cold-stamping method or an IMD method (IMD=In-Mold Decoration).

It has furthermore proved effective, in particular if the multilayer body is used as a transfer film, if the functional layer has at least one protective layer, for example a protective varnish layer, in addition to a detachment layer. After the multilayer body has been joined to a substrate and the carrier ply has been detached from the layers of the multilayer body which are preferably arranged on a side of the detachment layer facing away from the carrier ply, the protective layer preferably provides protection to layers arranged underneath it against abrasion, damage, chemical attacks or the like. In particular, the uppermost layer after removal of the carrier film has further functions, such as for example adhesion in the case of overlamination or ensuring the printability, preferably by means of thermal transfer, inkjet and/or offset printing methods. Furthermore, the functional layers in particular contain plies which preferably influence the functioning of the adhesion to or between the adjacent layers.

In particular, a first transparent, colored varnish layer is printed on the functional layer in individual partial areas. By transparent is preferably meant here that the varnish layer is preferably at least partially transparent to radiation in the visible wavelength range. By colored is preferably meant here that the varnish layer in particular exhibits a visible color impression with sufficient daylight.

Both the areas of the functional layer printed with the first varnish layer and the unprinted areas of the functional layer are preferably covered by a first replication layer, which preferably at least partially evens out the relief structure of the decorative ply, i.e. the different levels in the printed and the unprinted areas. The replication layer in particular has a relief structure completely or partially. A thin metal layer is preferably arranged on the first replication layer in register with, and when observed perpendicular to the plane of the carrier ply, congruent with the first colored varnish layer.

A second transparent, colored varnish layer is preferably printed in individual partial areas on the first metal layer as well as in the areas of the first replication layer which are not covered by a metal layer. Both the areas printed with the second colored varnish layer and the unprinted areas, preferably the first replication layer and/or the first metal layer, are in particular covered by a second replication layer, which preferably evens out the relief structure of the decorative ply, i.e. the different levels in the printed and the unprinted areas. Depending on the varnish chemistry, application quantity and application condition, only a partial evening out is preferably effected, which is in particular not decisive for the realization of the feature, however. The replication layer preferably has a relief structure completely or partially. A second thin metal layer is preferably arranged on the second replication layer in register with, and when observed perpendicular to the plane of the carrier ply, congruent with the first and second varnish layers and thus also in register with the first metal layer.

Both the areas of the second replication layer covered with the second metal layer and the uncovered areas of the second replication layer are preferably covered with a compensation layer, which evens out or covers and fills in differences in level in particular caused by the relief structure and the metal layer arranged in areas, wherein the multilayer body preferably has a largely flat, substantially unstructured surface on the side of the compensation layer facing away from the carrier ply. In particular, the thickness of the compensation layer varies in this way. The compensation layer preferably accomplishes further functional tasks, such as for example improvement of the adhesion to subsequent layers, protective functions with respect to chemical and/or physical attacks, as barrier layer or adhesive layer.

If the compensation layer has a similar refractive index to the second replication layer and/or if the difference in refractive index is less than approximately 0.3, then in particular the areas of the relief structure of the second replication layer not covered with the second metal layer and directly adjacent to the compensation layer are preferably optically obliterated, because optically recognizable layer boundaries between the replication layer and the compensation layer are preferably no longer present there due to the similar refractive index of the two layers.

The multilayer body is preferably a section of a transfer film, for example a hot-stamping film, which can be arranged on a substrate by means of an adhesive layer. The compensation layer is preferably designed as an adhesive layer, for example hot-melt adhesive, or an adhesive layer is attached to the side of the compensation layer facing away from the carrier ply. The adhesive layer is in particular a hot-melt adhesive which melts with thermal action and joins the multilayer body to the surface of the substrate.

In the case of a development of the multilayer body as a laminating film, i.e. without a detachment layer for detaching the carrier ply from the layers of the multilayer body, an additional, or, as an alternative to the adhesive layer, a further carrier ply is preferably provided on the side of the compensation layer facing away from the first carrier ply. This laminate body, which preferably consists of two carrier plies on the outside and the layers of the multilayer body inside, can for example be laminated into card composites for further use, for example into polycarbonate (PC). For this, it is advantageous if the carrier plies consist of the same material as the layers of the card composite that are adjacent to the laminate body, for example of PC.

BRIEF DESCRIPTION OF THE DRAWINGS

In the following the invention is explained with reference to several embodiment examples utilizing the attached drawings by way of example.

DETAILED DESCRIPTION OF THE PREFERRED EMBODIMENTS

Figure 1:
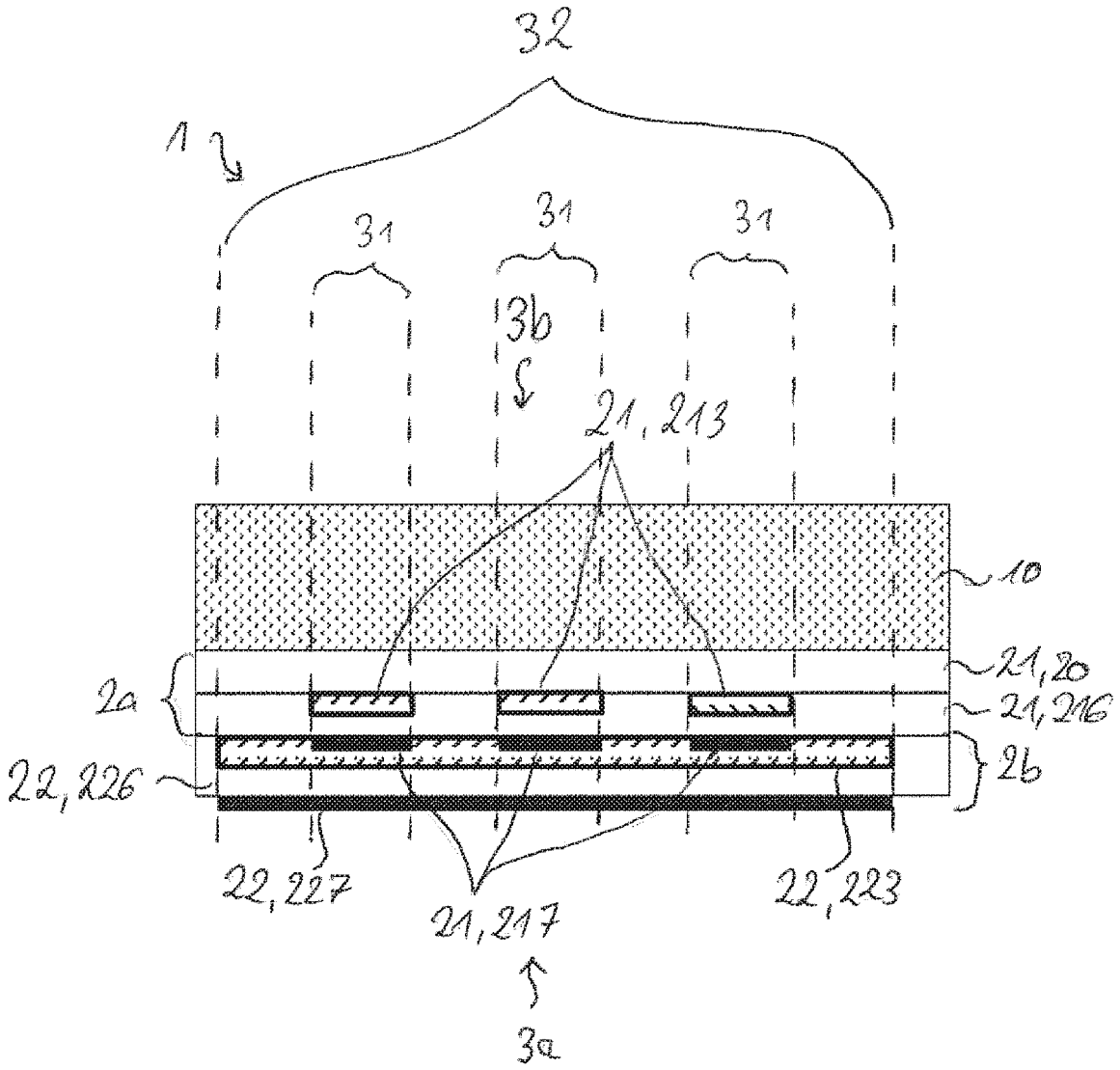
FIG. 1 shows a schematic representation of a security element.

FIG. 1 shows a security element 1 with a front side 3*b* and a rear side 3*a* lying opposite the front side 3*b* in cross section, wherein the security element 1 has two or more security features 2, wherein a first security feature 2*a* of the two or more security features 2 comprises one or more first layers 21 and a second security feature 2*b* of the two or more security features 2 comprises one or more second layers 22, wherein the first security feature 2*a* and the second security feature 2*b* are in particular arranged in register with each other, wherein the first security feature 2*a* generates at least one first optically variable effect and the second security feature 2*b* generates at least one second optically variable effect, wherein the at least one first optically variable effect has a first color and the at least one second optically variable effect has a second color, wherein the first color and the second color differ from each other.

Figure 2:
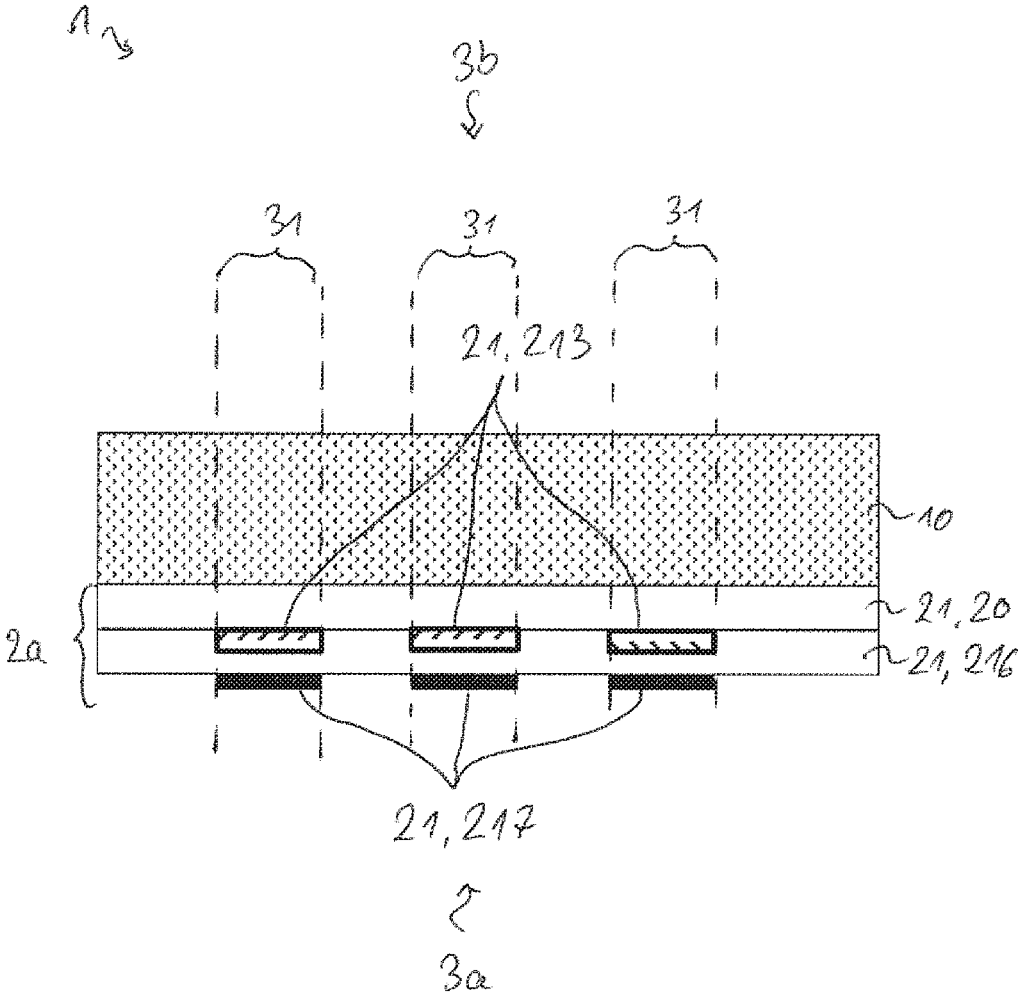
FIG. 2 shows a schematic representation of a security element.

FIG. 1 further shows that the security element 1 comprises a carrier ply 10. A first layer 21, which is for example formed as functional layer 20, is applied to the rear side 3*a* of the carrier ply 10. A first layer 21 is applied to the side of the functional layer 20 facing away from the carrier ply 10 in three first areas 31, wherein this first layer 21 is formed as first color layer 213. A further first layer 21, which is formed as first replication layer 216, is applied to the side of the functional layer 20 facing away from the carrier ply 10 and to the side of the first color layer 213 facing away from the carrier ply 10. A further first layer 21, which is formed as first metal layer 217, is applied to the side of the first replication layer 216 facing away from the carrier ply 10 in the three first areas 31. The functional layer 20, the first color layer 213, the first replication layer 216 and the first metal layer 217 preferably form the first security feature 2*a*. Such a security feature 2*a* is also shown in FIG. 2.

The security feature 1 shown in FIG. 1 further has a second layer 22, which is formed as second color layer 223, on the side of the first replication layer 216 and of the first metal layer 217 facing away from the carrier ply 10 in a second area 32. A second replication layer 226 is applied to the side of the first replication layer 216 and of the second color layer 223 facing away from the carrier ply 10. The side of the second replication layer 226 facing away from the carrier ply 10 has a further second layer 22, which is formed as second metal layer 227 in the second area 32. The second color layer 223, the second replication layer 226 and the second metal layer 227 preferably form the second security feature 2*b*.

The method for producing the security element 1 with the three first areas 31 and a second area 32 shown in FIG. 1 comprises the following steps:

step a: applying a first security feature 2*a* comprising one or more first layers 21 to a carrier ply 10, wherein the first security feature 2*a* generates at least one first optically variable effect, wherein the at least one first optically variable effect has a first color, step b: applying a second security feature 2*b* comprising one or more second layers 22 to the carrier ply 10 and/or the first security feature 2*a* such that the first security feature 2*a* is in particular arranged in register with the second security feature 2*b*, wherein the second security feature 2*b* generates at least one second optically variable effect, wherein the at least one second optically variable effect has a second color, and wherein the first color and the second color differ from each other.

In step a the first color layer 213 and/or one or more layers which form and/or have one or more first optically variable structures are preferably applied to the carrier ply 10 as first layer 21 or first layers 21. The one or more first optically variable structures are preferably formed in the one or more first areas 31 and, however, not formed in the one or more second areas 32 or optically obliterated by a varnish layer with a refractive index which differs from the layer with the optically variable structures lying underneath it by not more than 0.3, preferably by not more than 0.1.

It is possible in step a for the first color layer 213 to be applied in the three first areas 31, but not to be applied in the second area 32 or to be removed again in the second area 32, which does not overlap with the three first areas 31, after it has been applied.

Further, it is possible in step a for the first replication layer 216 to be applied, in particular over the whole surface or in areas, as first layers 21 and in step a for a relief structure to be molded into the first replication layer 216 as first optically variable structure.

It is further also possible in step a for at least one first opaque layer, in particular a first opaque metal layer, to be applied to the first replication layer 216 as first layer 21, wherein the first opaque layer is preferably applied in the one or more first areas 31, but is not applied in the one or more second areas 32 or is removed again there after it has been applied, is preferably removed using the first color layer 213 as exposure mask registration-accurate relative to the first color layer 213. The first metal layer 217 can be formed, for example, as first opaque metal layer.

Preferably, in step b the second color layer 223 and/or one or more layers which form and/or have one or more second optically variable structures are in particular applied to the carrier ply 10 and/or the first color layer 213 as second layer 22 or second layers 22. It is in particular possible in step b for the second color layer 223 to be applied in the second area 32 and in the three first areas 31. Further, it is possible in step b for the second color layer 223 to be applied in the second area 32 and not to be applied in the three first areas 31.

In particular, in step b the second replication layer 226 is applied over the whole surface as one of the second layers 22. In step b a relief structure is preferably molded onto and/or into the second replication layer 226 as second optically variable structure. It is possible for the second optically variable structure to be molded both in the three first areas 31 and in the second area 32.

Further, it is possible in step b for at least one second opaque layer 220*a*, in particular a second opaque metal layer 220*b*, to be applied to the second replication layer 226 as second layer 22, wherein the second opaque layer 220*a* is preferably applied in the second area 32, but is preferably not applied in the three first areas 31 or is removed again there after application. The second metal layer 227 can be formed, for example, as second opaque metal layer.

The one or more first layers 21, which form the first optically variable structure, and/or the one or more second layers 22, which form the second optically variable structure, preferably comprise at least one reflective layer, wherein the at least one reflective layer is formed as opaque, translucent or transparent reflective layer and is preferably selected from: a metal layer, a partially shaped metal layer, a layer of metallic raster dots, an HRI layer, an LRI layer or a combination of several HRI layers and/or LRI layers.

It is possible in steps a and/or b for the first color layer 213 and/or the second color layer 223 and/or the at least one reflective layer to be arranged in register with each other.

In particular, in step b one or more second layers of the one or more second layers 22 are applied, as one or more opaque, translucent or transparent layers, in particular selected from: metal layer, partially shaped metal layer, reflective layer, layer of metallic raster elements, such as for example raster dots and/or raster lines, HRI layer, an LRI layer or a combination of HRI layers and/or LRI layers, to the at least one first replication layer 216 and/or the first metal layer 217 and/or the second replication layer 226 in the three first areas 31 and/or in the second area 32.

It is possible for a positive photoresist and/or a negative photoresist to be used for the formation of the at least one first opaque layer, in particular the first metal layer 217*a*, and/or for the formation of the at least one second opaque layer, in particular the second metal layer 227*a*, wherein the first color layer 213 and/or the second color layer 223 are used as first etching masks and/or second etching masks. If a positive photoresist is, for example, applied to the first metal layer 217*a* applied over the whole surface and the security element 1 is then exposed using suitable radiation from the front side 3*b*, i.e. through the carrier ply 10, the positive photoresist is protected from the radiation by the first color layer 213 in the first areas 31. In the other areas, the positive photoresist is soluble for a suitable solvent applied subsequently, whereby the photoresist is washed off in the areas not protected by the first color layer 213. The uncovered first metal layer is preferably soluble in the same solution as the photoresist. In that case, the structuring of the first metal layer is effected together with the washing-off of the exposed positive photoresist.

Further, it is possible for the first replication layer 216 and/or the at least one first metal layer 217 and/or the first color layer 213 and/or the second replication layer 226 and/or the second metal layer 227 and/or the second color layer 223 to have radiation-curable constituents which, after they have been applied and/or stamped and/or printed onto the carrier ply 10 and/or the first replication layer 216 and/or the first metal layer 217 and/or the first color layer 213 and/or the second replication layer 226 and/or the second metal layer 227 and/or the second color layer 226, are preferably cured by electromagnetic radiation.

Preferably, the first color layer 213 is provided as first exposure mask and/or the second color layer 223 is provided as second exposure mask during the curing of the first replication layer 216 and/or the first color layer 213 and/or the second replication layer 226 and/or the second color layer 223 by the electromagnetic radiation.

Further, it is possible in step a and/or b for one or more first openings and/or one or more second openings to be introduced into the first replication layer 216 and/or the first metal layer 217 and/or the first color layer 213 and/or the second replication layer 226 and/or the second metal layer 227 and/or the second color layer 223, wherein the one or more first openings preferably have a transmittance of greater than 50%, in particular of greater than 90%, and/or preferably of less than 10%, in particular of less than 5%.

It is possible for one or more first layers 20, 213, 216, 217 of the one or more first layers 21 and/or one or more second layers 223, 226, 227 of the one or more second layers 22 to be arranged next to each other, in particular in one plane, or to be arranged one underneath the other, in particular in several planes. Such a plane is preferably spanned by one of the first and/or second layers 21, 22.

The security element 1 shown in FIG. 1 has a spatial arrangement of the first layers 20, 213, 216, 217 and the second layers 223, 226, 227 such that the one or more first layers 20, 213, 216, 217 are arranged above the one or more second layers 223, 226, 227 when the security element 1 is observed from the front side 3*b* and the one or more second layers 22 completely overlap the one or more first layers 21 when the security element 1 is observed from the rear side 3*a*.

It is also possible for the one or more first layers 20, 213, 216, 217 to be arranged above the one or more second layers 223, 226, 227 when the security element 1 is observed from the rear side 3*a* and the one or more second layers 22 in particular to completely overlap, partially overlap or not overlap the one or more first layers 21 or to be adjacent to each other, in particular at least in areas, for an observer from the front and/or rear side when the security element 1 is observed from the front side 3*b*.

In step b the second color layer 223 as well as the second replication layer 226, into which a second optically variable structure is preferably introduced, is preferably applied. The introduction of the second optically variable structure is effected, for example, by thermal replication or by UV replication. It is possible for the second optically variable structure to be metallized with a second layer consisting of aluminum.

Further, it is possible for a third or fourth color layer to be applied to the second replication layer 226 and/or to the second optically variable structure, wherein the first color layer 213 and/or the second color layer 223 are preferably used as mask, in particular as first exposure mask and/or as second exposure mask. Here, the carrier ply 10 is in particular formed transparent or at least translucent.

It is also possible for the first security feature 2*a* to be visible in one or more first areas 31 of the security element 1 and the second security feature 2*b* to be visible in one or more second areas 32 of the security element 1 when observed in reflected light and/or when observed in transmitted light from the front side 3*b* and/or the rear side 3*a*.

Further, it is possible for the one or more first areas 31 and/or the one or more second areas 32 to be adjacent to each other at least in sections, in particular to be physically adjacent to each other and/or preferably to be only apparently adjacent to each other for an observer from the front and/or rear side. The first security feature 2*a* is preferably formed opaque in the one or more first areas 31 and formed transparent or translucent in the one or more second areas 32. It is possible for one or more of the first layers 21 to be formed as opaque layer, in particular as opaque metal layer, wherein the opaque layer is provided in the one or more first areas 31, but is not provided in the one or more second areas 32.

It is further possible for one or more first layers of the one or more first layers 21 to form and/or have a first optically variable structure and/or for one or more second layers of the one or more second layers 22 to form and/or have a second optically variable structure. The first optically variable structure is preferably provided in the one or more first areas 31, but not provided in the one or more second areas 32.

Further, it is possible for the first optically variable structure to be formed as optically variable relief structure which is molded into a replication layer, and for the optically variable relief structure not to be molded into the replication layer in the one or more second areas 32 and/or to be optically obliterated by applying a varnish layer with a refractive index which differs from the refractive index of the replication layer by not more than 0.3, in particular not more than 0.1.

In particular, the varnish layer, which preferably optically obliterates the optically variable relief structure, is made up of a second layer of the one or more second layers 22. The second optically variable structure 221 is preferably provided both in the one or more first areas 31 and in the one or more second areas 32.

It is possible for the one or more first layers 21, which form the first optically variable structure, and/or the one or more second layers 22, which form the second optically variable structure 221, to comprise at least one reflective layer 212, wherein the reflective layer 212 is preferably provided in the one or more first areas 31, but is not provided in the one or more second areas 32.

Further, it is possible for the reflective layer 212 to be formed as opaque, translucent or transparent reflective layer and in particular to be selected from: a metal layer, a partially shaped metal layer, a layer of metallic raster elements, in particular raster dots, an HRI layer, an LRI layer, a combination of two or more HRI layers and/or LRI layers, in particular layer sequences comprising two or more HIR layers and/or LRI layers.

The first optically variable structure and/or the second optically variable structure 221 preferably generates an achromatic optically variable effect.

It is also possible for the first optically variable structure and/or the second optically variable structure 221 to comprise a volume hologram and/or an optically active relief structure, in particular selected from: diffraction grating, hologram, computer-generated hologram, asymmetrical diffraction structure, matte structure, in particular anisotropic matte structure, blazed grating, zero-order diffraction structure, Fresnel-type freeform surface, refractive structure, in particular micromirror arrangement, light-refracting or focusing structure, in particular microlens arrangement.

It is further possible for the first optically variable structure to differ from the second optically variable structure 221, in particular for the first optically variable structure to differ from the second optically variable structure 221 in one or more structure parameters, in particular in alignment, grating period, grating depth, stochastic parameters, in particular roughness depth, preferably correlation length in the case of matte structures, and/or to be allocated to different classes of optically variable structures. The at least one first layer of the one or more first layers 21 is preferably formed as first color layer 213 and/or the at least one second layer of the one or more second layers 22 is preferably formed as second color layer 223.

It is possible for the varnish layer to be made up of the second color layer 223 or a replication layer of the second optically variable structure 221.

It is further possible for the first color layer 213 to be provided in the one or more first areas 31, but not to be provided in the one or more second areas 32. Further, it is possible for the second color layer 223 to be provided both in the one or more first areas 31 and in the one or more second areas 32. It is also possible for the second color layer 223 to be provided in the one or more second areas 32 and not to be provided in the one or more first areas 31.

In particular, the first color layer 213 and the second color layer 223 have different colors.

The first color layer 213 and/or the second color layer 223 are preferably formed as transparent or translucent layer.

It is possible for the first color layer 213 and/or the second color layer 223 to be selected from: layer containing dyes and/or pigments, in particular optically variable pigments, liquid crystal pigments, interference layer pigments, interference layer system, in particular consisting of two or more layers with different refractive indices or an absorption layer, a spacer layer and a reflective layer, layer consisting of a liquid crystal material, in particular cholesteric liquid crystal material, volume hologram layer, metal layer.

Further, it is possible for the first color layer 213 and/or the second color layer 223 and/or the reflective layer to be arranged in register with each other.

It is further possible for at least one first layer of the one or more first layers 21 to be made up of a transparent or translucent replication layer, preferably formed over the whole surface, for an optically active relief structure to be molded at least into a surface of the replication layer and in the one or more first areas 31 to be covered with one of the one or more first layers 21, which are formed as opaque metallic reflective layer, but for the surface of the replication layer in the one or more second areas 32 not to be covered with the opaque metallic reflective layer.

Preferably, at least one second layer of the one or more second layers 31*b* is made up of a transparent or translucent replication layer, preferably formed over the whole surface, that an optically active relief structure is molded at least into a surface of the replication layer and in the one or more second areas 32 is covered with one of the one or more second layers 22, which are formed as reflective layer.

It is possible for at least one first layer of the one or more first layers 21, preferably in the one or more first areas 31, to have one or more first openings and/or for at least one second layer of the one or more second layers 22, preferably in the one or more second areas 32, to have one or more second openings, wherein the first openings and/or the second openings in particular have a transmittance of greater than 50%, preferably of greater than 90%, and wherein the at least one first layer of the one or more first layers 21 outside the first openings in particular have a transmittance of less than 10%, preferably of less than 5%.

Further, it is possible for the one or more first openings and/or the one or more second openings to be provided as first rasterizations and/or as second rasterizations, wherein the spacings of the first rasterizations and/or of the second rasterizations from each other, in particular the average spacings of the first rasterizations and/or of the second rasterizations from each other, are preferably less than or equal to 300 μm, in particular less than or equal to 150 μm.

It is further possible for at least one first area of the one or more first areas 31 having a first rasterization and at least one second area of the one or more second areas to overlap such that the at least one first optically variable effect and the at least one second optical variable effect is detectable by an observer from the front side 3*b* or the rear side 3*a*, in particular in reflected light and/or in transmitted light.

It is also possible for at least one first area of the one or more first areas 31 and at least one second area of the one or more second areas 32 having a second rasterization to overlap such that the at least one first optically variable effect and the at least one second optical variable effect is detectable by an observer from the front side 3*b* or the rear side 3*a*, in particular in reflected light and/or in transmitted light.

The at least one first optically variable effect and/or the at least one second optically variable effect, when the security element 1 is tilted and/or bent and/or rotated, preferably provides a sequence of colors, in particular a sequence of color values and/or a sequence of color lightnesses and/or a sequence of color saturations, and/or a color change, in particular a color value change and/or a color lightness change and/or a color saturation change, which produce a movement effect, a morphing effect and/or a flip effect, in particular a color flip effect, and/or a 3D form virtually jumping out or jumping back.

FIG. 1 shows that the second color layer 223 as second exposure mask completely overlaps and overhangs the first color layer 213 as first exposure mask.

The three first areas 31 and/or the second area 32 are preferably shaped in each case in the form of a design element 4, in particular shaped as: an alphanumeric character, a coding, in particular a barcode, a character, a symbol, a microprint, an image, a logo, an emblem or a motif. Instead of the first color layer 213 and/or second color layer 223, which in particular have a homogeneous coloring, one or more different colors are preferably arranged next to each other or at least partially overlapping, for example as motif and/or image.

It is further possible for the first color layer 213 and/or the second color layer 223 to have a color progression and/or a color gradient in at least one predetermined direction. The one or more colors, preferably the first color and/or the second color, of the first color layer 213 and/or of the second color layer 223 changes gradually in particular with respect to the color saturation and/or have a gradient in the hue.

Further, it is possible for the first color layer 213 and/or the second color layer 223 or at least one further color layer to be formed as opaque to semi-opaque color layer.

It is also possible for the second color layer 223 to be omitted and a thin-film interference layer stack to be applied to the second replication layer 226. Such a thin-film interference layer stack preferably consists of at least one semi-transparent absorber layer, at least one transparent dielectric spacing layer and at least one opaque mirror layer or preferably, alternatively to the opaque mirror layer, a further semi-transparent absorber layer. In this case, the color impression generated in a lower layer plane of such a thin-film interference layer stack is in particular formed not by a transparent color layer, but preferably by interference. Further, it is possible to introduce at least one volume hologram instead of the first color layer 213 and/or the second color layer 223.

The register, preferably perfect register, between the first color layer 213 and/or the second color layer 223 and the first metal layer 217 and/or the second metal layer 227 can preferably be produced by means of a washing method, in which in particular a color layer 213, 223 created in a first step serves as mask in order to preferably wash off a metal layer 217, 227 located underneath it in register. In particular, a coating with a single-layered or multi-layered adhesive layer is subsequently effected, wherein optional additional layers preferably serve as adhesion-promoter layers and/or barrier layers and/or stabilizing layers and/or leveling layers, with the result that the security feature, in particular the first security feature and/or the second security feature, is transferred onto a substrate to be protected and/or a security document, for example by means of hot stamping. It is also possible for the coating to be effected with an adhesion-promoter layer, which is in particular designed for the subsequent transfer by means of cold stamping. Further, it is possible to dispense with an adhesive layer depending on the application and substrate material.

FIG. 2 in particular shows a film comprising a first security feature 2*a* in cross section, wherein the security feature 2*a* is preferably made up of the functional layer 20, the first color layer 213, the first replication layer 216 and the first metal layer 217. One or more first layers 21 are applied to a carrier ply 10, which preferably consists of PET and has a thickness of from 4.5 μm to 100 μm, preferably 12 μm-50 μm. One of the first layers 21 is formed as first color layer 213, wherein the first color layer 213 is applied to the side, facing away from the carrier ply 10, of a further first layer 21, which is formed as functional layer 20, in three first areas 31. A first replication layer 216 is applied to the side of the functional layer 20 and of the first color layer 213 facing away from the carrier ply 10. Further, a first metal layer 217 is applied to the side of the first replication layer 216 facing away from the carrier ply 10 in the three first areas 31.

It is possible for the first color layer 213 to be used as mask or mask layer for the registered or register-accurate structuring of the first metal layer 217, which is in particular applied to the first replication layer 216, wherein the first replication layer 216 preferably has first optically variable structures.

Further, it is possible for the first color layer 213 to be applied, for example, by means of a printing method or a dyed photosensitive layer to be exposed by means of a photolithographic method, wherein the photosensitive layer is then structured according to the exposure and/or the intensity distribution of the exposure. Preferably, the dyed photosensitive layer structured in this way preferably subsequently functions as or is the first color layer 213.

Figure 3:
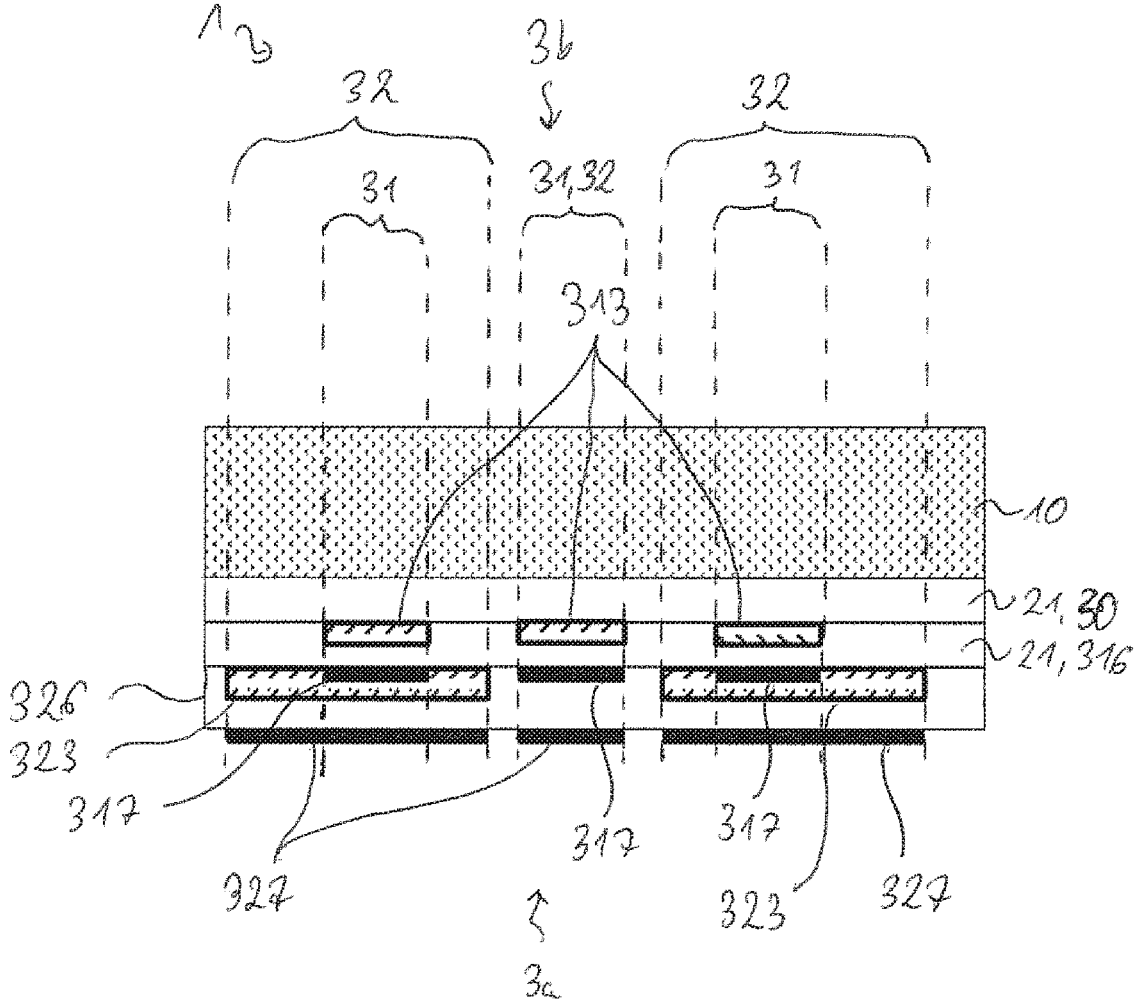
FIG. 3 shows a schematic representation of a security element.

FIG. 3 shows a security element 1 comprising a carrier ply 10, wherein a first layer 21, which is for example formed as functional layer 30, is applied to the rear side 3*a* of the carrier ply 10. A first layer 21 is applied to the side of the functional layer 30 facing away from the carrier ply 10 in three first areas 31, wherein this first layer 21 is formed as first color layer 313. A further first layer 21, which is formed as first replication layer 316, is applied to the side of the functional layer 30 facing away from the carrier ply 10 and to the side of the first color layer 313 facing away from the carrier ply 10. A further first layer 21, which is formed as first metal layer 317, is applied to the side of the first replication layer 316 facing away from the carrier ply 10 in the three first areas 31. The functional layer 30, the first color layer 313, the first replication layer 316 and the first metal layer 317 preferably form a first security feature.

The security element 1 shown in FIG. 3 further has a second layer 22, which is formed as second color layer 323 in two second areas 32, on the side of the first replication layer 316 and of the first metal layer 317 facing away from the carrier ply 10. A second replication layer 326 is applied to the side of the first replication layer 316 and of the second color layer 323 facing away from the carrier ply 10. The side of the second replication layer 326 facing away from the carrier ply 10 has a further second layer in the three second areas 32, which is formed as second metal layer 327. The second color layer 323, the second replication layer 326 and the second metal layer 327 preferably form the second security feature. One of the first areas 31 completely overlaps with one of the second areas 32.

FIG. 3 further shows that the second color layer 323 partially overlaps with the first color layer 313. Further, the second color layer 323 in particular has a gap between the left-hand second area 32 and the right-hand second area 32. It is in particular possible for the first color layer 313 in combination with the first metal layer 317 to serve as mask for the second metal layer 327. An observer preferably does not detect the second metal layer 327 in the first areas 31 with the first metal layer 317 when the security element 1 is observed from the front side 3*b*, because the first metal layer 317 is in particular opaque and here, preferably, no optical effect of the second metal layer 327 is detectable.

Figure 4A:
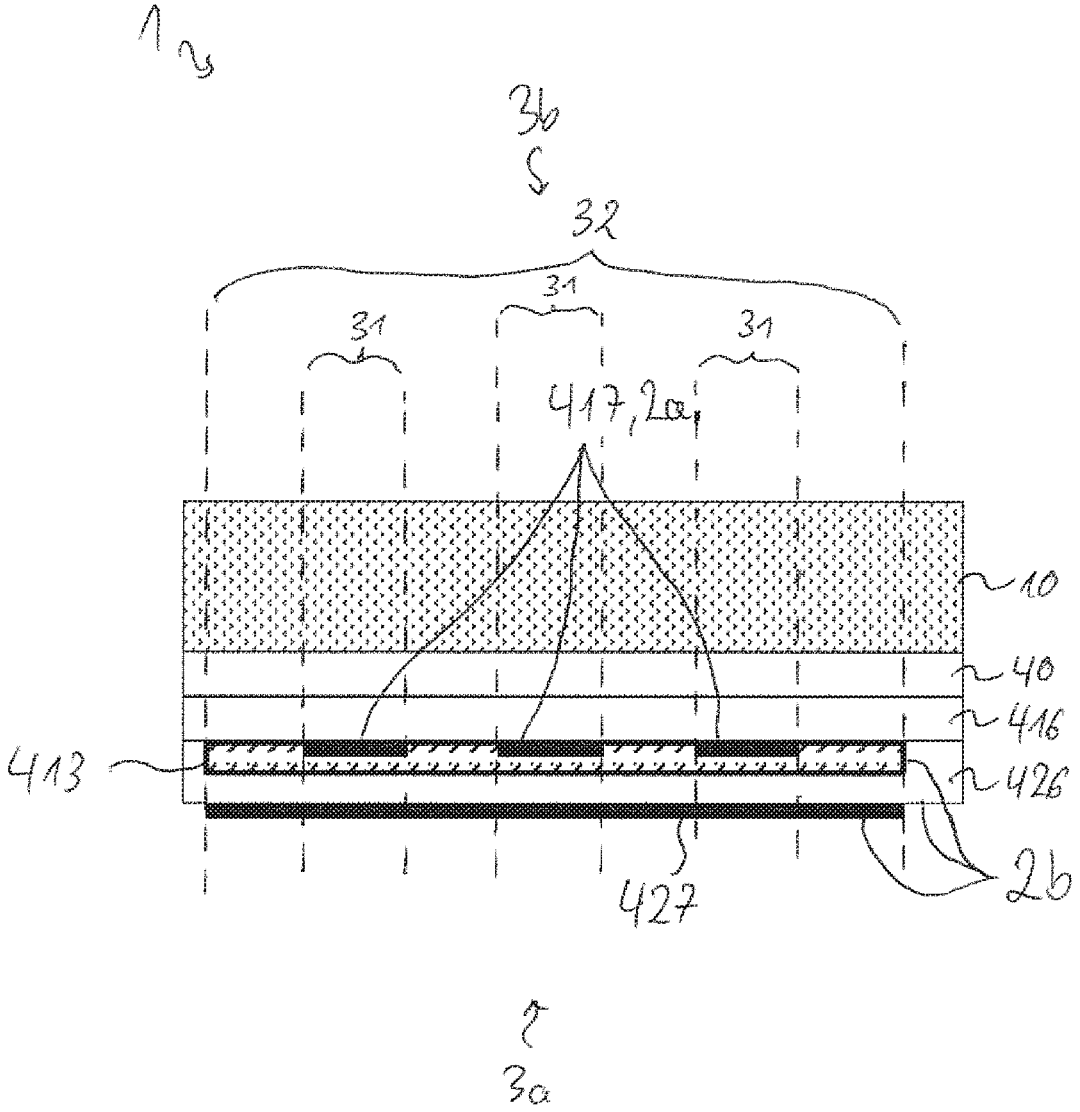
FIG. 4*a* shows a schematic representation of a security element.

FIG. 4*a* shows a security element 1 comprising a carrier ply 10, wherein a functional layer 40 is formed on the rear side 3*a* of the carrier ply 10. A first replication layer 416 is formed on the side of the functional layer 40 facing away from the carrier ply 10. A first metal layer 417 is formed on the side of the first replication layer 416 facing away from the carrier ply 10 in the three first areas 31. The functional layer 40, the first replication layer 416 and the first metal layer 417 preferably form a first security feature. The color of the first security feature 2*a* is substantially determined by the choice of the material of the metal layer 417 as well as the structures molded into the replication layer 416. The color of the first security feature is preferably metallic silver when substantially achromatically acting structures and a metal layer made of aluminum or silver are used.

The security element 1 shown in FIG. 4*a* further has a first color layer 413 on the side of the first replication layer 416 and of the first metal layer 417 facing away from the carrier ply 10 in the second area 32. Further, the security element 1 has a second replication layer 426 on the side of the first replication layer 416 and/or of the first metal layer 417 and/or of the first color layer 413 facing away from the carrier ply 10. The side of the second replication layer 426 facing away from the carrier ply 10 has a second metal layer 427 in the second area 32. The first color layer 413, the second replication layer 426 and the second metal layer 427 make up the second security feature 2*b*.

The security element 1 shown in FIG. 4*a* in particular corresponds to the security element shown in FIG. 1 except for the difference that no first color layer is present. Preferably, when the security element 1 is observed in reflected light from the front side 3*b*, the light reflected by the first metal layer 417 is in particular not filtered by a first color layer. The color of the metallic reflection at the first metal layer 417 is substantially detectable here, which is detectable, for example, as silver when aluminum is used as reflective layer or as copper-colored when copper is used as reflective layer. It is advantageous here that methods, such as for example etching methods, washing methods, mask exposure, or also the so-called zero.zero demetallization method can be used for the first metal layer, wherein these methods preferably make a high resolution and/or registration accuracy relative to the first optically variable effect possible.

Figure 4B:
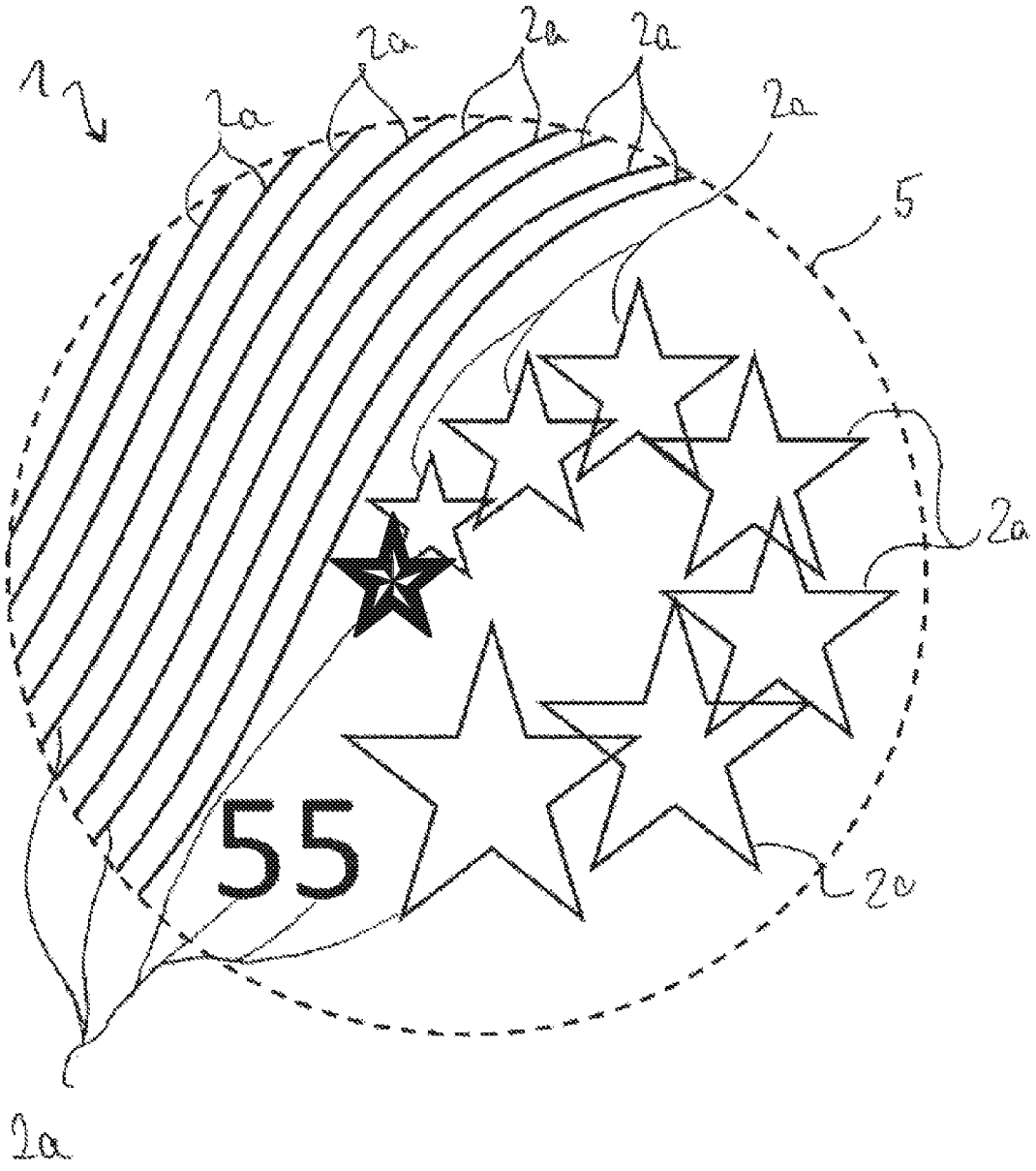
FIG. 4*b* shows a schematic representation of a security element.
Figure 4C:
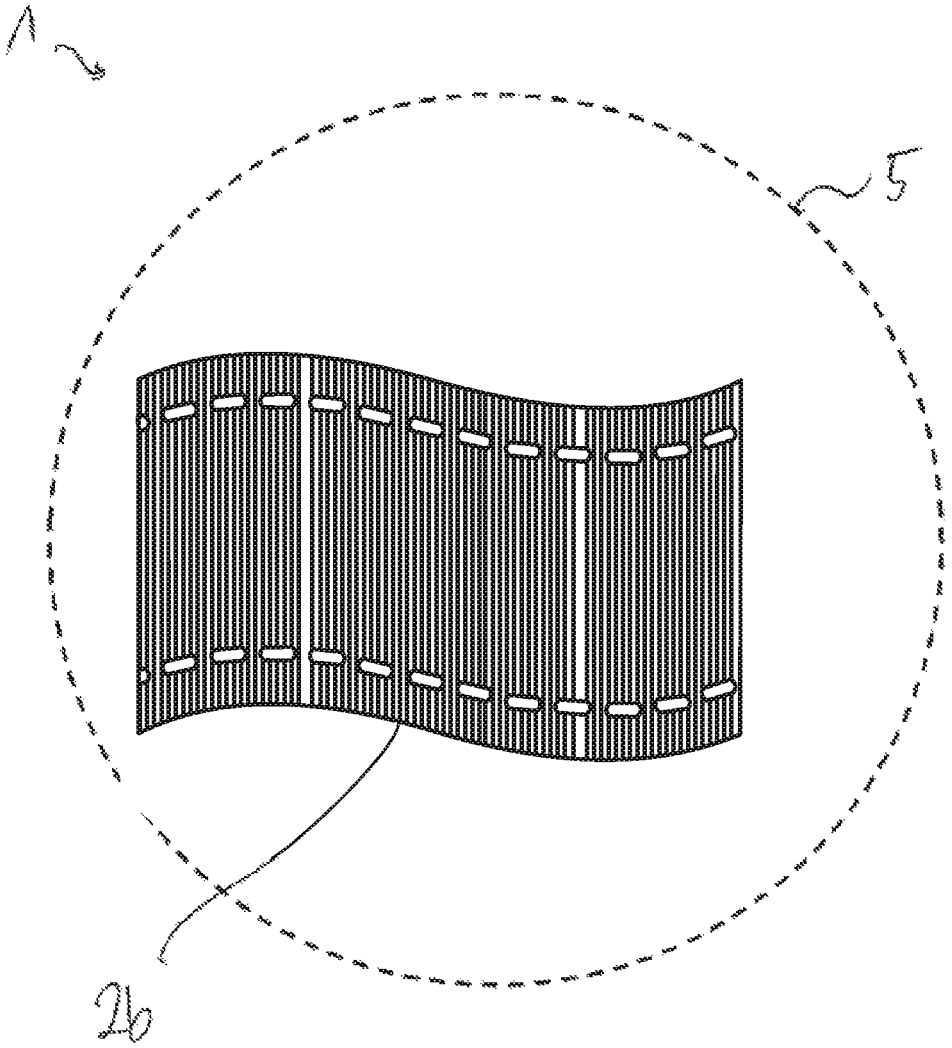
FIG. 4*c* shows a schematic representation of a security element.
Figure 4D:
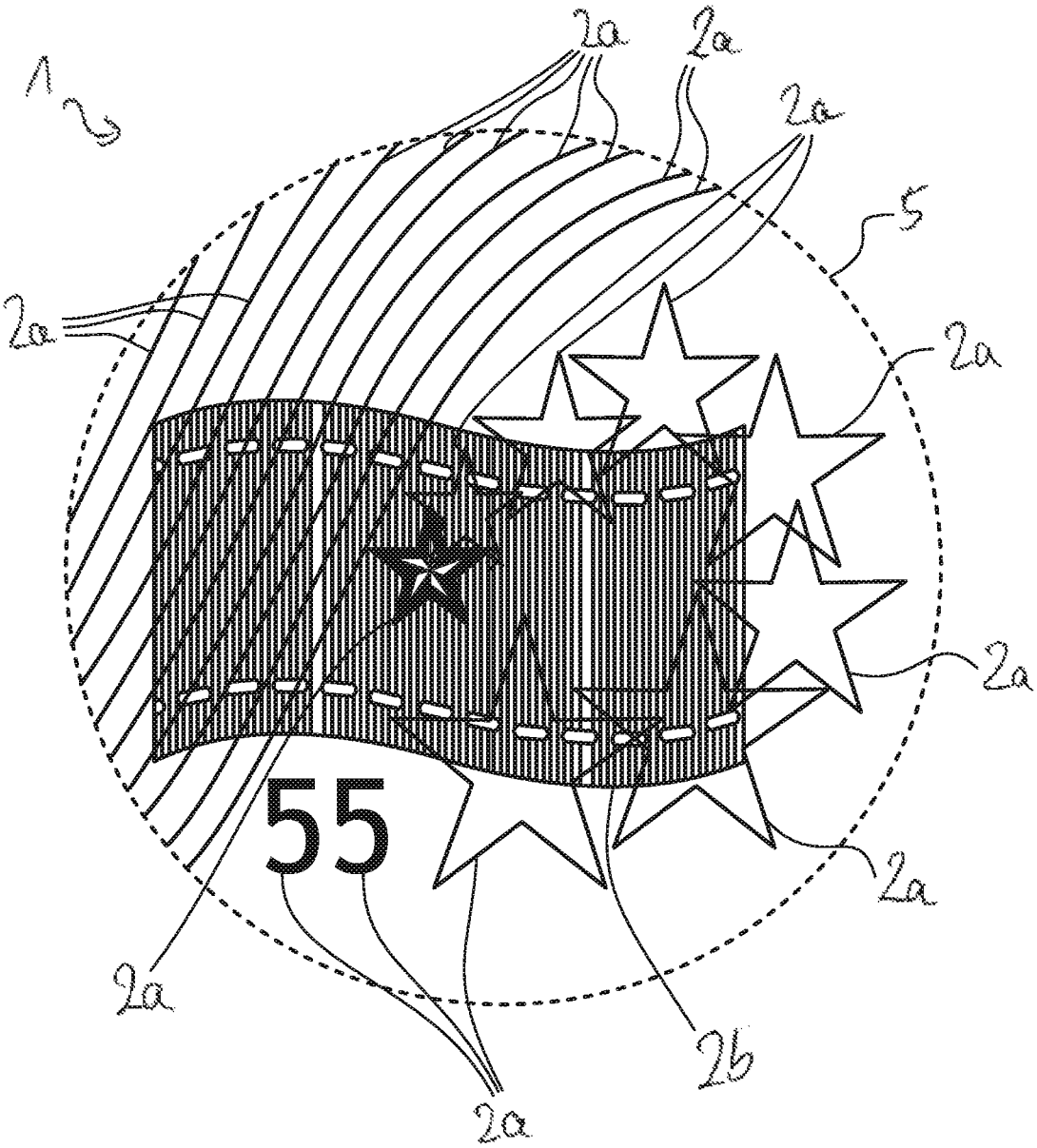
FIG. 4*d* shows a schematic representation of a security element.

FIGS. 4*b* to 4*d* show the structure of the security element 1 as well as the interplay of a first security feature 2*a* and a second security feature 2*b* in schematic top views. The security element 1 is shaped as a round patch, the outer edge 5 of which is indicated by a dashed line.

FIG. 4*b* shows, separated, an optical effect of the first security feature 2*a* when observed perpendicularly. The optical effect is preferably composed of diffractive movement effects in or also along the metallic line elements represented in black, a virtually three-dimensionally projecting, achromatic, metallized star close to the center of the first security feature 2*a* and the number "55" as achromatic matte area. The virtually three-dimensionally projecting, achromatic, metallized star is realized via a Fresnel freeform surface. The first security feature 2*a* has no color layer and thus appears substantially metallic silver.

FIG. 4*c* shows, separated, an optical effect of the second security feature 2*b* when observed perpendicularly. The optical effect is preferably composed of lightness bands moving horizontally depending on a varying observation and/or illumination angle, which are realized via achromatic, anisotropic matte structures. The optical effect can be seen in a flag-shaped metallized area with dashed interruptions. Because of the color layer 413 lying in front of the structures and the second metal layer 427 for an observer looking at the security element 1 from the front side 3*b*, the horizontally moving lightness bands appear monochromatically in the color of the color layer 413.

It is also possible for the second security feature 2*b* to have, instead of a color layer and a metal layer, a thin-film structure consisting of at least three layers:

absorber layer, in particular comprising a chromium layer with a thickness of 8 nm, transparent spacer layer, in particular comprising at least one layer with a thickness of 450 nm and/or consisting of $MgF_2$ or in particular comprising a polymeric varnish layer with a thickness of 500 nm, and metallic mirror layer, in particular comprising at least one layer with a thickness of 25 nm and/or consisting of aluminum.

In this case, the horizontally moving lightness bands preferably appear in different colors, in particular depending on the observation angle. For example, the lightness bands can appear in reddish hues when observed normally at approx. 25° and in greenish hues tilted to approx. 40°.

FIG. 4*d* shows the combined optical effect of the first security feature 2*a*, in particular shown in FIG. 4*b*, and of the second security feature 2*b*, in particular shown in FIG. 4*c*, when observed perpendicularly. In particular, the perfect register of the metallic silver star in the center of the security element 1 with the background appearing in the color of the color layer 413 is easily detectable and can be easily communicated for an observer.

The second security feature 2*b* optionally also has a computer-generated hologram in addition to the achromatic, anisotropic matte structures. This computer-generated hologram is preferably only provided in the area of the second security feature 2*b*, which lies behind the virtually three-dimensionally projecting, achromatic, metallized star close to the center of the first security feature 2*a*. Here, this star is not metallized over the whole surface unlike in FIG. 4*b*, but rather has a demetallized line or dot raster, preferably with a surface proportion of 10% to 20% of demetallized lines and/or dots. The line raster and/or dot raster preferably has a periodicity here which lies below the resolution limit of the human eye. This periodicity is preferably less than or equal to 300 μm and further preferably less than or equal to 150 μm. The computer-generated hologram is in particular computed such that it clearly and sharply represents an icon, a motif and/or symbols, such as for example numbers, letters and/or denomination signs, and/or an image, such as for example a barcode, when illuminated with a point light source. When illuminated with non-directional light sources, by contrast, the icons and/or symbols and/or images to be represented appear very blurred and thus hardly perceptible to the human eye.

Here, such a security element 1 preferably appears almost like the security element 1 shown in FIG. 4*d* for an observer when illuminated with non-directional light sources. When illuminated with a point light source, such as for example the spotlight of a smartphone, by contrast, the icon and/or the symbol and/or the image of the computer-generated hologram in particular appears to float above the star, wherein the icon and/or the symbol and/or the image appears in the color of the color layer 413, whereas the star is preferably detectable as metallic silver here.

Figure 4E:
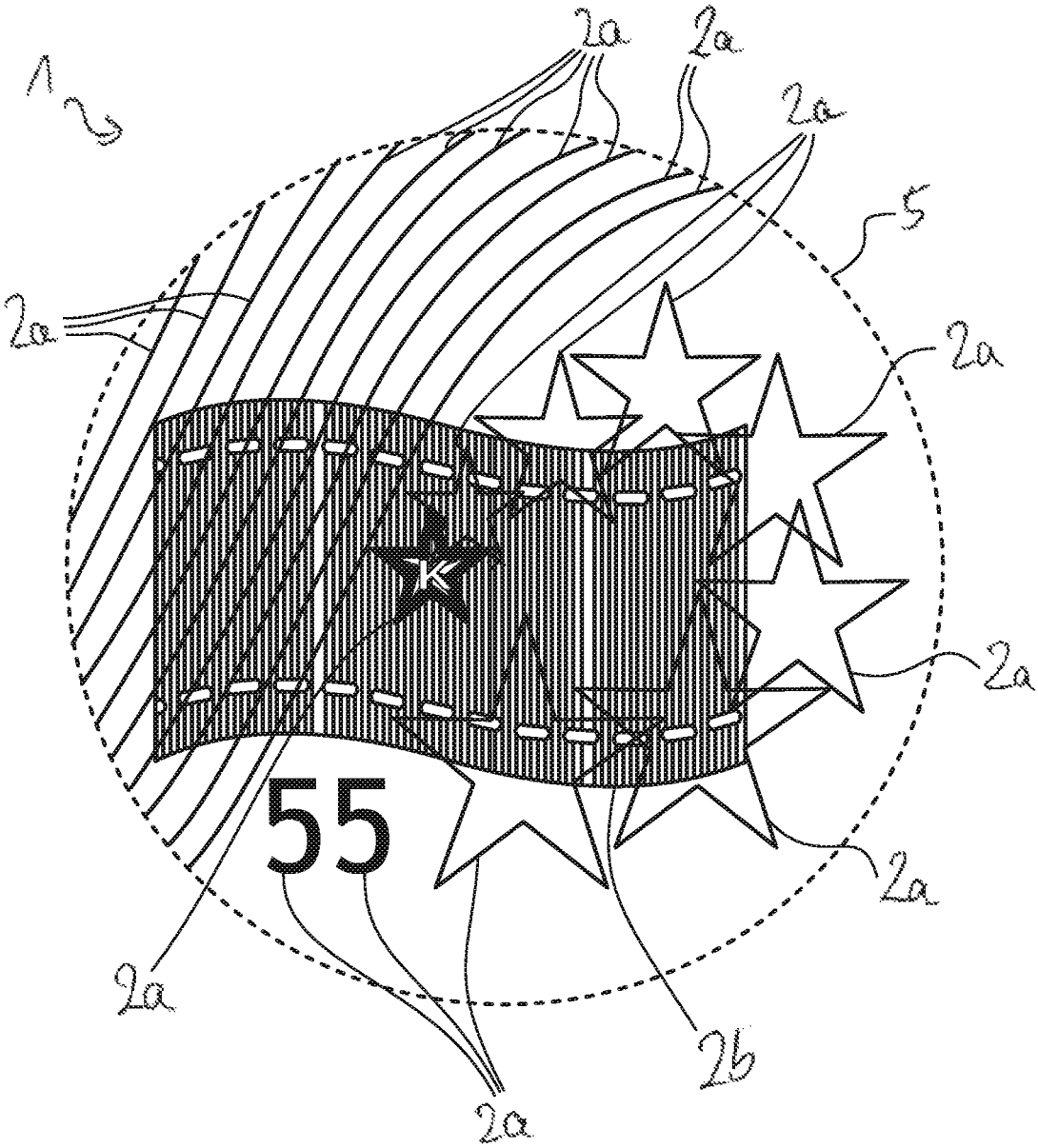
FIG. 4*e* shows a schematic representation of a security element.

FIG. 4*e* shows the combined optical effects of a first security feature 2*a* and of a second security feature 2*b* when observed perpendicularly and illuminated with a point light source, wherein the computer-generated hologram in this example represents the letter "K" and preferably overlaps with a virtually three-dimensionally projecting, achromatic, metallized star close to the center of the first security feature 2*a* here.

Figure 4F:
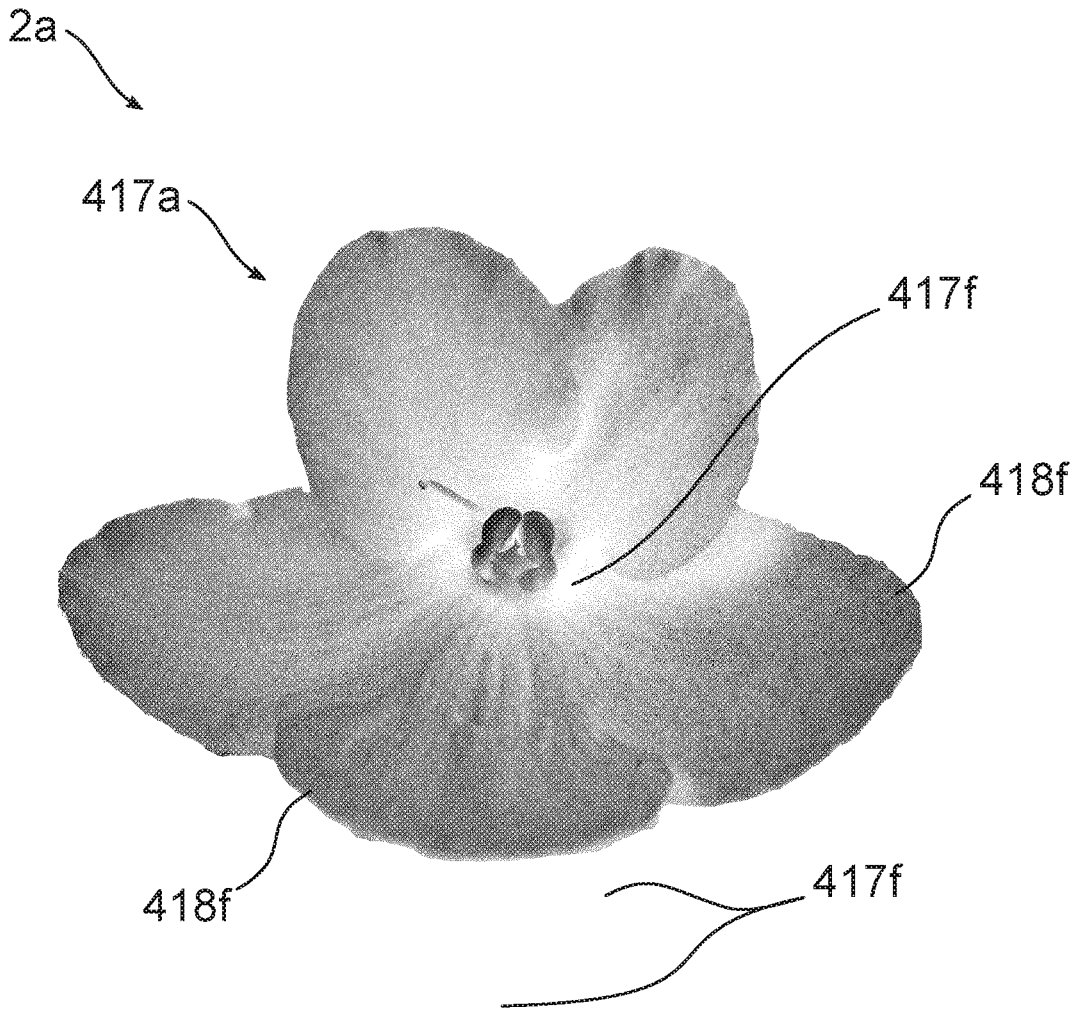
FIG. 4*f* shows a schematic representation of a security feature.
Figure 4G:
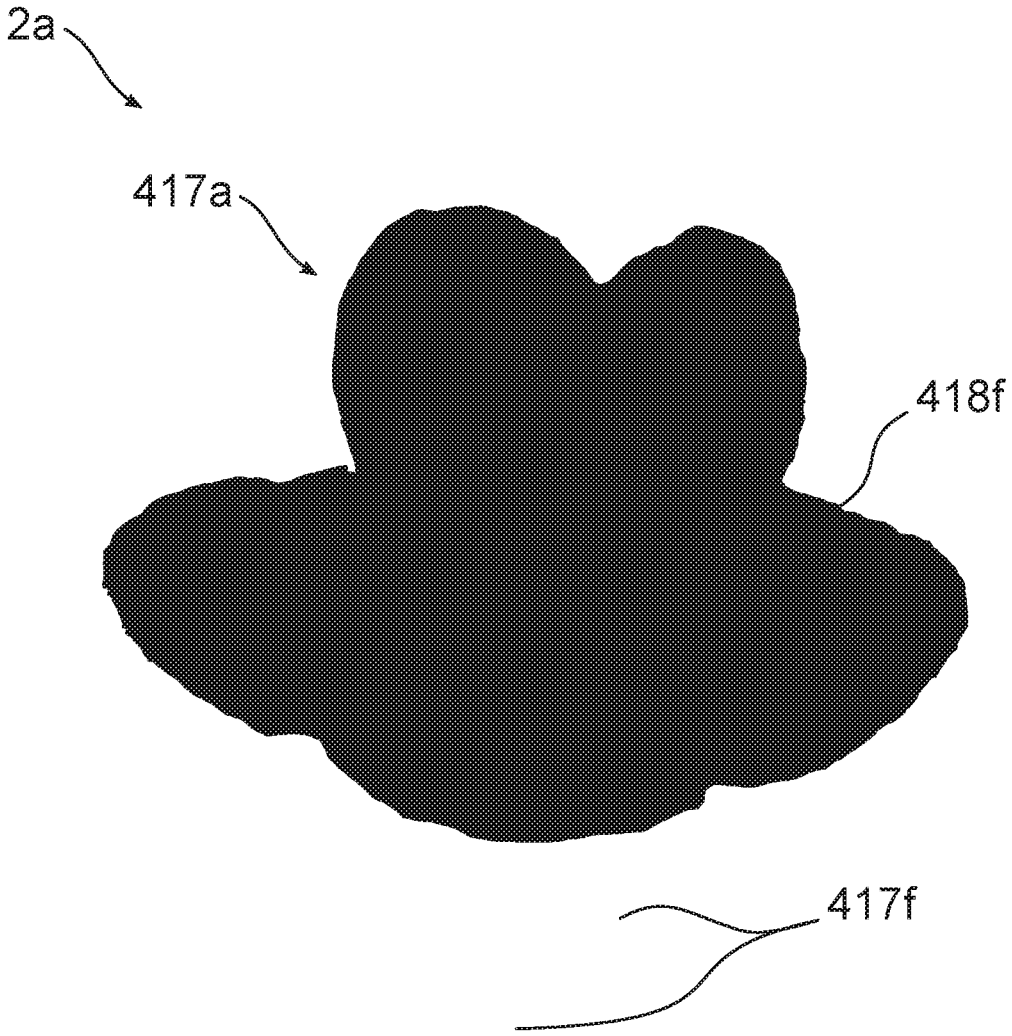
FIG. 4*g* shows a schematic representation of a security feature.

It is further possible for the security element 1, in particular a security element according to the invention, to comprise a first security feature 2*a* consisting of a high-resolution partial metallization 417*a*, preferably made of aluminum. Such a first security feature 2*a* preferably has an achromatic radial movement effect as optically variable effect. The partial metallization 417*a* is in particular chosen such that the grayscale image of a violet is represented. The grayscale image composed of metallic and/or metallized pixels 418*f* preferably has a resolution of at least 250 dpi, further preferably of at least 500 dpi, still further preferably of 1000 dpi and in particular preferably of at least 1500 dpi. FIG. 4*f* shows this, in particular as security feature 2*a*, in a schematic representation wherein the metallic and/or metallized areas 418*f* are shown in black and the non-metallized and/or non-metallic areas 417*f* are shown in white. For the observer, a second security feature preferably lies behind the first security feature 2*a* and in particular consists of a, for example blue, dyed color layer as well as a partial metallization, preferably lying behind the color layer, in particular the partial metallization 417*a*, preferably made of aluminum, in particular partial metallization 417*a*, for example made of aluminum, lying in front of or behind the color layer for the observer. The partial metallization 417*a* of the security feature 2*a*, in particular comprising a metallic and/or metallized area 418*f*, preferably has the shape of the violet flower, as shown schematically in FIG. 4*g*. The optically variable effect of the second security feature can be, for example, an endless pattern built up from high-frequency linear gratings with a grating period of from approx. 300 nm to 350 nm and/or can be produced by high-frequency linear gratings with a grating period of from approx. 300 nm to 350 nm. When observed normally, a blue violet preferably appears, wherein the color progression, for example from light blue to darker blue, is preferably produced by the high-resolution partial metallization 417*a* above the blue color layer. In particular, the radial pumping effect can be seen for one thing in the violet. If the security feature is tilted to a great extent about the horizontal axis, the endless pattern, in particular a plurality of small bees, preferably appears in diffractive colors which are preferably also modified by the filter effect of the blue color layer in the non-metallized and/or non-metallic areas 418*f*, for example of the aluminum layer.

Figure 5:
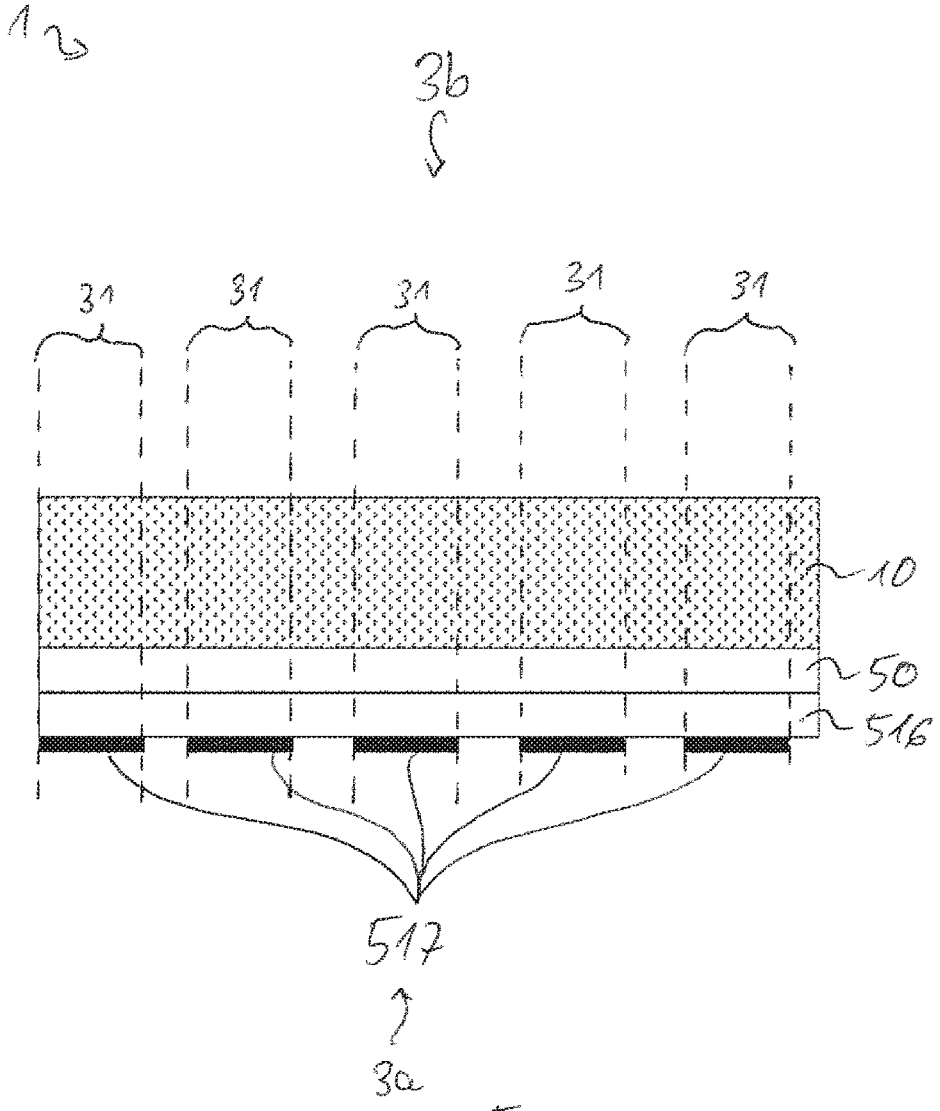
FIG. 5 shows a schematic representation of a security element.

FIG. 5 shows a security element 1, in particular at a first stage of the method, comprising a carrier ply 10, a functional layer 50 formed on the rear side 3*a* of the carrier ply 10, and a first replication layer 516 formed on the side of the functional layer 50 facing away from the carrier ply 10.

FIG. 5 further shows five first areas 31, in which a first metal layer 517 is formed on the side of the first replication layer 516 facing away from the carrier ply 10.

By the first stage of the method is preferably meant the formation of the first metal layer 517 as first partial metallization.

Figure 6:
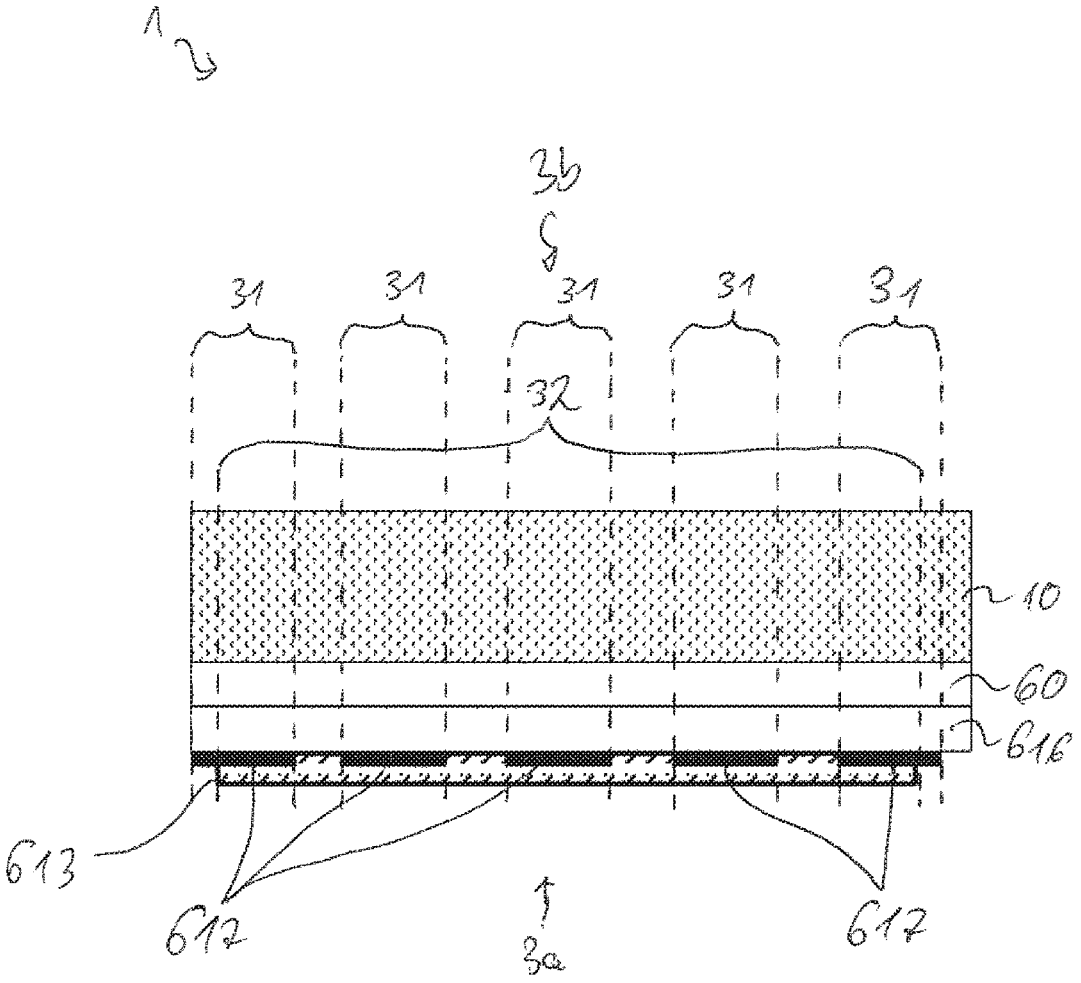
FIG. 6 shows a schematic representation of a security element.

FIG. 6 shows the security element 1 shown in FIG. 5, except that the security element 1 is preferably at a second stage of the method. In particular, in the second stage of the method a first color layer 613 is applied, for example printed by means of gravure printing, on to the side of the first replication layer 616 and of the first metal layer 617 facing away from the carrier ply 10 in a second area 32.

Figure 7:
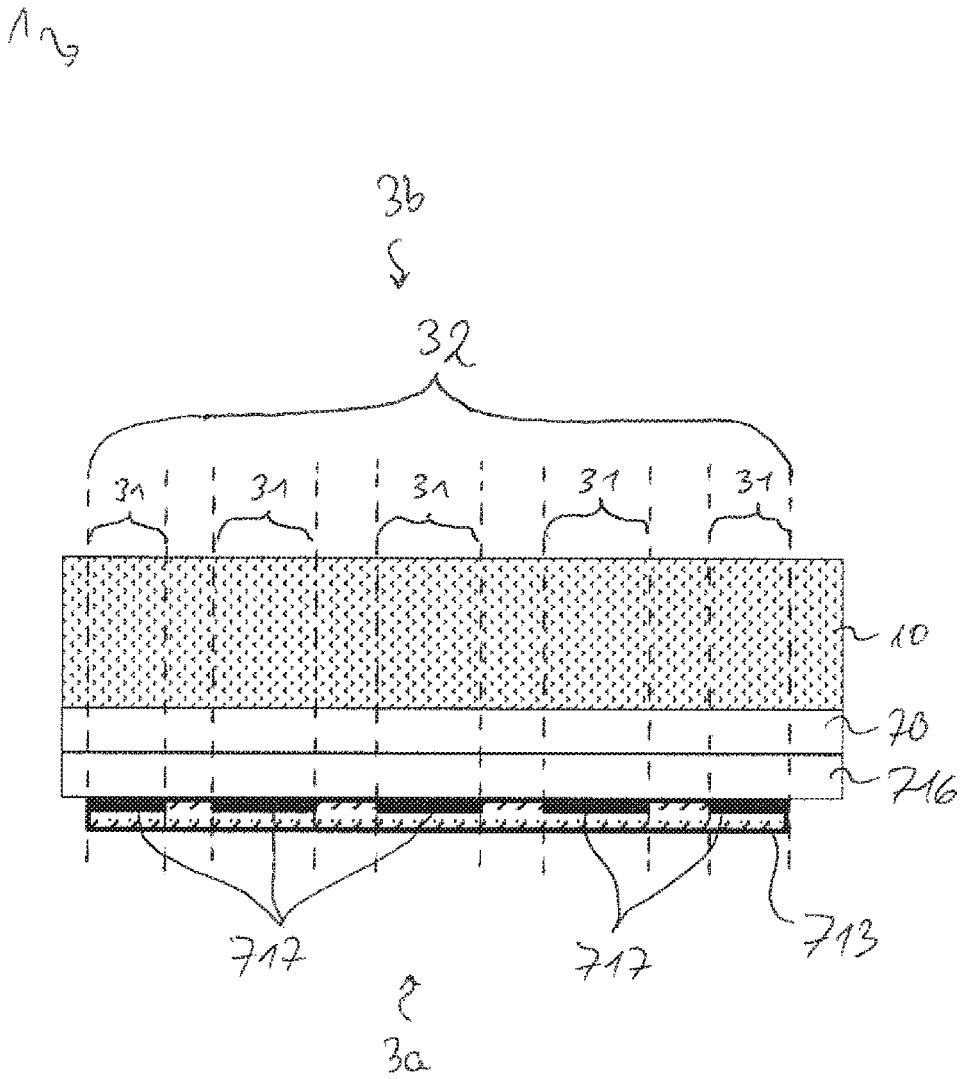
FIG. 7 shows a schematic representation of a security element.

FIG. 7 shows the security element 1 shown in FIG. 6, except that the security element 1 is preferably at a third stage of the method. In particular, in the third stage of the method the first color layer 713 is used as etch resist, in order to trim the first metal layer 717 such that the formation of the first metal layer 717 is preferably limited to the first areas 31 and the second area 32.

It is possible for the first color layer and/or the second color layer to have the function of an etch resist, wherein in particular the partial metallization produced in a first step or the first metal layer 717 and/or a second metal layer is trimmed to the area of the color layer or the first color layer 713 and/or a second color layer in an additional etching step.

Figure 8:
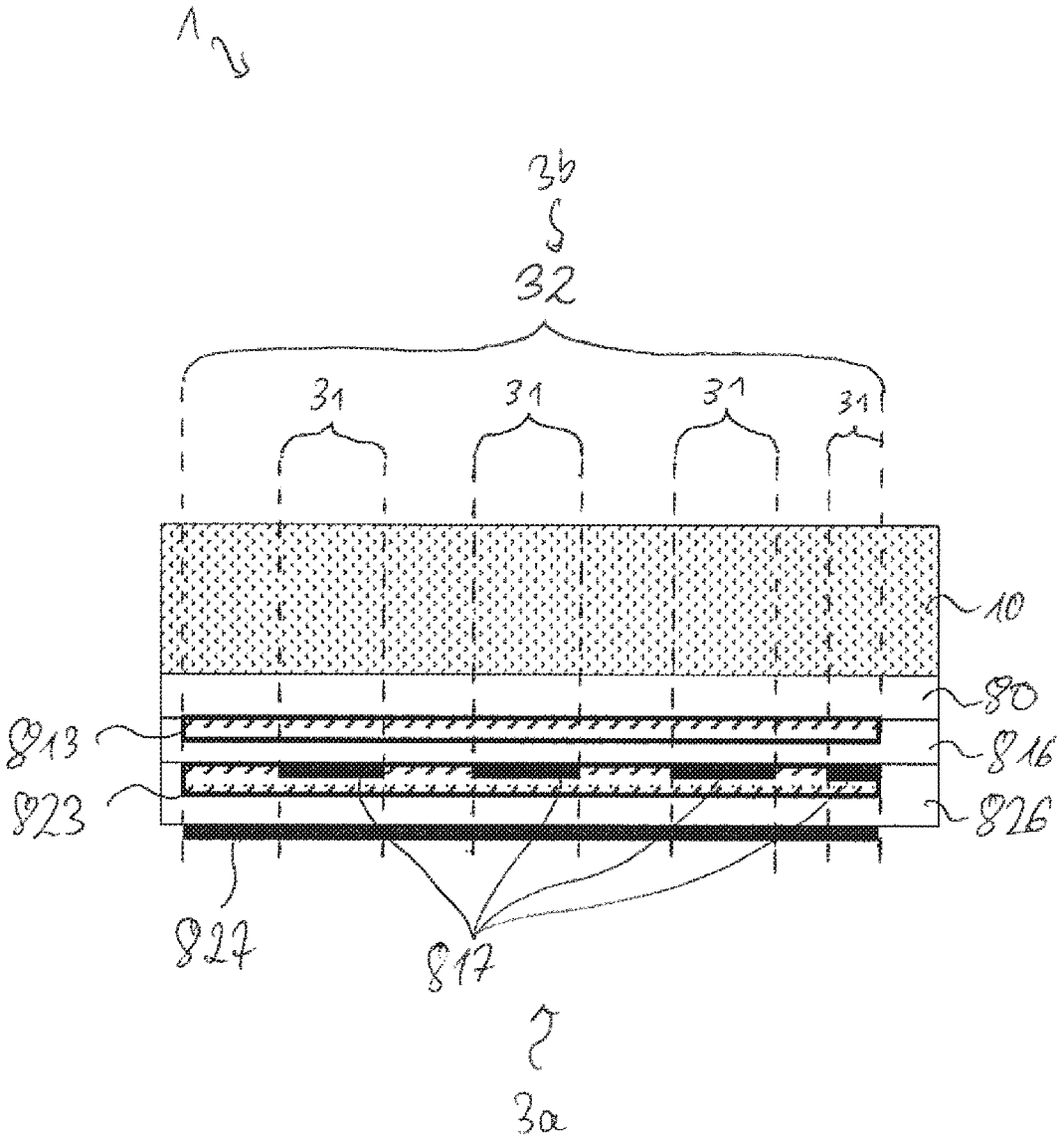
FIG. 8 shows a schematic representation of a security element.

FIG. 8 shows a security element 1 which preferably has the same layer structure as the security feature shown in FIG. 7, except that the security feature 1 has a first color layer 813, a second color layer 823 and a second metal layer 827 in a second area 32 and has a first metal layer 817 in four first areas 31.

In particular, the first color layer 813 and/or the second color layer 823 determines the outer shape of the partial metallization or of the first metal layer 817 and/or the second metal layer 827, which are preferably limited at least by the outer boundaries of the second area 32. It is possible to form the fine structure of the partial metallization within the second area 32, which comprises the first color layer 813, by means of an additional method. Thus, it is for example possible to use photolithographic methods or printing methods, etch resist methods, barrier base methods, washing methods and/or lift-off methods and/or lye printing methods.

In the case of observation from the front side 3*b*, an observer preferably detects the first color in the first areas 31 which comprise the first metal layer 817 and at least one mixed color which in particular results from an overlaying of the first and the second color outside the first areas 31, but in the second area 32. The second color layer 823 preferably has the second color here.

It is further possible to introduce codings and/or individual markings into one or more layers of the security element 1 by means of a laser, in that the first metal layer 817 facing the carrier ply 10 is removed selectively by means of the laser.

It is alternatively or additionally possible to introduce codings and/or individual markings into one or more layers of the security element 1 by means of lasers, in that the first color layer and/or second color layer is removed selectively by means of lasers.

Figure 9:
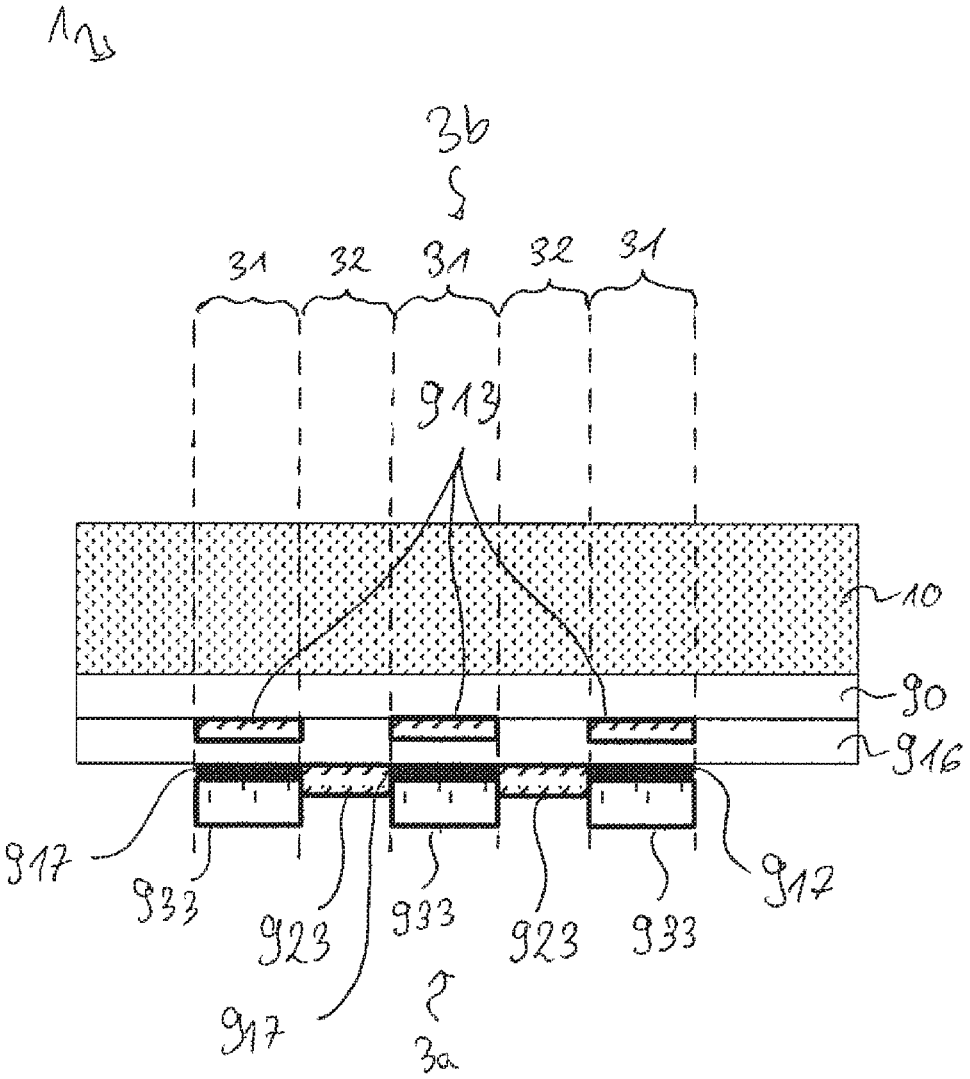
FIG. 9 shows a schematic representation of a security element.

FIG. 9 shows a security element 1 comprising a carrier ply 10, to the rear side 3*a* of which a functional layer 90 is applied. The side of the functional layer 90 facing away from the carrier ply 10 has a first color layer 913 in three first areas. Further, the side of the functional layer 90 and of the first color layer 913 facing away from the carrier ply 10 has a first replication layer 916. A first metal layer 917 is applied in the three first areas 31 and a second color layer 923 is applied in the two second areas 32 to the side of the first replication layer 916 facing away from the carrier ply 10. The side of the first metal layer 917 facing away from the carrier ply 10 has a third color layer 933 in the three first areas 31.

In particular, the first metal layer 917 is arranged registration-accurate relative to the first color layer 913 and the third color layer 933.

It is possible to print the first color layer 913 in the pattern, thus in particular partially, in a first step. In a second step, the first replication layer 916 is preferably applied and preferably provided with an optically variable structure in a third step. The first metal layer 917 is preferably applied to the first replication layer 916 over the whole surface in a fourth step. In a fifth step, the first color layer 913 is in particular used as mask with a positive photoresist for the structuring of the first metal layer 917 in areas. After the fifth step, the metal layer 917 is preferably present only in the areas 31.

Further, it is possible to apply the second color layer 923 in the form of a dyed negative photoresist in a sixth step, in that the first metal layer 917 is in particular used as mask. In a seventh step, the third color layer 933 is preferably applied as a dyed positive photoresist and the first metal layer 917 is again used as mask in order to preferably obtain the security element 1 shown in FIG. 9.

Further, it is already possible to use a dyed positive photoresist in the first photolithographic process step, in particular in the fifth step. In so doing it is possible to eliminate the third photolithographic process step, in particular the seventh step.

Figure 10:
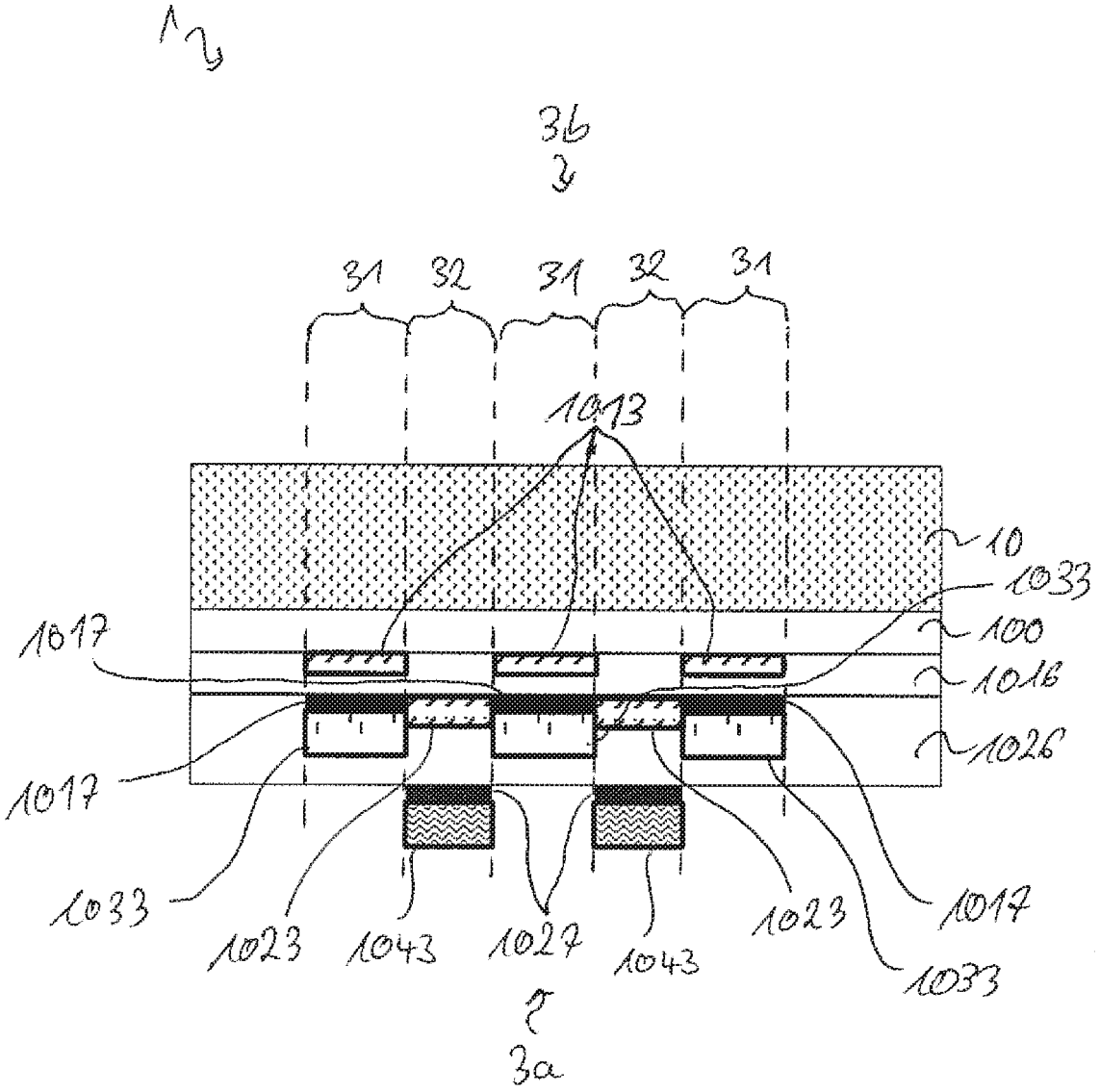
FIG. 10 shows a schematic representation of a security element.

FIG. 10 shows the security element 1 shown in FIG. 9, except that the side of the first replication layer 1016, of the second color layer 1023 and of the third color layer 1033 facing away from the carrier ply 10 has a second replication layer 1026 over the whole surface as well as a metal layer 1027 partially in the second areas 32. A fourth color layer 1043 is applied to the side of the second metal layer 1027 facing away from the carrier ply 10 in the second areas 32.

It is possible to structure the second metal layer 1027 in a registration-accurate manner using the first metal layer 1017 as mask, in particular to structure it in areas, for example by means of a dyed negative resist which in particular remains in the layer structure of the security element 1 as fourth color layer 1043.

Figure 11:
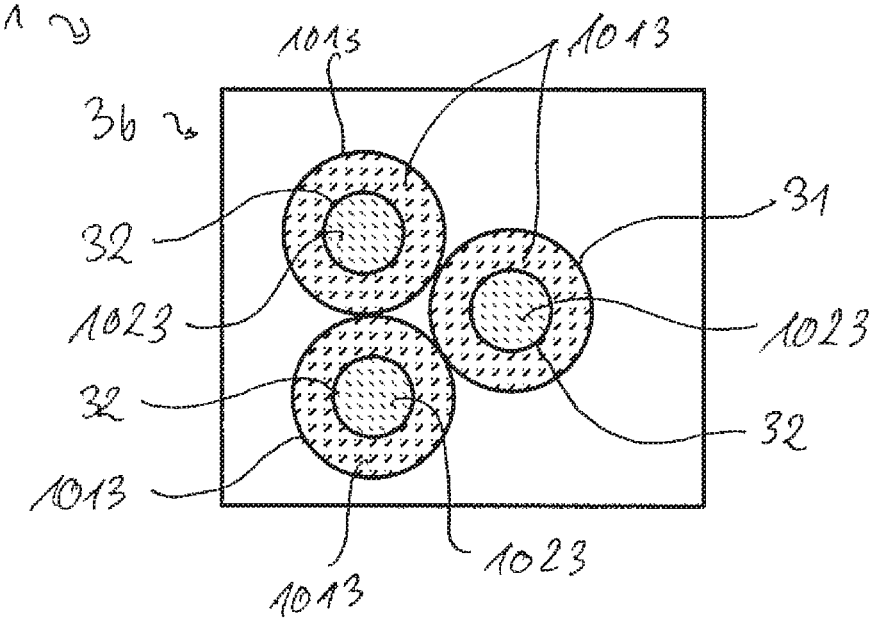
FIG. 11 shows a schematic representation of a security element.
Figure 12:
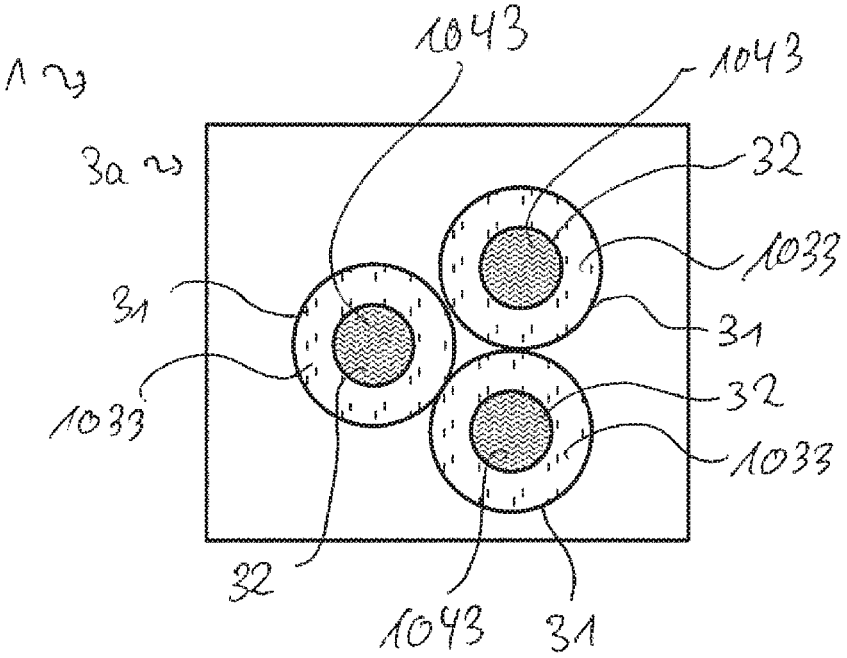
FIG. 12 shows a schematic representation of a security element.

In the security element 1 shown in FIG. 10, two different optically variable effects registration-accurate with two identical or different colors of the first and second color layers 1013, 1023 are preferably detectable as combined optical impressions for an observer from the front side 3*b* of the security element 1, as shown in FIG. 11, and two identical or different colors of the third and fourth color layers 1033, 1043 or the above colors registration-accurate relative to the optically variable effects are detectable from the rear side 3*a* of the security element 1, as shown in FIG. 12.

Preferably, such a security element 1 is particularly advantageous for window areas.

Figure 13:
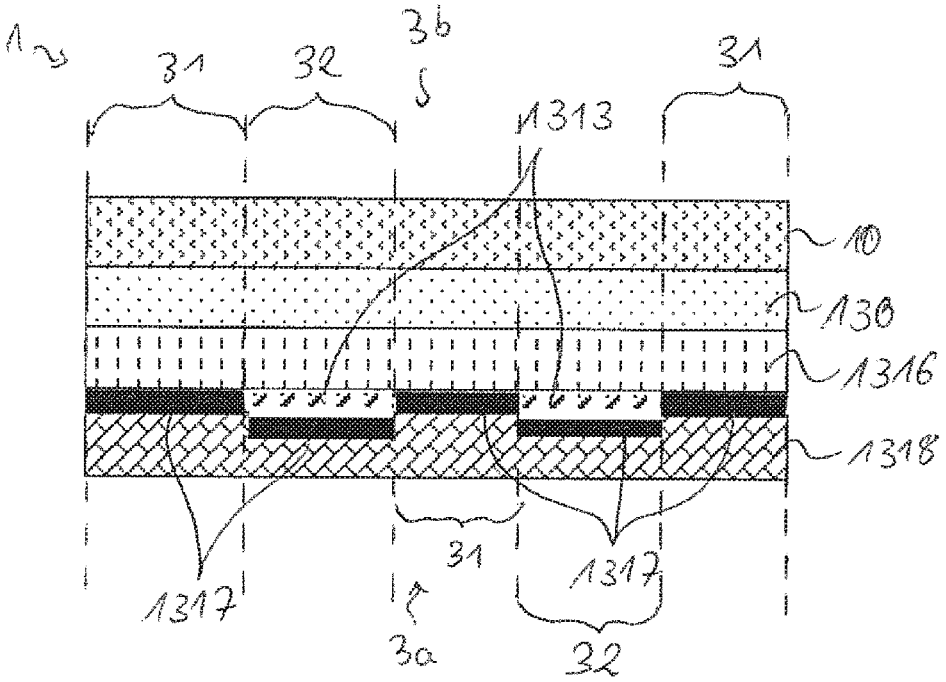
FIG. 13 shows a schematic representation of a security element.

FIG. 13 shows a security element 1 comprising a carrier ply 10 and further layers, which are formed on the rear side 3*a* of the carrier ply 10 in the sequence: functional layer 130, first replication layer 1316, first color layer 1313 in second areas 32, first metal layer 1317 in first areas 31 and the second areas 32, negative photoresist 1318.

Figure 14:
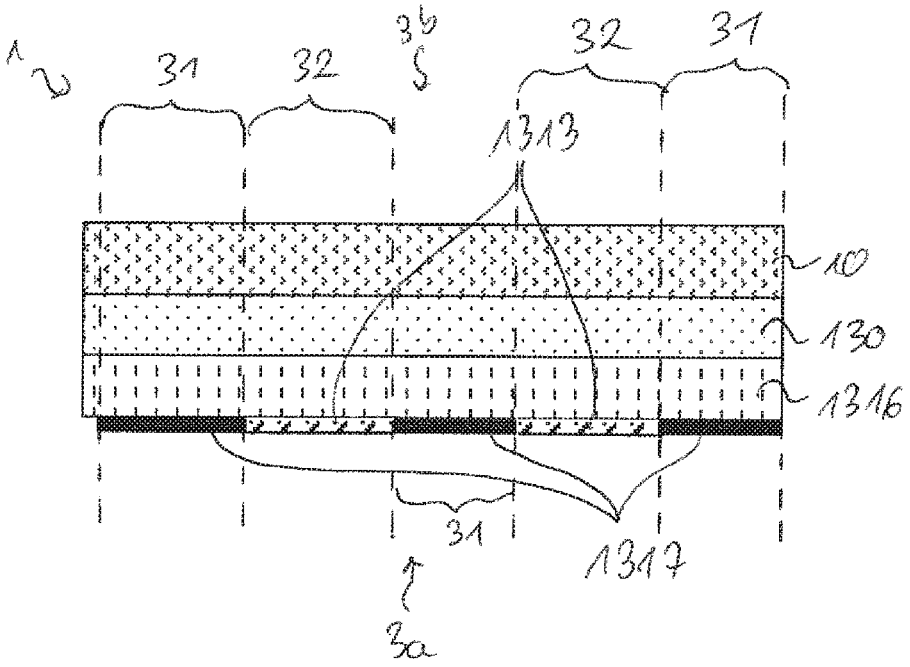
FIG. 14 shows a schematic representation of a security element.
Figure 15:
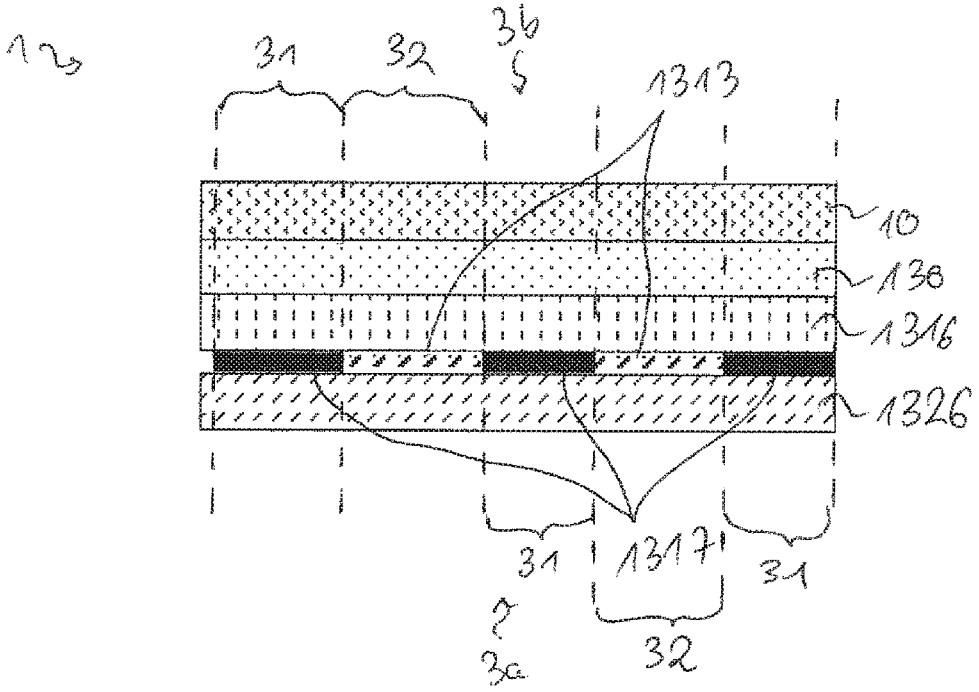
FIG. 15 shows a schematic representation of a security element.
Figure 16:
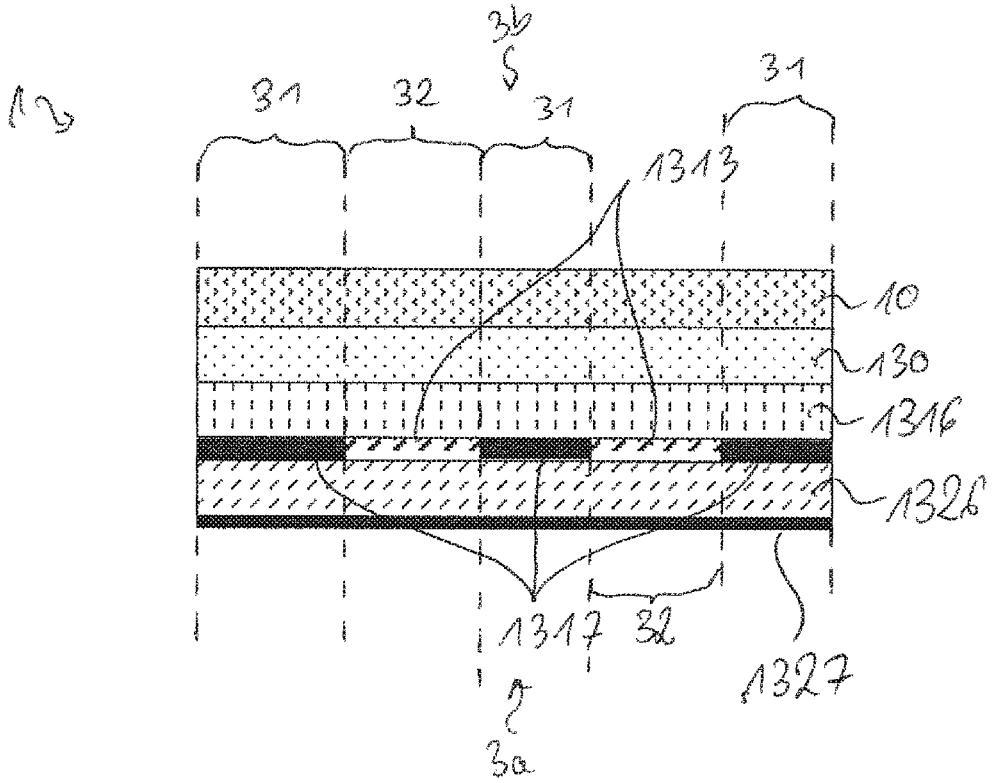
FIG. 16 shows a schematic representation of a security element.

It is possible for the first color layer 1313 to be applied after the first replication layer 1316, with the result that the replication is obliterated in particular in areas in which the first color layer 1313 overlaps the first replication layer 1316. In a further step, it is possible to apply a first metal layer 1317 and a negative photoresist 1318 to the first replication layer 1316 and the first color layer 1313. In such a photolithographic structuring, in particular structuring in areas, preferably either an external mask is used and/or the first color layer 1313 is used as mask and/or specific structures in the replication are used as mask. It is further possible for the first color layer 1313 to be used as mask, wherein, in particular after the removal of the negative photoresist 1318 and of the unprotected first metal layer 1317, a first metal layer 1317 is produced as a partial metallization with colored, transparent gaps in the first areas 31, as shown in FIG. 14. Further, it is possible to apply and/or structure a second replication layer 1326 to/on the first metal layer 1317 and/or the first replication layer 1316, as shown in FIG. 15, as well as to apply and/or vapor-deposit a second metal layer 1327 to/on the second replication layer 1326, as shown in FIG. 16.

Figure 17:
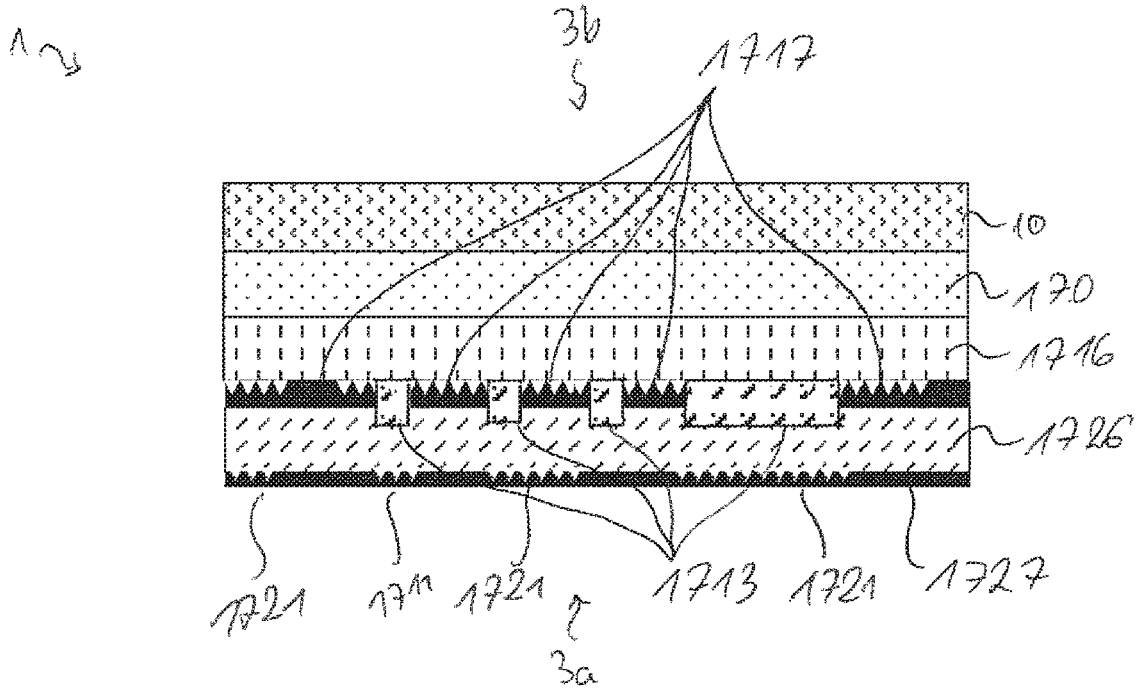
FIG. 17 shows a schematic representation of a security element.

FIG. 17 shows a security element 1 comprising a carrier ply 10 and further layers, which are formed on the rear side 3*a* of the carrier ply 10 in the sequence: functional layer 170, first replication layer 1716, first color layer 1713 in second areas, first metal layer 1717 in first areas, second replication varnish layer 1726, second metal layer 1727.

FIG. 17 further shows that the first color layer 1713 is applied and/or introduced into the areas of the second optically variable structures 1721 of the second replication layer 1726 in order to preferably obliterate the optical effect of the first optically variable structures there. Further, the second optically variable structures 1721 are introduced into the second replication layer 1726 in particular such that it preferably overlies and/or overlaps at least partly with the first color layer 1713.

Figure 18:
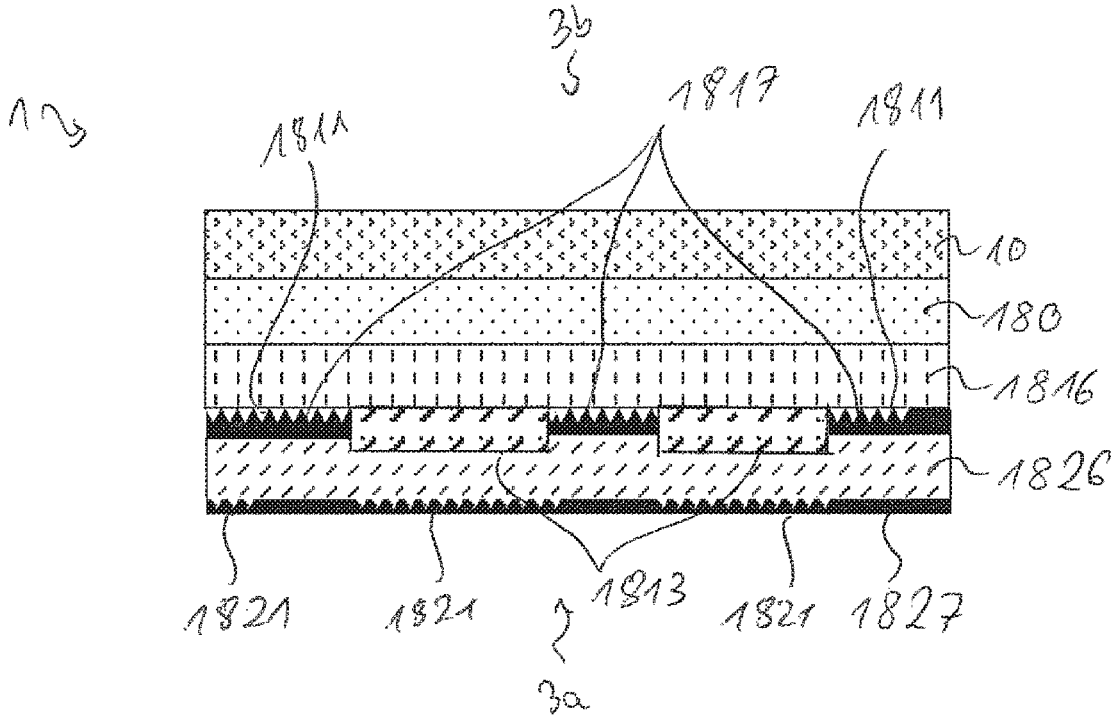
FIG. 18 shows a schematic representation of a security element.

FIG. 18 shows the security element 1 shown in FIG. 17, except that the first color layer 1813 is in particular applied in the areas of the first replication layer 1816 which preferably have no first optically variable structures 1811. It is possible for the first color layer 1813 to overlap with the first optically variable structures in edge areas. The second replication layer 1826 preferably has second optically variable structures 1821 such that they in particular overlap at least partially with the first color layer 1813.

It is possible to combine the security element shown in FIG. 17 with the security feature shown in FIG. 18.

Figure 19:
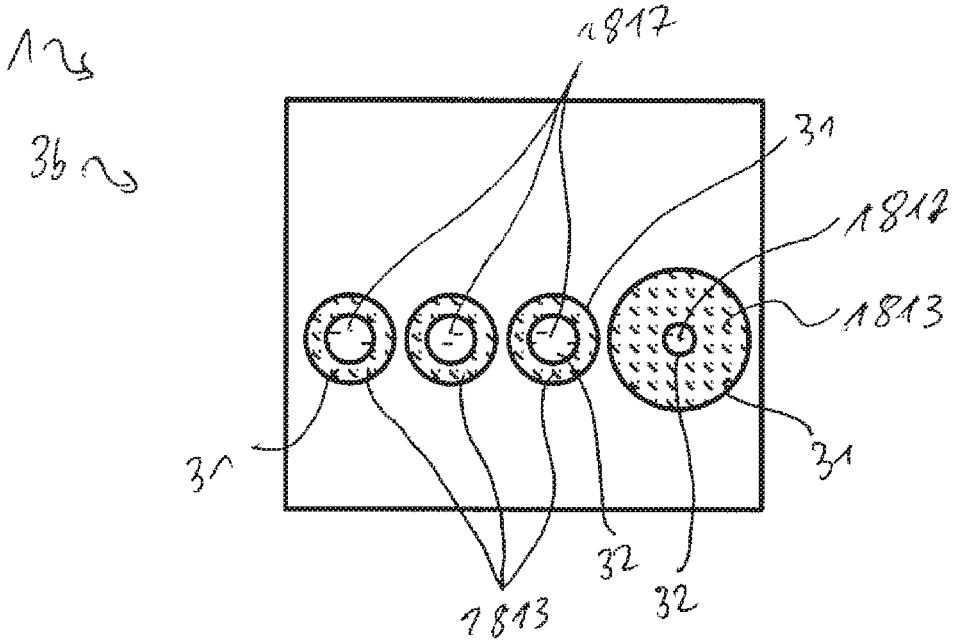
FIG. 19 shows a schematic representation of a security element.

FIG. 19 shows a security element 1 in top view from the front side 3*b*, wherein in first areas 31 the first color layer 1813 is in particular detectable for an observer and in second areas 32 the first metal layer 1817 is in particular detectable for an observer.

Figure 20:
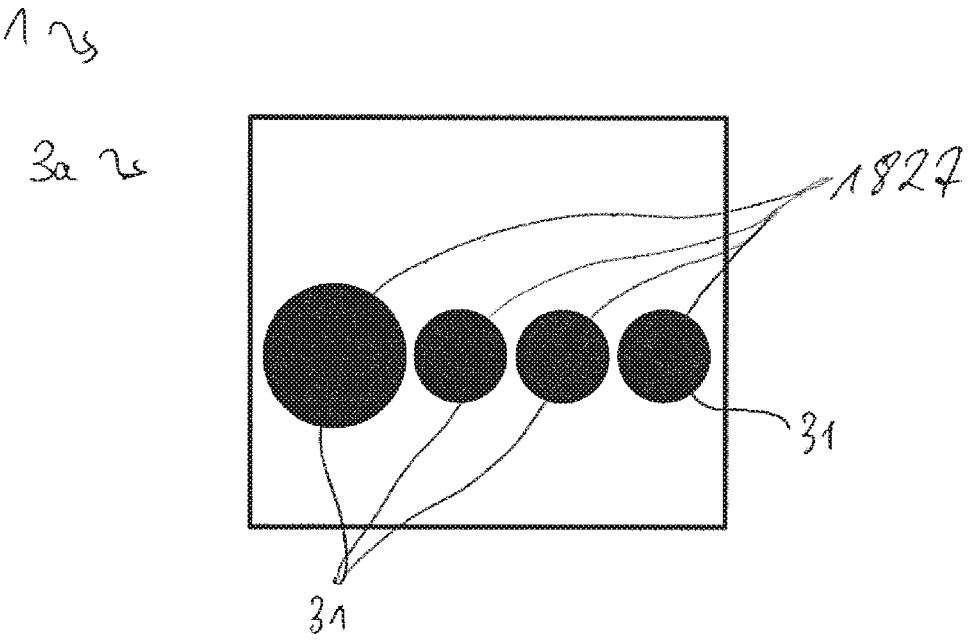
FIG. 20 shows a schematic representation of a security element.

FIG. 20 shows a security element 1 in top view from the rear side 3*a*, wherein in first areas 31 the second metal layer 1827 is in particular detectable for an observer.

Figure 21:
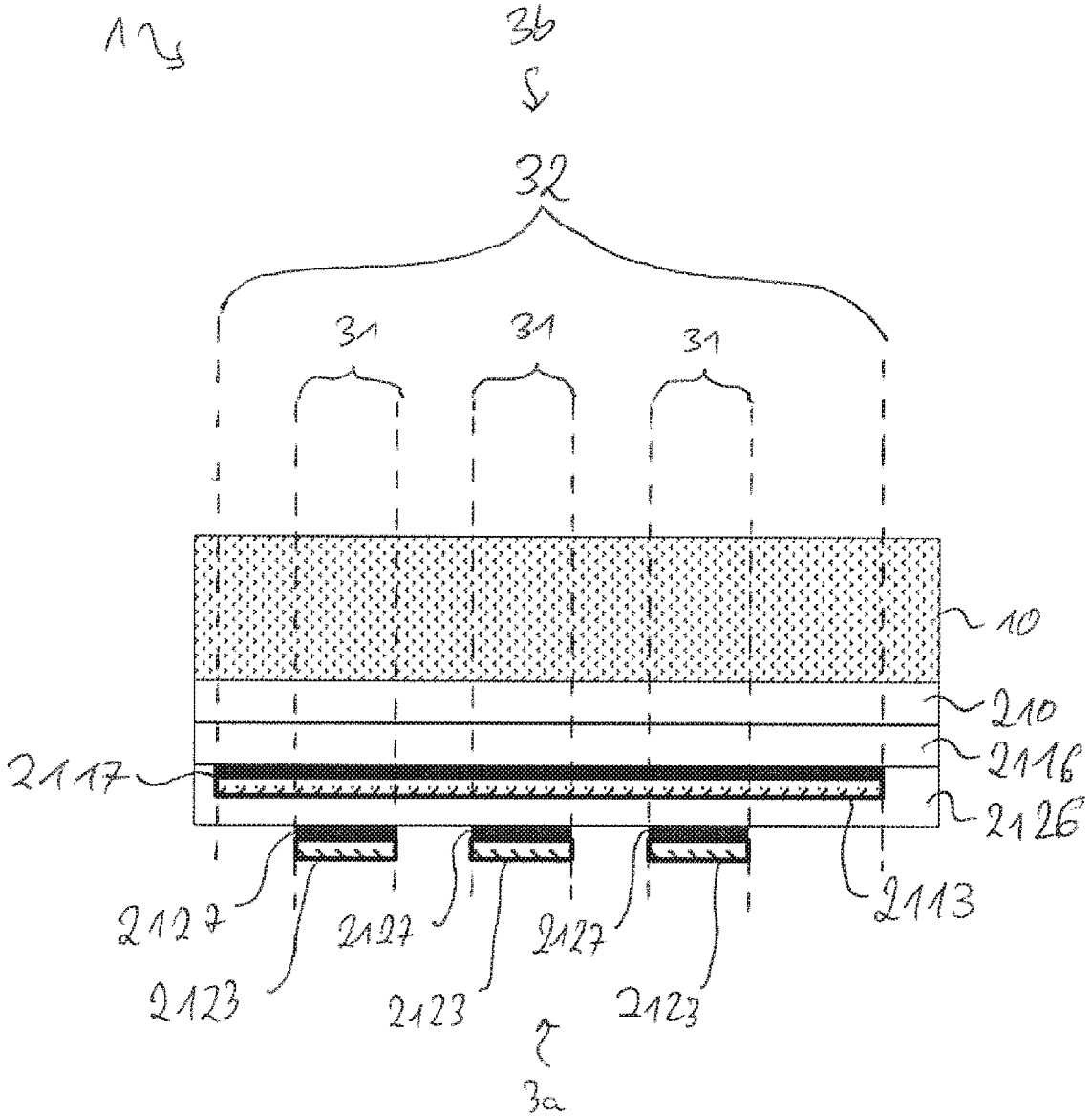
FIG. 21 shows a schematic representation of a security element.

FIG. 21 shows a security element 1 comprising a carrier ply 10 and further layers, which are formed on the rear side 3*a* of the carrier ply 10 in the sequence: functional layer 210, first replication layer 2116, first metal layer 2117 in a second area 32, first color layer 2113 in the second area 32, second replication varnish layer 2126, second metal layer 2127 in first areas 31, second color layer 2123 in first areas 31.

The first optically variable effect and/or the second optically variable effect is preferably detectable from the rear side 3*a* for an observer when the security element 1 with a structure according to FIG. 21 is observed. It is possible to use such a security element for example in PCI products (internal KINEGRAM® in a polycarbonate card), in which the security element is in particular applied to a polycarbonate film, wherein the polycarbonate film with the security element is preferably embedded such that the rear side 3*a* of the security element 1 is detectable from the outside for an observer.

It is further possible to structure the first metal layer 2117 and/or the second metal layer 2127 with a dyed etch resist, in particular to structure it in areas. Photopatternable, dyeable varnishes, such as for example negative resists or positive resists, are in particular suitable for high resolutions.

It is possible for the first color layer 2113 and/or the second color layer 2123 to have the function of an etch resist, wherein in particular the partial metallization produced in a first step or the first metal layer 2117 and/or the second metal layer 2127 is trimmed to the area of the color layer or the first color layer 2113 and/or the second color layer 2123 in an additional etching step.

Figure 22:
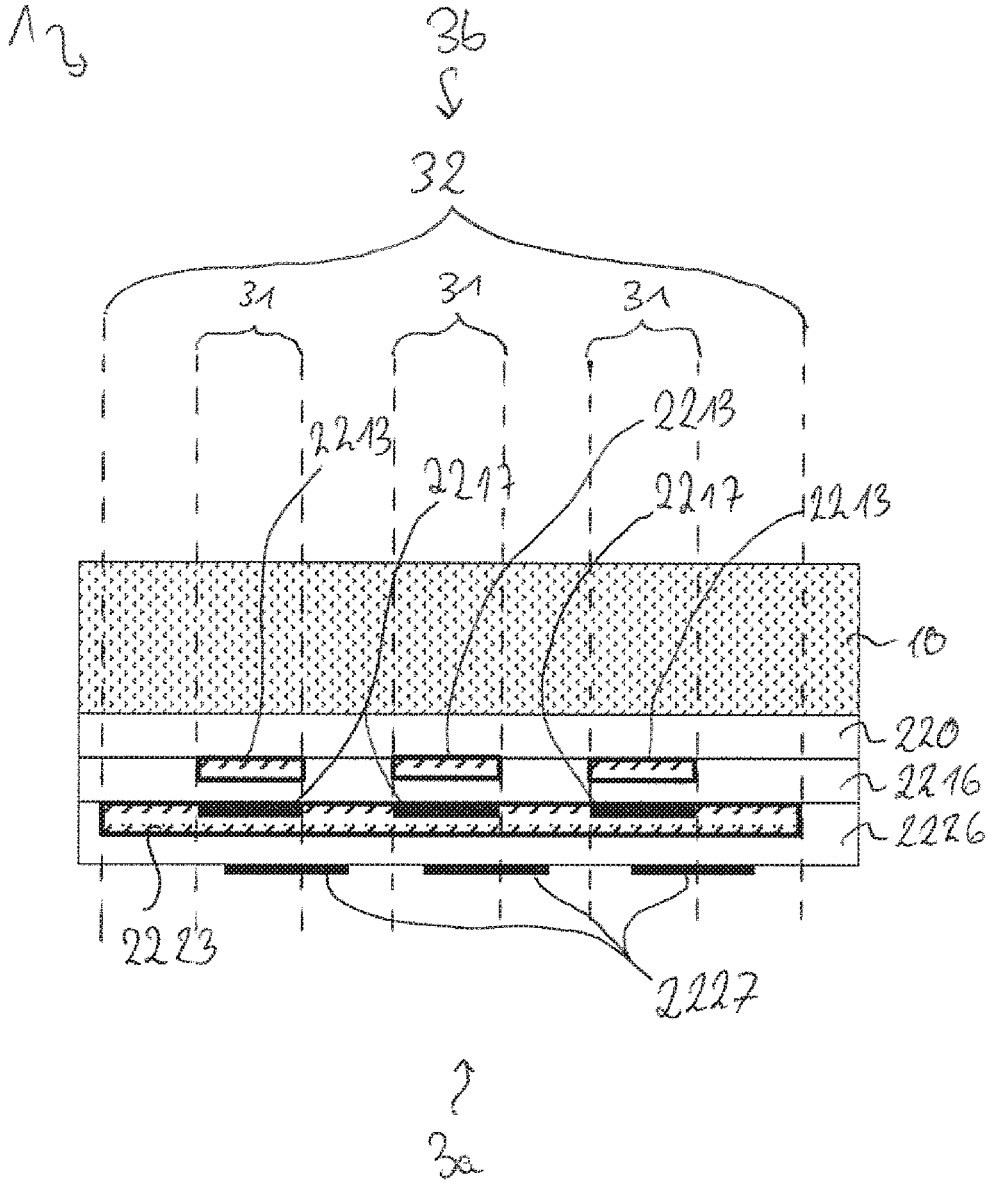
FIG. 22 shows a schematic representation of a security element.

FIG. 22 shows the security element 1 shown in FIG. 1, except that the second metal layer 2227 is arranged in three different areas, wherein these areas overlap at least partially with the second area 32 and the first areas 31.

The second metal layer 2227 is preferably structured as second partial metallization, wherein areas without a metal layer and with a color layer are preferably detectable in the case of observation perpendicular to the plane spanned by the carrier ply 10. The layer structure is preferably partially transparent here, wherein the substrate is detectable for an observer through the first and/or second security feature, in particular from the front side 3*b* or from the rear side 3*a*. The carrier ply 10 preferably appears colored in the area of the first and/or second security feature, in the case of observation from the front side, due to the optical effect of the second color layer 2223. The same preferably applies to a substrate or to a document to which the security feature is applied.

Figure 23:
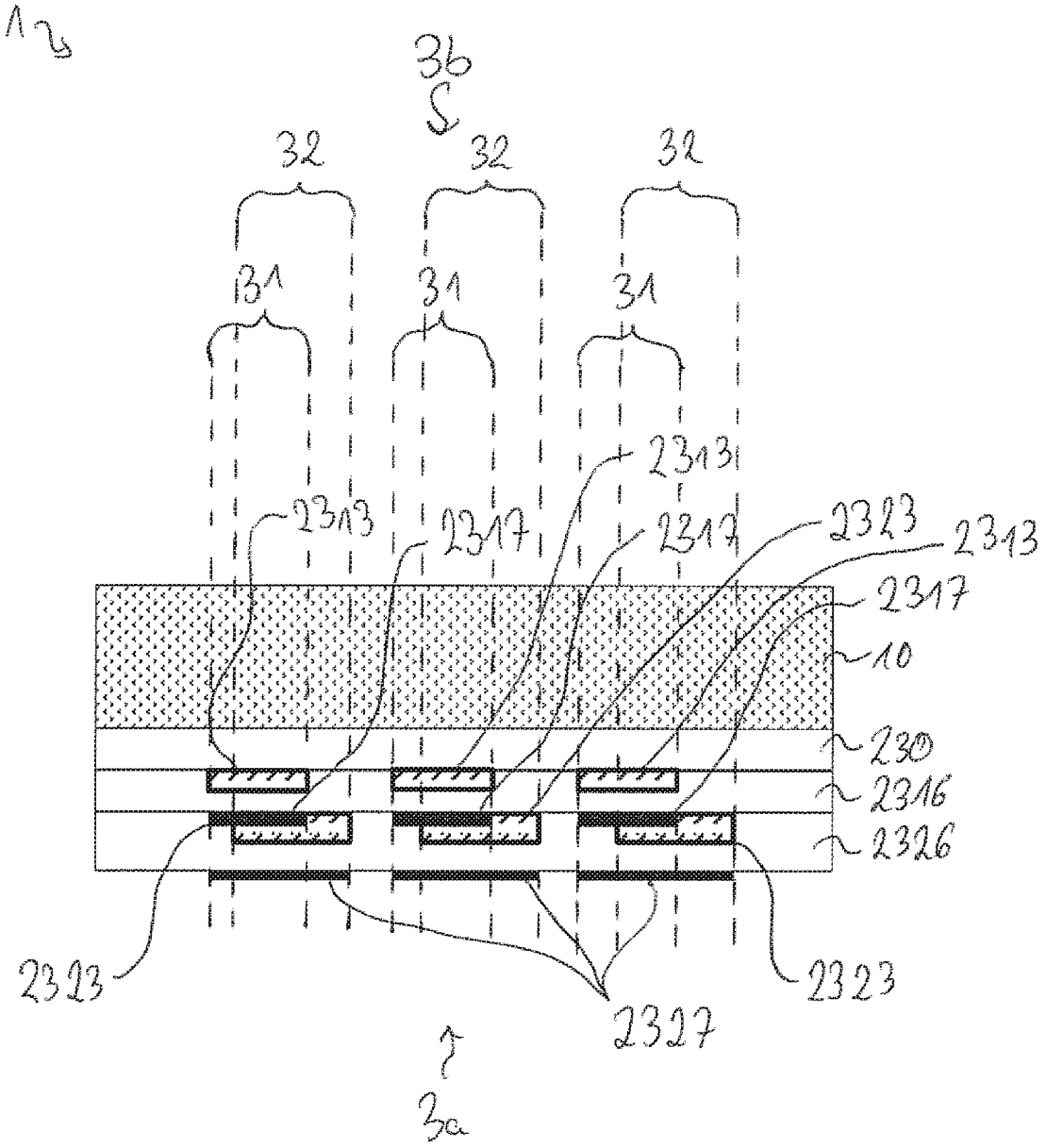
FIG. 23 shows a schematic representation of a security element.

FIG. 23 shows the security element 1 shown in FIG. 22, except that the second color layer 2323 is formed in second areas 32.

It is possible to use the first color layer 2313 and/or the second color layer 2323 as mask for the structuring, in particular the structuring in areas, of the first metal layer 2317 and/or the second metal layer 2327.

It is possible for an observer to detect the carrier ply 10 from the rear side 3*a* through the first and/or the second security element, wherein the carrier ply 10 is preferably detectable without a color impression which is produced by the second color layer 2323, unlike the security element 1 shown in FIG. 22 or 9. The same applies to the substrate or a document after a transfer.

Figure 24:
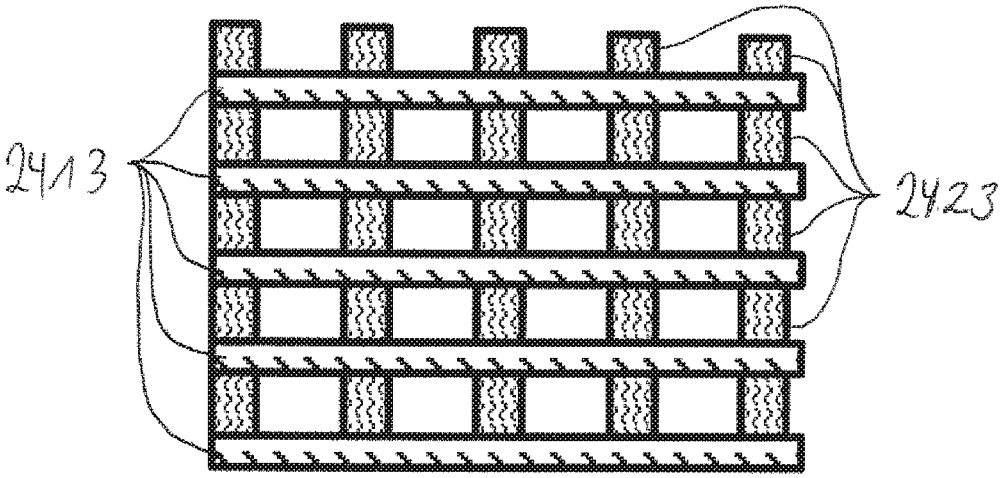
FIG. 24 shows a schematic representation of a security element.

FIG. 24 shows a security element 1 in top view, wherein the security element 1 has a first color layer 2413, which is shaped in the form of a line raster, and a first metal layer is preferably structured registration-accurate relative to it. The security element 1 further has a second color layer 2423, which is shaped in the form of a second line raster, and a second metal layer is preferably structured registration-accurate relative to it in areas in which the first metal layer is not present. The line rasters are preferably chosen such that the individual lines are not resolved by a human eye, wherein the raster spacings are in particular smaller than 300 μm, preferably smaller than 150 μm. In the case of fine rasterizations, photolithographic methods are in particular advantageous, because a much higher resolution can be achieved with them. Thus, a first color can be structured in high resolution from a negative photoresist, for example by means of mask exposure, and can serve as mask for the registration-accurate structuring of a further metal layer in further method steps.

It is possible for an observer to detect a surface coverage of the security element 1 of 25% with respect to the first color layer 2413 and/or a first metal layer and/or to detect a surface coverage of the security element 1 of 25% with respect to the second color layer 2423 and/or a second metal layer and/or to detect a surface proportion of the security element 1 of 50%, which is transparent and has no color layer and no metal layer.

It is further possible for the following values to result for the line raster, wherein the surface coverage in particular relates to that proportion which an observer is to detect from the front side of the security feature:

| Area | Surface coverage | Ratio b:d |
|---|---|---|
| first color layer 2413 | 25% | 0.25 |
| second color layer 2423 | 25% | 0.333 |
| transparent surface proportion | 50% | |

The variable b here preferably denotes the line width of the respective line raster and the variable d here preferably denotes the period of the line raster. If the period d lies significantly below the typical resolution limit of the human eye, the line raster is in particular not recognizable with a human eye. It has proved to be advantageous to select periods d which are in particular smaller than 300 μm, preferably smaller than 150 μm. In particular, instead of a line raster, dot rasters and/or other raster forms are used for the raster elements.

Figure 25:
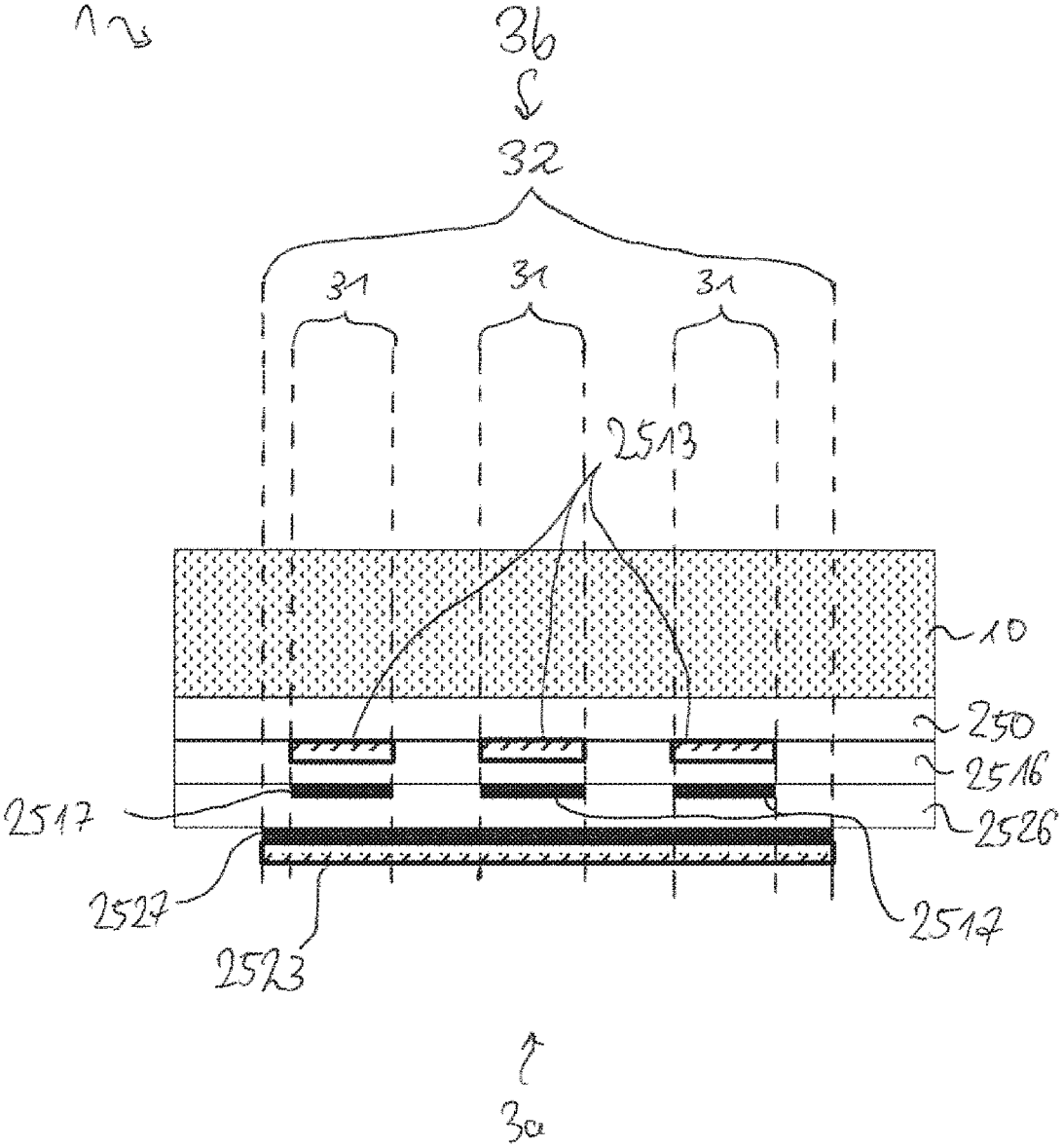
FIG. 25 shows a schematic representation of a security element.
Figure 26:
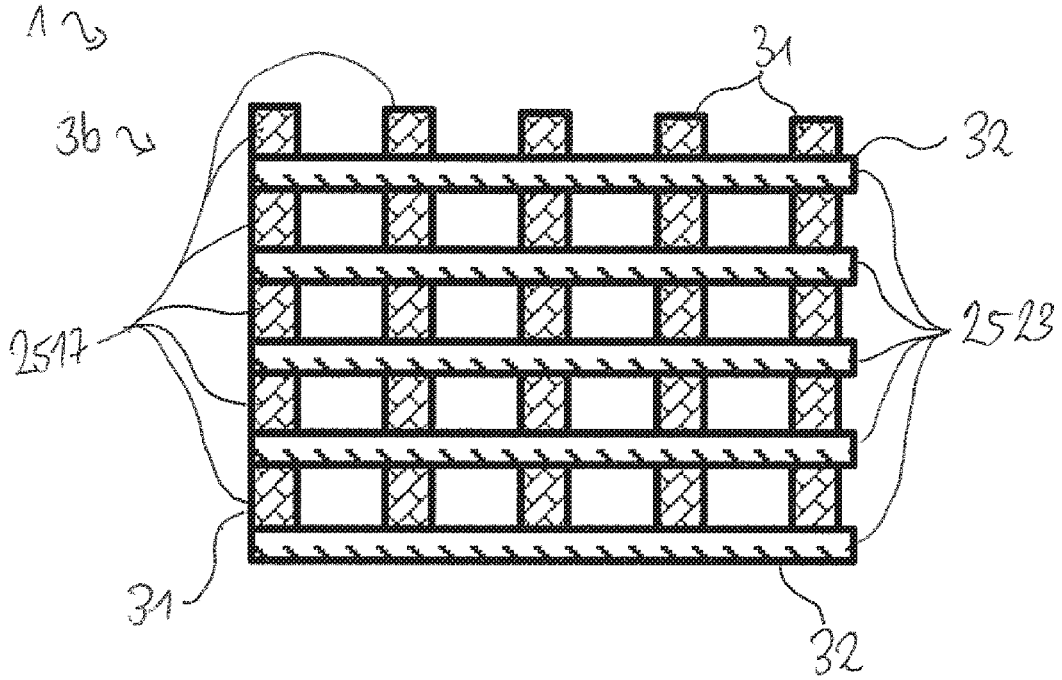
FIG. 26 shows a schematic representation of a security element.
Figure 27:
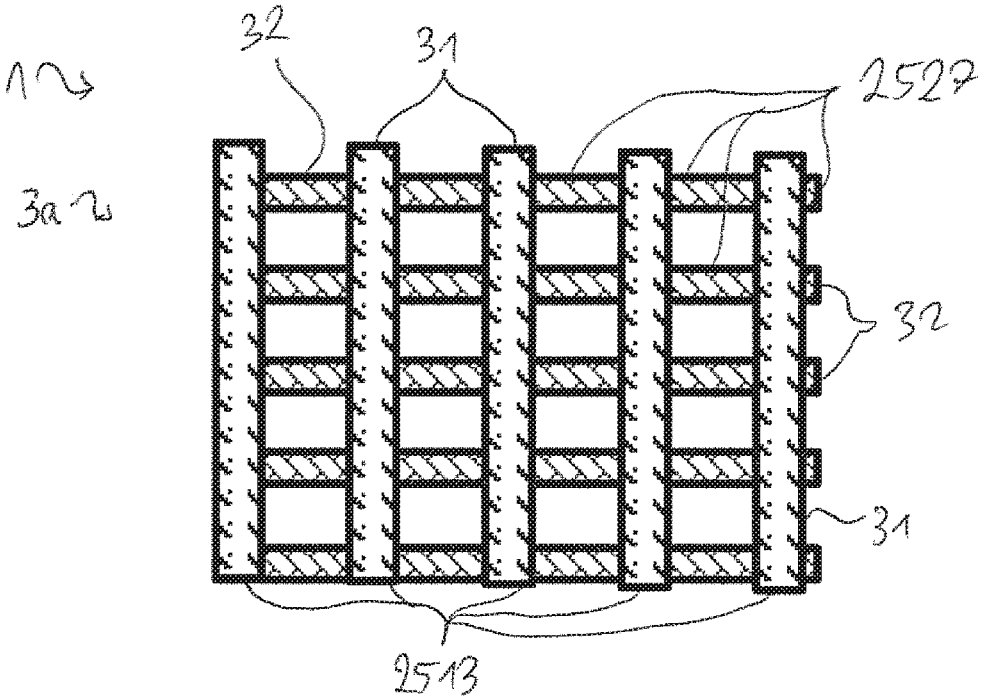
FIG. 27 shows a schematic representation of a security element.

FIG. 25 shows the security element 1 shown in FIGS. 26 and 27 in cross section, wherein the first metal layer 2517 together with the first color layer 2513 and the second metal layer 2527 together with the second color layer 2523 are in each case shaped as a line raster. It is possible to use a dyed etch resist for the second color layer 2523.

FIGS. 26 and 27 show the security element 1 shown in FIG. 25 in top view from the front side 3*b*, in particular through the carrier ply 10, and from the rear side 3*a* respectively.

Further, the first metal layer 2517 is preferably arranged in register with the first color layer 2513 and the second metal layer 2527 is preferably arranged in register with the second color layer 2523, wherein the metal layers 2517, 2527 in particular appear silver, if the observation is not effected through a color layer.

It is further possible for the widths of the raster lines and/or the sizes of differently shaped raster elements to vary, for example according to a predetermined function, in order to generate an additional item of optical information in particular when observed in transmitted light.

It is also possible to apply the second color layer extensively, wherein in particular no transparent surface proportions are detectable. The mask exposure method or the so-called zero.zero demetallization method, which preferably make a high resolution of the rasterizations possible and, in the case of the zero.zero method, in particular make a precise register accuracy with zero tolerance between optically variable structures and metal layers possible, is preferably used for a fine structuring, in particular a fine structuring in areas of the first color layer 2513, preferably a metal layer without color layer. It is possible to use the mask exposure method for structuring a color layer, in particular through a photosensitive layer, with high resolution, preferably for structuring it in areas.

Figure 28:
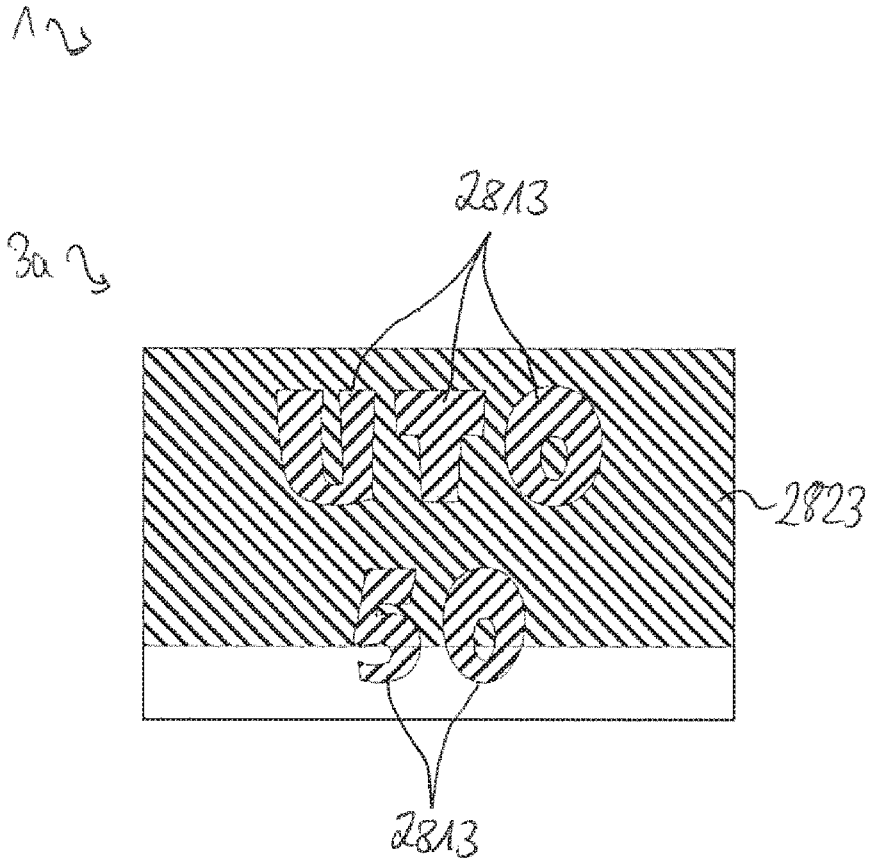
FIG. 28 shows a schematic representation of a security element.

FIG. 28 shows a security element 1 in top view from the front side 3*a*. A first color layer 2813 is in particular backed with a first metal layer in registration-accurate manner and preferably exhibits a first optically variable effect, for example a lightness change when the security element 1 is tilted and/or diffraction effects. A second color layer 2823 is formed in areas which are not covered by the first color layer 2813. The second color layer 2823 is in particular backed with a second metal layer in registration-accurate manner. The first optical variable effect is preferably detectable for an observer in the areas of the characters "UTO" and "50" which comprise the first color layer 2813 and the first metal layer.

Figure 29:
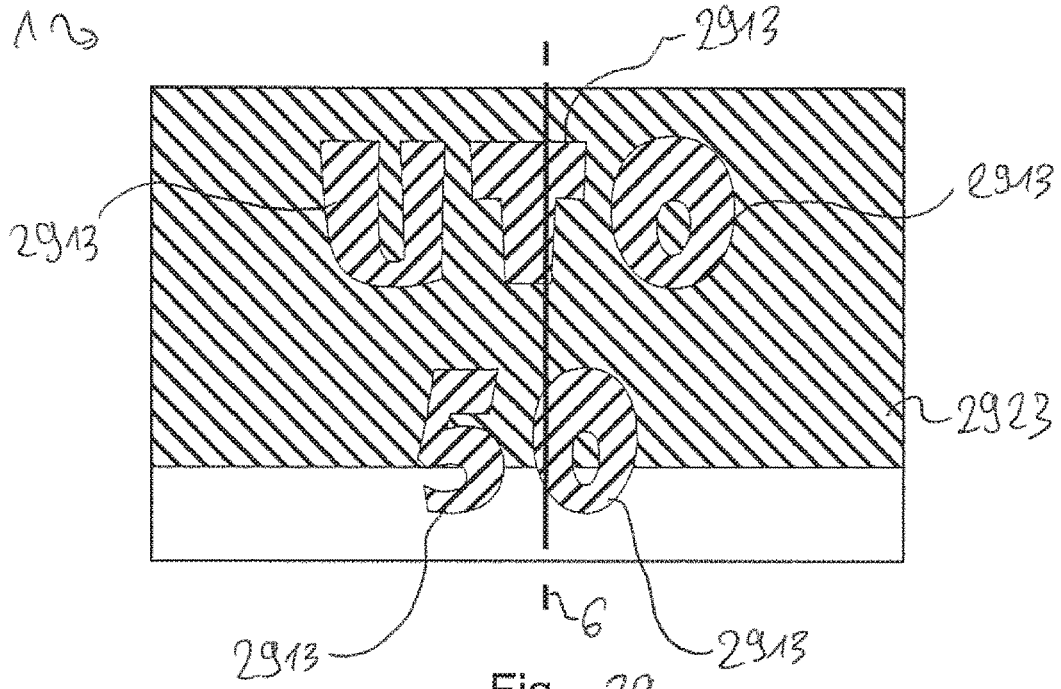
FIG. 29 shows a schematic representation of a security element.
Figure 30:
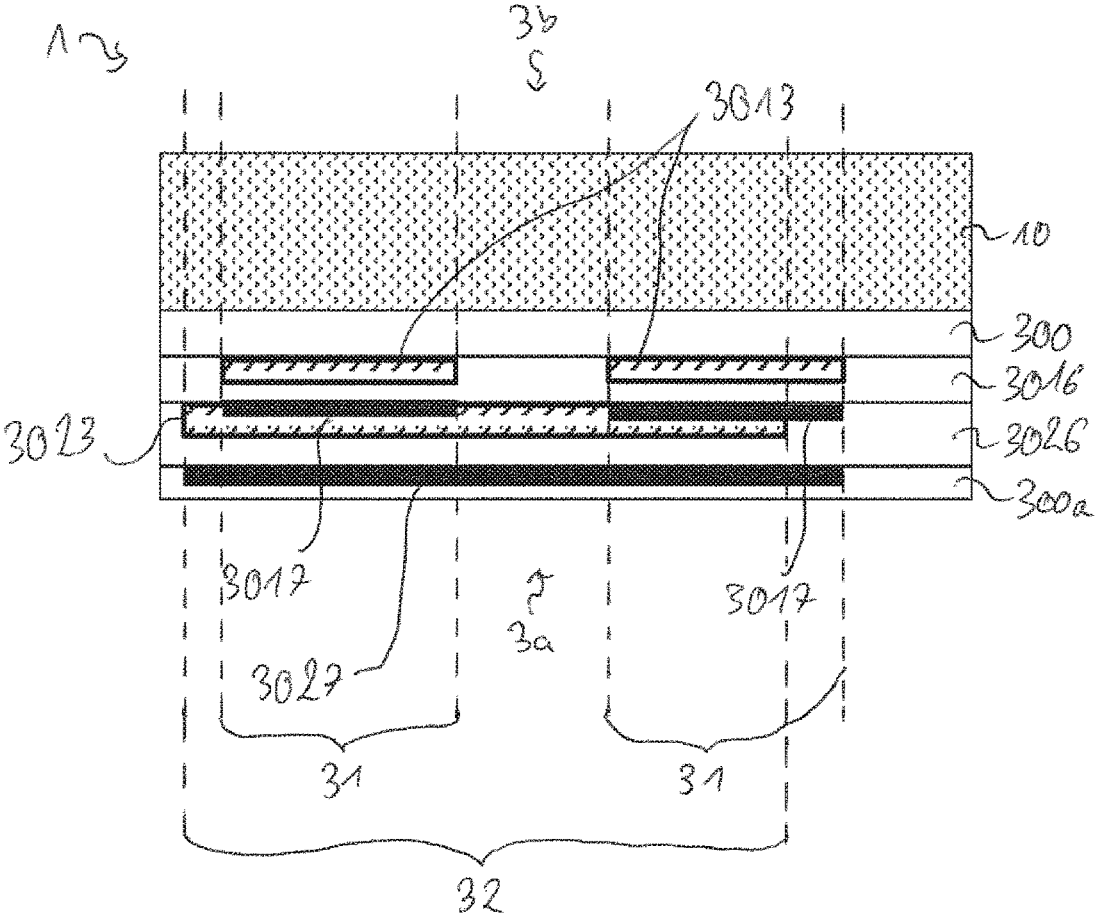
FIG. 30 shows a schematic representation of a security element.

FIG. 29 shows the security element 1 shown in FIG. 28 comprising a virtual section line and FIG. 30 shows a cross section of this security element at the position of or along the virtual section line 6, wherein the security element 1 shown in FIG. 30 substantially corresponds to the structure of the security element shown in FIG. 1.

FIG. 30 shows a security element 1 comprising a carrier ply 10 and further layers, which are formed on the rear side 3*a* of the carrier ply 10 in the sequence: functional layer 300, first color layer 3013 in first areas 31, first replication layer 3016, first metal layer 3017 in the first areas 31, second color layer 3023 in second area 32, second replication layer 3026, second metal layer 3027 in the second area 32 as well as in the first areas 31.

It is possible for the first replication layer 3016 to be thicker than the first color layer 3013, wherein the first replication layer 3016 in particular covers the first color layer 3013 and evens out differences in level. It is further possible for the second replication layer 3026 to hide differences in level and to preferably level out the layer composite of first metal layer 3017 and second color layer 3023. A second metal layer 3027 is preferably arranged on the second color layer 3023 in register with the first and/or with the second color layer 3013, 3023 and/or in register with the first metal layer 3017. It is possible for an optional compensation layer **300*a* to fill in the differences in height between the second replication layer 3026 and the second metal layer 3027**.

The carrier ply is a preferably transparent plastic film with a thickness of between 4.5 μm and 125 μm, preferably between 12 μm and 50 μm, further preferably between 16 μm and 23 μm. The carrier ply 10 can be formed as a mechanically and thermally stable film made of a material transparent to light, for example ABS(=acrylonitrile butadiene styrene), PP (polypropylene), PEN (polyethylene naphthalate), PC (polycarbonate), PE (polyethylene), preferably PET (polyester, polyethylene terephthalate). The carrier ply 10 is in particular monoaxially or biaxially stretched here. Further, it is also possible for the carrier ply to consist not only of one layer, but also of several layers. Thus, it is for example possible for the carrier ply to have, in addition to a plastic carrier, for example an above-described plastic film, a detachment layer which makes it possible to detach the functional layer up to the compensation or adhesive layer of the existing layer structure from the plastic film, for example when the multilayer body is used as hot- or cold-stamping film. In particular, the detachment layer is partially present, in order to preferably form a further security feature, such as for example in the case of a label film. The partial detachment layer preferably leads to a destruction of the security element here, if it is detached again from a substrate, such as for example a document.

The functional layer preferably comprises a detachment layer, for example made of hot-melting material, which in particular makes it easier to detach the carrier ply 10 from the other layers of the multilayer body which are arranged on a side of the detachment layer facing away from the carrier ply 10. This is in particular advantageous if the multilayer body is formed as a transfer ply, such as is used for example in a hot-stamping method, cold-stamping method or an IMD method (IMD=In-Mold Decoration).

It has furthermore proved effective, in particular if the multilayer body is used as a transfer film, if the functional layer has at least one protective layer, for example a protective varnish layer, in addition to a detachment layer. After the multilayer body has been joined to a substrate and the carrier ply 10 has been detached from the layers of the multilayer body which are arranged on a side of the detachment layer facing away from the carrier ply 10, the protective layer preferably provides protection to layers arranged underneath it against abrasion, damage, chemical attacks or the like. In particular, the uppermost layer after removal of the carrier film has further functions, such as for example adhesion in the case of overlamination or ensuring the printability, preferably by means of thermal transfer, inkjet and/or offset printing methods. Furthermore, the functional layers in particular contain plies which preferably influence the functioning of the adhesion to or between the adjacent layers.

In particular, a first transparent, colored varnish layer is printed on the functional layer in individual partial areas. By transparent is preferably meant here that the varnish layer is preferably at least partially transparent to radiation in the visible wavelength range. By colored is preferably meant here that the varnish layer in particular exhibits a visible color impression with sufficient daylight.

Both the areas of the functional layer printed with the first varnish layer and the unprinted areas of the functional layer are preferably covered by a first replication layer, which preferably at least partially evens out the relief structure of the decorative ply, i.e. the different levels in the printed and the unprinted areas. The replication layer in particular has a relief structure completely or partially. A thin metal layer is preferably arranged on the first replication layer in register with, and when observed perpendicular to the plane of the carrier ply, congruent with the first colored varnish layer.

A second transparent, colored varnish layer is preferably printed in individual partial areas on the first metal layer as well as in the areas of the first replication layer which are not covered by a metal layer. Both the areas printed with the second colored varnish layer and the unprinted areas, preferably the first replication layer and/or the first metal layer, are in particular covered by a second replication layer, which preferably evens out the relief structure of the decorative ply, i.e. the different levels in the printed and the unprinted areas. Depending on the varnish chemistry, application quantity and application condition, only a partial evening out is preferably effected, which is in particular not decisive for the realization of the feature, however. The replication layer preferably has a relief structure completely or partially. A second thin metal layer is preferably arranged on the second replication layer in register with, and when observed perpendicular to the plane of the carrier ply, congruent with the first and second varnish layers and thus in particular also in register with the first metal layer.

Both the areas of the second replication layer covered with the second metal layer and the uncovered areas of the second replication layer are preferably covered with a compensation layer, which evens out or covers and fills in differences in level in particular caused by the relief structure and the metal layer arranged in areas, wherein the multilayer body preferably has a largely flat, substantially unstructured surface on the side of the compensation layer facing away from the carrier ply. In particular, the thickness of the compensation layer varies in this way. The compensation layer preferably accomplishes further functional tasks, such as for example improvement of the adhesion to subsequent layers, protective functions with respect to chemical and/or physical attacks, as barrier layer or adhesive layer.

If the compensation layer has a similar refractive index to the second replication layer and/or if the difference in refractive index is less than approximately 0.3, then in particular the areas of the relief structure of the second replication layer not covered with the second metal layer and directly adjacent to the compensation layer are preferably optically obliterated, because optically recognizable layer boundaries between the replication layer and the compensation layer are preferably no longer present there due to the similar refractive index of the two layers.

The multilayer body is preferably a section of a transfer film, for example a hot-stamping film, which can be arranged on a substrate by means of an adhesive layer. The compensation layer is preferably designed as an adhesive layer, for example hot-melt adhesive, or an adhesive layer is attached to the side of the compensation layer facing away from the carrier ply. The adhesive layer is in particular a hot-melt adhesive which melts with thermal action and joins the multilayer body to the surface of the substrate.

In the case of a development of the multilayer body as a laminating film, i.e. without a detachment layer for detaching the carrier ply from the layers of the multilayer body, an additional, or, as an alternative to the adhesive layer, a further carrier ply is preferably provided on the side of the compensation layer facing away from the first carrier ply. This laminate body, which preferably consists of two carrier plies on the outside and the layers of the multilayer body inside, can for example be laminated into card composites for further use, for example into polycarbonate (PC). For this, it is advantageous if the carrier plies consist of the same material as the layers of the card composite that are adjacent to the laminate body, for example of PC.

Figure 31:
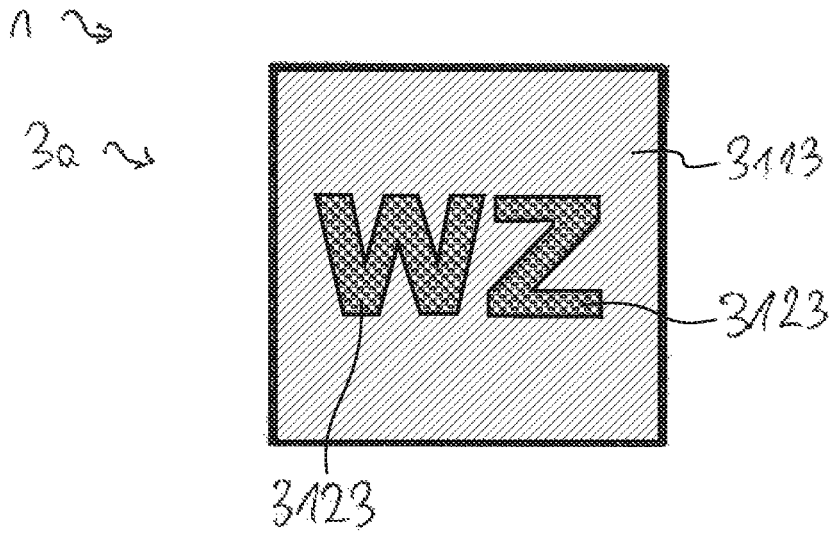
FIG. 31 shows a schematic representation of a security element.
Figure 32:
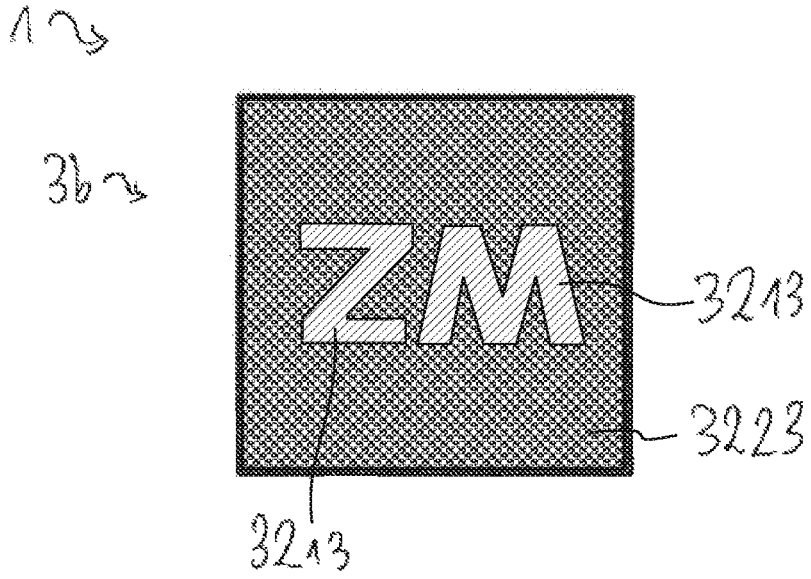
FIG. 32 shows a schematic representation of a security element.

FIGS. 31 and 32 show a security element 1 comprising a so-called diffractive watermark, which is in particular based on asymmetrical structures. Blazed gratings with a grating period of between 0.5 μm and 10 μm are typically used as asymmetrical structures. An almost identical blazed grating is preferably used in the lettering and the background. Only the orientation of the two gratings relative to each other is rotated through approx. 180°. It is possible for changes in contrast in particular to be produced when the security element 1 is rotated in the plane spanned by the security element 1 from 0° (see FIG. 31) through 180° (see FIG. 32).

It is possible for the background 3113 and the lettering 3123 to be complemented in registration-accurate manner by a respective color, such as for example red and green, wherein a further optical effect is in particular produced.

For example, in the case of a first observation (FIG. 31) a dark red lettering 3123 against a light green background 3113 is detectable, wherein, after a rotation through 180°, a light red lettering against a dark green background in particular becomes detectable (FIG. 32).

Figure 33:
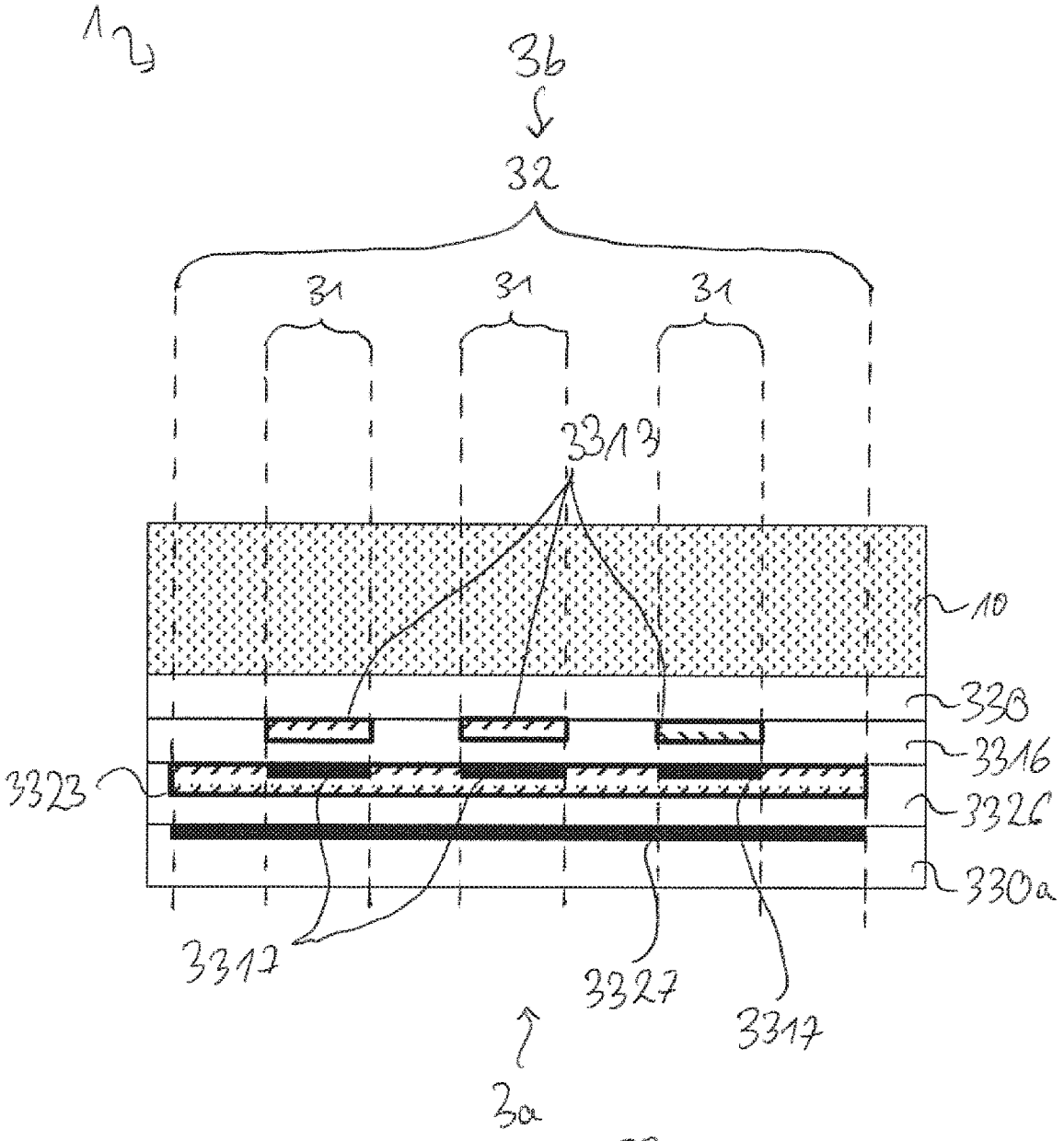
FIG. 33 shows a schematic representation of a security element.

FIG. 33 shows the security element 1 shown in FIGS. 31 and 32 in cross section, wherein the layer structure of the security element in particular corresponds to the layer structure of the security element shown in FIG. 1. The effect shown in FIGS. 31 and 32 results in the case of observation from the front side 3*b*. In order that the effect can be produced as described, a first asymmetrical structure is molded in the areas 31 and a structure rotated through approximately 180° relative thereto in the areas 32.

Figure 34:
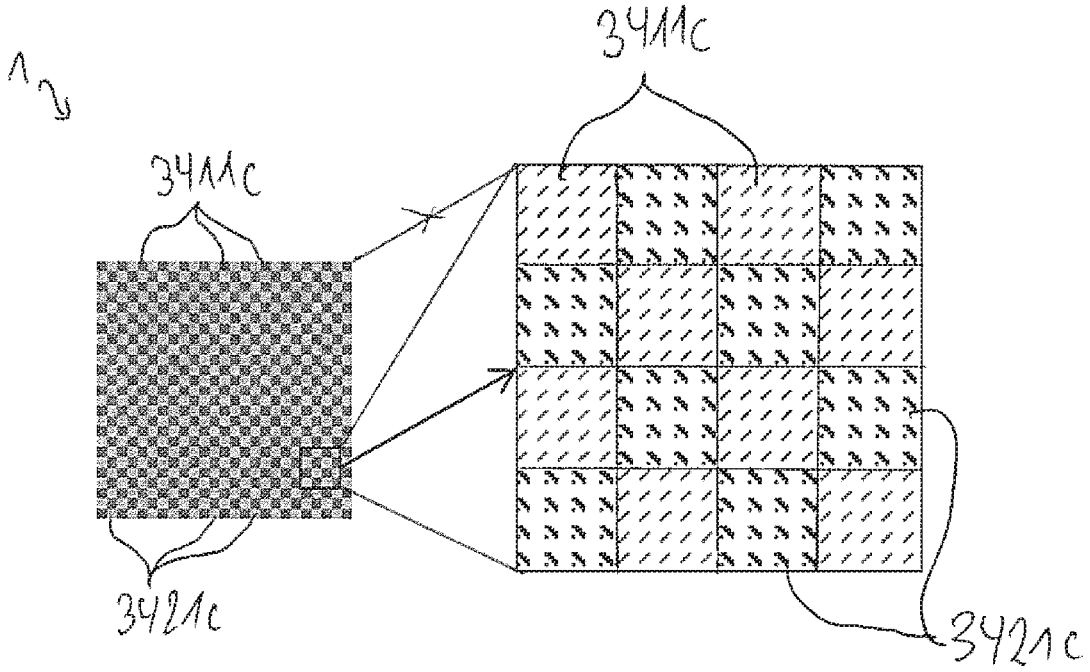
FIG. 34 shows a schematic representation of a security element.

FIG. 34 shows a security element or a part of a security element comprising a square field with a size of 4 mm×4 mm which in particular has the shape of a 2-dimensional raster, wherein the size of a raster element 3411*c* or 3421*c* is for example 50 μm×50 μm or 100 μm×100 μm and has, in particular in each case, differently oriented anisotropically scattering matte structures, which have, for example, an orientation of +45° and −45° relative to one of the edges of the security element 1. It is possible for both structures 3411*c*, 3421*c* in each case to have the colors green and red in registration-accurate manner. The layer structure of the security element 1 in particular corresponds in cross section to the security element shown in FIG. 1.

An observer of the security element 1, when it is tilted to one side, preferably detects the square field in a first green color, wherein when it is tilted to the other side, the square field in particular appears in red color.

It is also possible that similar optical effects can also be produced by means of asymmetrical achromatic structures or grating structures, with for example 100 lines/mm and a structure depth of 1000 nm, instead of anisotropically scattering matte structures in different orientations.

Furthermore, it is preferred to use two isotropically scattering matte structures, wherein they preferably scatter in rotation-invariant manner, with different scattering characteristics, in particular due to different roughness depth and/or different correlation lengths, and/or two grating structures with different structure depths and/or profile shapes. A further possibility is to use two achromatically white-reflecting computer-generated holograms with different radiation angles. Depending on the structures used, in particular depending on the period, structure depth, and/or profile shape used, the color flip is preferably effected in a different angular range, preferably in the case of rotating and/or tilting.

An individual grid of the two-dimensional rasterization, at 50 μm×50 μm, is preferably significantly below the resolution limit of the human eye, wherein the square fields in particular appear to be homogeneous to an observer.

The surface coverage of the two colors preferably varies locally between 0% and 100%. Thus, for example, the surface coverage of the first color can decrease from 80% to 20% from the edge towards the middle and, conversely, the surface coverage of the second color can increase from 20% to 80%.

There are a large number of different possibilities for the design of a raster, as are known for example from printing technology, in particular as one-dimensional rasters, two-dimensional rasters, amplitude-modulated, and/or frequency-modulated. The rasters can also be provided with a substructure, as are known for example from security printing, in particular as artistic screening and/or line rasters with width modulation.

It is also possible for dynamic movement effects to overlap. Here, the first replication preferably has a configuration with anisotropically scattering structures, which for an observer in particular produces two light bars which preferably move from the center to the edges when the feature moves from left to right. The second replication registration-accurate relative to the first replication preferably exhibits a movement pattern composed of concentric rings.

Figure 35:
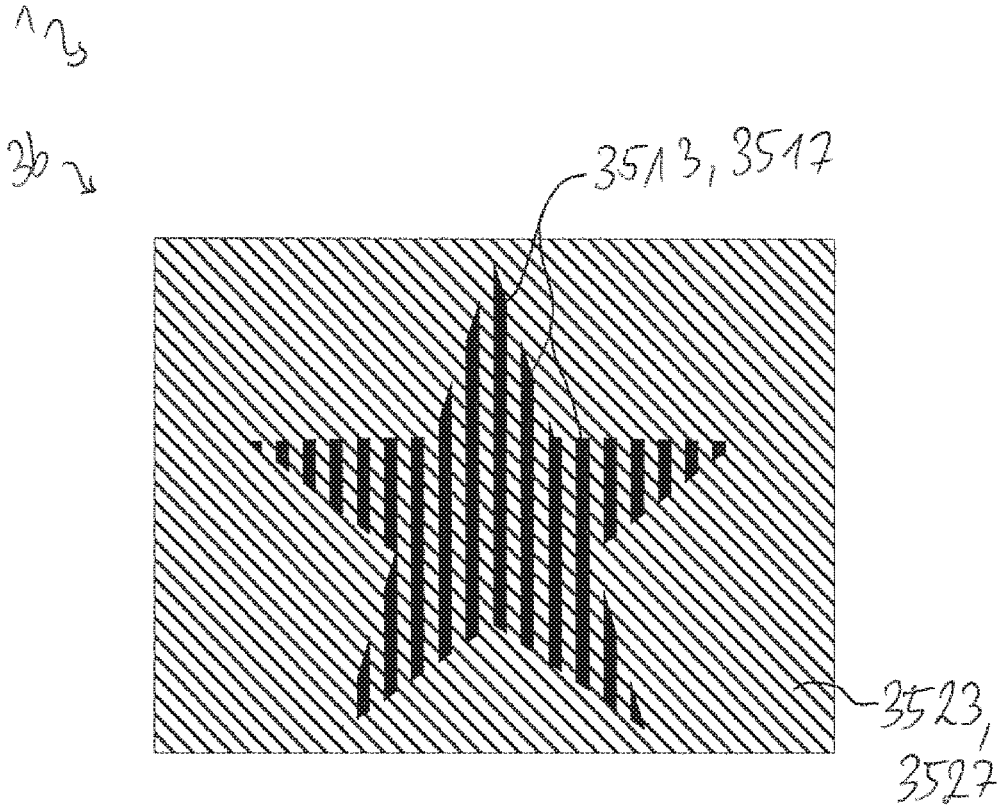
FIG. 35 shows a schematic representation of a security element.
Figure 36:
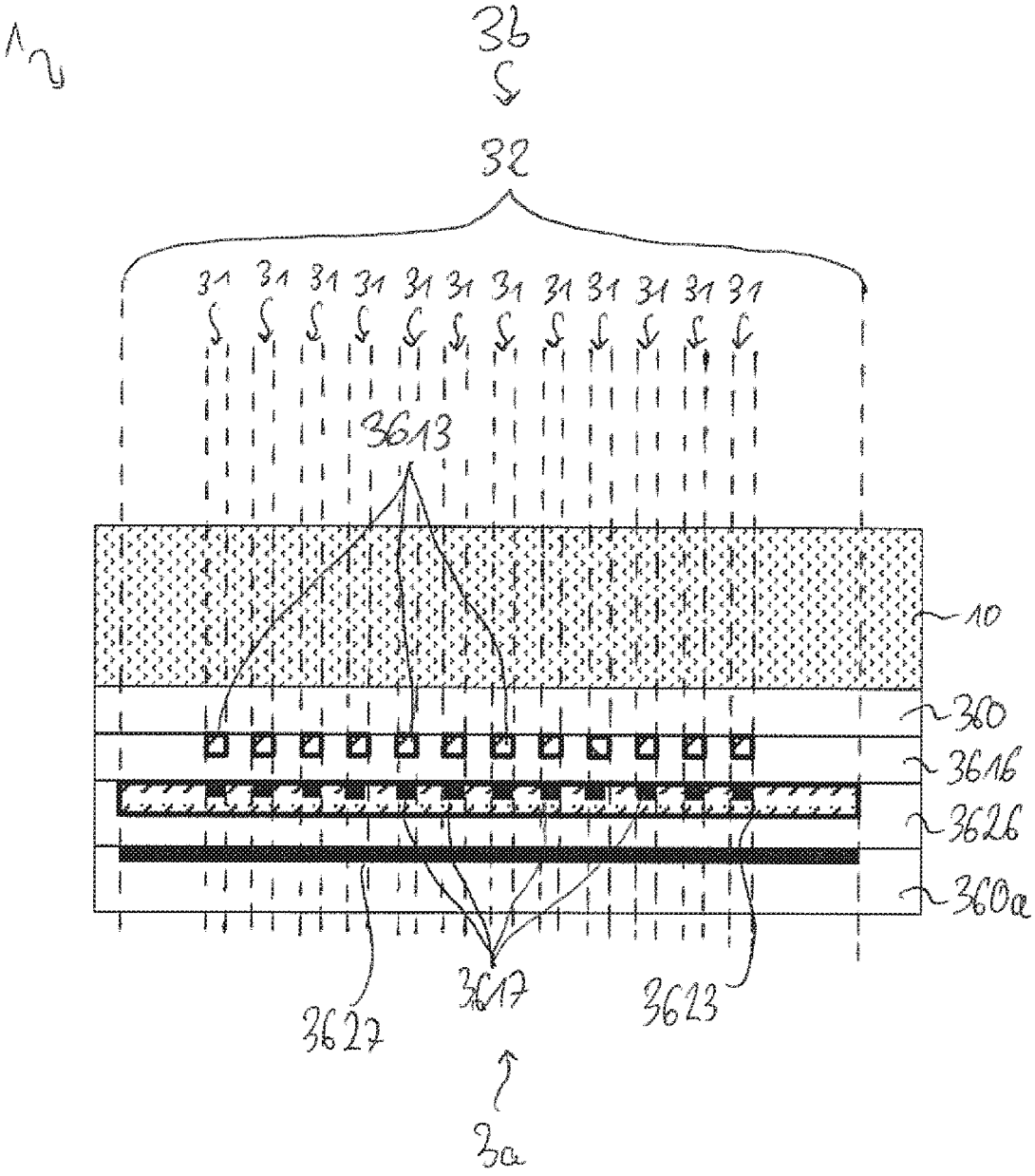
FIG. 36 shows a schematic representation of a security element.

FIGS. 35 and 36 show a security element 1 in top view from the front side 3*b*, and in cross section respectively. In the center of the security element 1 shown in FIG. 35 there is located a Fresnel freeform surface in the shape of a three-dimensional star 3513, 3517. The star preferably appears in the color blue and appears partially transparent due to the rasterization. In the background there is located a yellow-orange color layer 3523 in front of a metal layer 3527, which in particular exhibits a dynamic movement effect. When the security element 1 is tilted, the freeform surface preferably appears 3-dimensionally in blue color, i.e. preferably virtually jumping out three-dimensionally, and in the background, in particular through the freeform surface, though preferably attenuated due to the rasterization of the freeform surface, a movement effect preferably appears in a different color, wherein the yellow-orange color together with the metal layer is in particular detectable as a golden hue. For an observer, the two effects and the two color impressions are preferably detectable or catch their eye alternately.

It is possible for the rasterizations to be one-dimensional or two-dimensional. The local surface coverage is in particular effected as a result of an amplitude or frequency modulation of the punctiform and/or linear raster elements.

In particular, the minimum dimensions of a rasterization, such as for example the diameter of a partial surface area, or the width of a raster line in the case of a one-dimensional rasterization, lie in the range between 1 μm and 300 μm, preferably between 5 μm and 200 μm.

The layer structure of the security element 1 shown in FIG. 36 substantially corresponds to the layer structure of the security element shown in FIG. 1, except for the fact that the side of the second replication layer 3626 facing away from the carrier ply 10 and the side of the second metal layer 3627 facing away from the carrier ply 10 has a further functional layer 360*a*. This functional layer 360*a* is preferably formed as an adhesive layer or a sequence of adhesive layers, barrier layers and/or adhesion-promoter layers.

Figure 37:
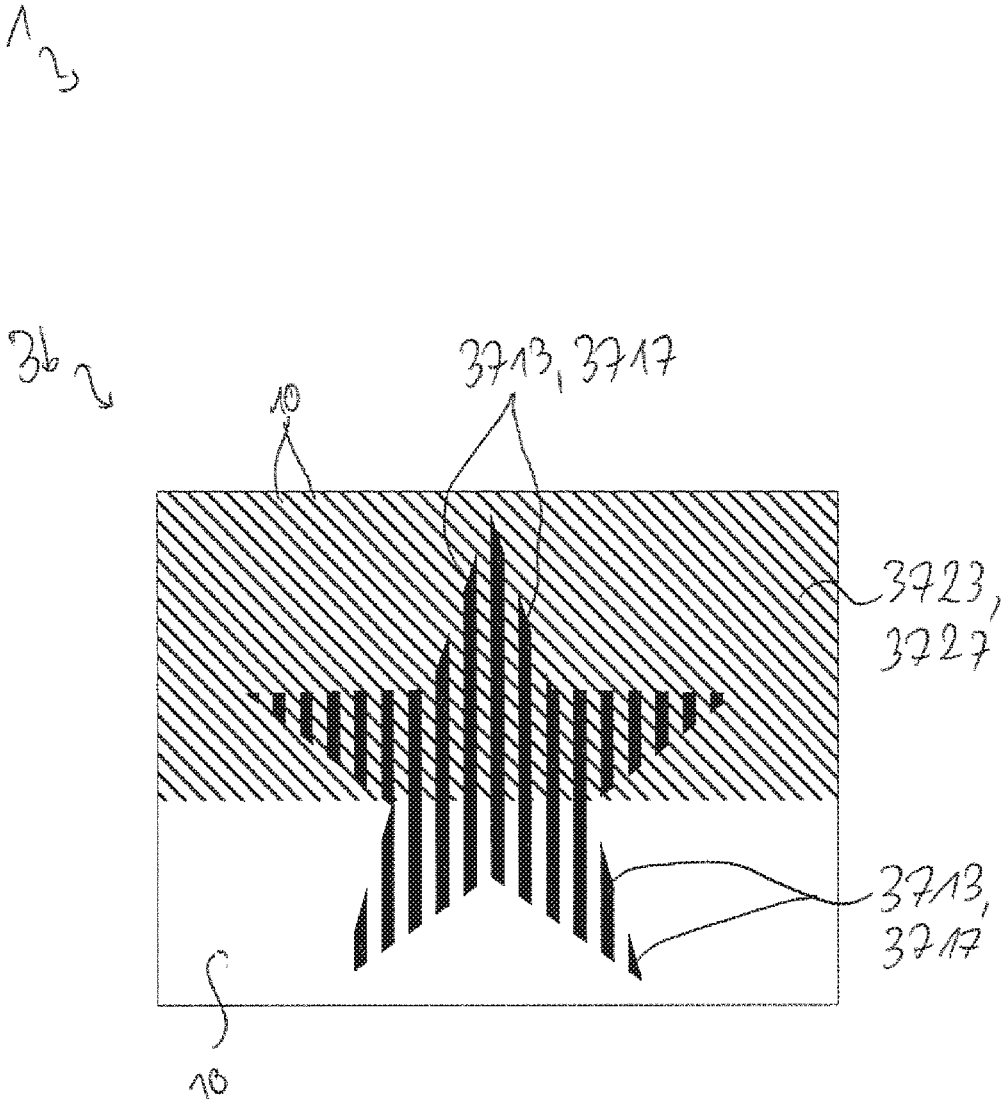
FIG. 37 shows a schematic representation of a security element.
Figure 38:
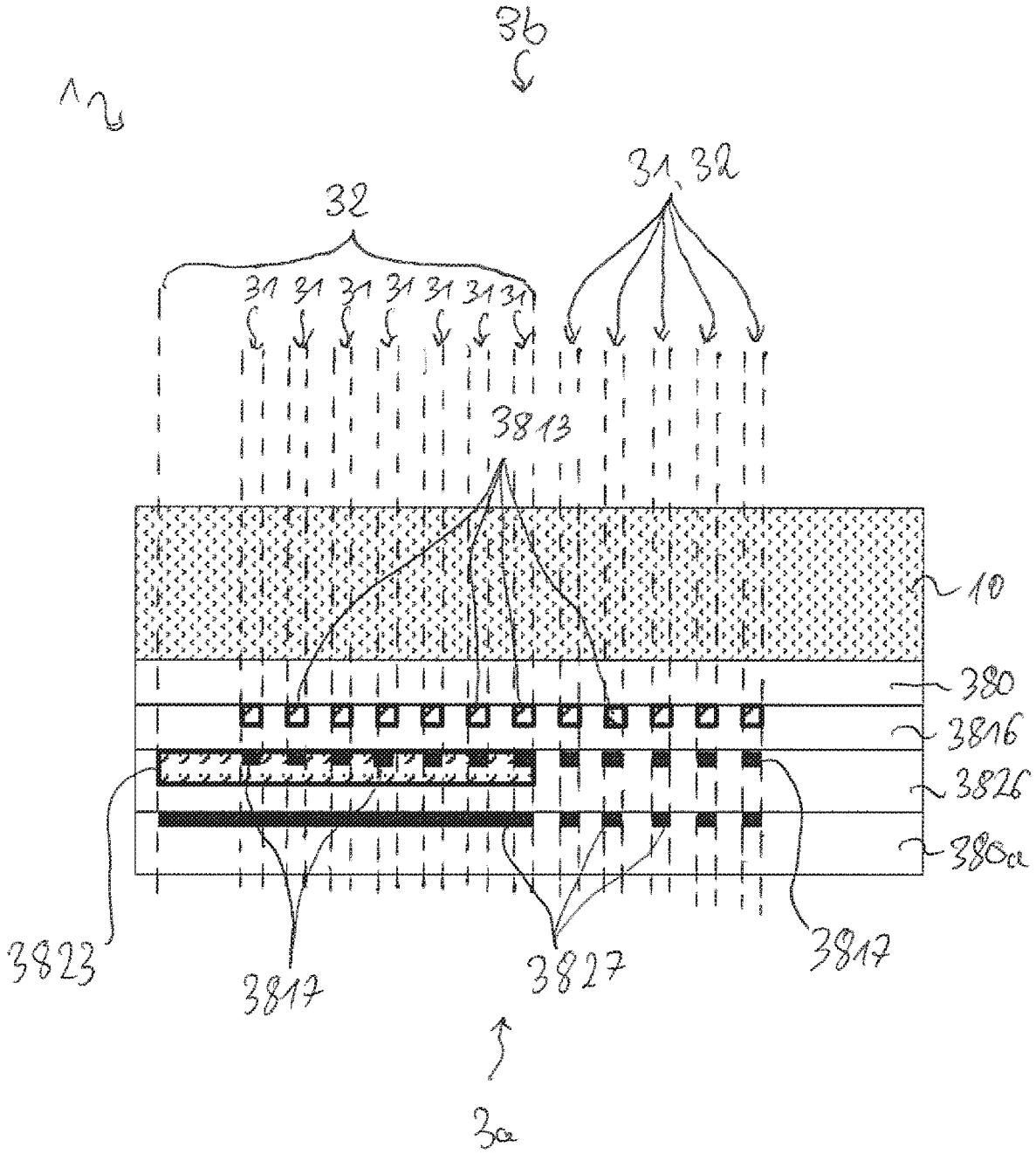
FIG. 38 shows a schematic representation of a security element.

FIGS. 37 and 38 show the security element 1 shown in FIGS. 35 and 36, except that the security element 1 shown in FIGS. 37 and 38 has a partial overlapping of the first color layer 3713 and the second color layer 3723. In areas in which the freeform surface is not backed by the second color layer 3723, it in particular appears partially transparent, wherein after application to a substrate the substrate is in particular detectable without color effect.

If the security element is transferred to a substrate and observed from the front side 3*b*, the substrate is preferably recognizable without color effect in the partially transparent areas of the freeform surface which are not backed with the second color layer.

Figure 39:
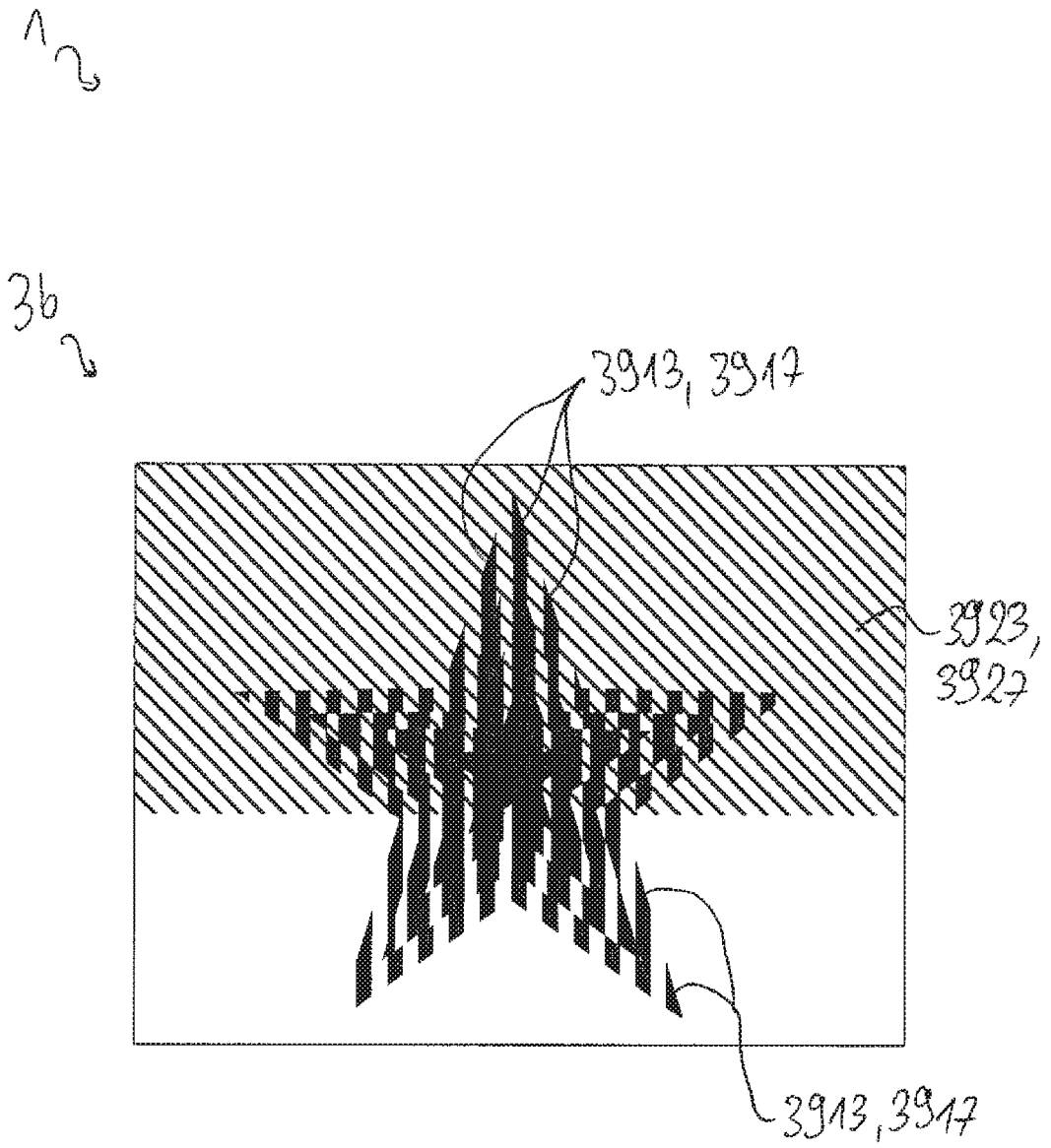
FIG. 39 shows a schematic representation of a security element.
Figure 40:
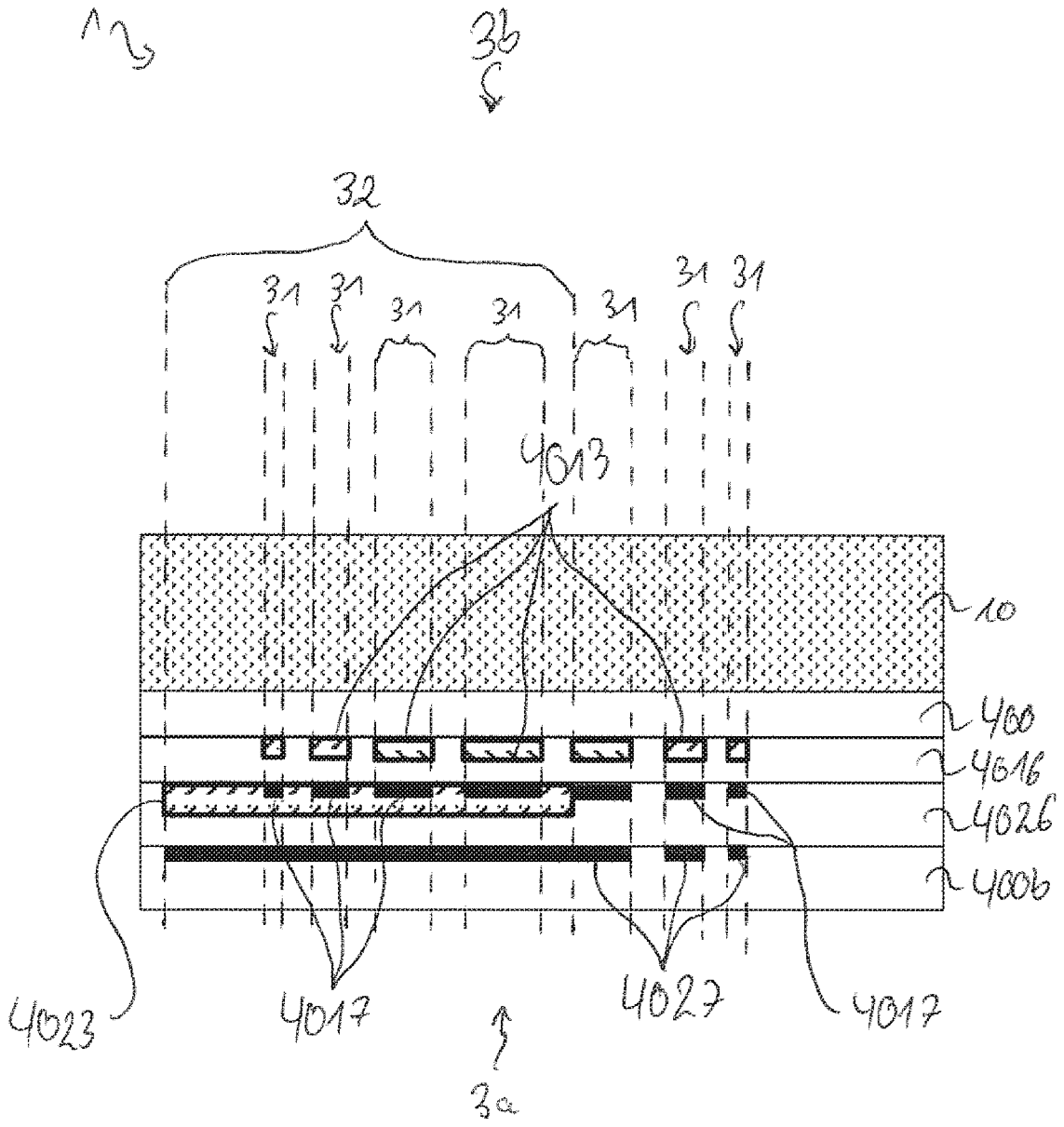
FIG. 40 shows a schematic representation of a security element.

FIGS. 39 and 40 show the security element 1 shown in FIGS. 37 and 38, except for the fact that the security element 1 shown in FIGS. 39 and 40 is provided with a first metal layer 3917 so as to be completely opaque in the central area, wherein the metallic surface coverage gradually decreases in particular in the edge areas.

Figure 41:
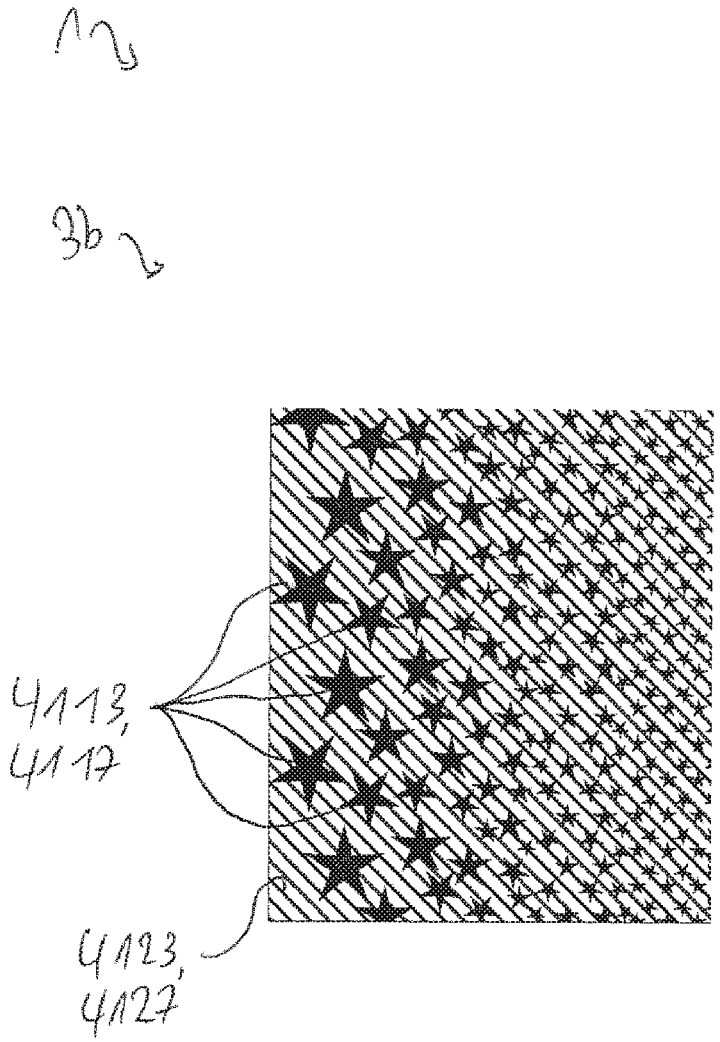
FIG. 41 shows a schematic representation of a security element.

FIG. 41 shows a security element 1 which has star-shaped motifs which have a change in their size and/or alignment and/or surface coverage. The star-shaped motifs 4113, 4117 on the left-hand side of FIG. 41 in particular have a diameter in the millimeter range and are resolved by a human eye, preferably without aids. The star-shaped motifs on the right-hand side in particular have a diameter in the region of a few micrometers and are in particular no longer resolved by a naked human eye. The optically variable effect that is present registration-accurate relative to the first color layer 4113 in the star-shaped motifs and is produced by the microstructures molded in the first metal layer 4117 in particular consists of a lightness progression from left to right, for example in golden color, which is detectable when the security element 1 is tilted. In the background, further microstructures 4127 are present which in particular exhibit a red lightness progression which moves from top to bottom when the security element 1 is tilted. In the larger star-shaped motifs it is preferably clearly detectable that the golden effect is localized in the individual star-shaped motifs, meanwhile on the right-hand side the smaller star-shaped motifs preferably act like a continuous raster.

It is also possible to combine two freeform surfaces in one security element, wherein a first star-shaped motif with a first color layer and a rastered first metal layer in particular forms a relief with a virtual three-dimensional curvature, which is directed, jumps out, in particular jumps out virtually convexly, towards the observer. It is further possible for a second star-shaped motif to be formed in a background which has the second color, with an apparent curvature, which in particular points, jumps back, in particular jumps back virtually concavely, away from the observer. When the security element is tilted, an observer detects the optical impression of a three-dimensional star in which the observer preferably detects a reflection of the upper side in the first color and at the same time preferably receives the impression that they could detect through the upper side the rear "inner" side of the star, the reflection of which in particular glows in a color different from the first color.

LIST OF REFERENCE NUMBERS

1 security element
2 security feature
2*a* first security feature
2*b* second security feature
3*a* rear side
3*b* front side
4 design element
5 outer edge
6 section line
10 carrier ply
20, 30, 50, 90, 130, 170, 210, 300, 360*a* functional layer
21 first layer
210 opaque layer
210*a* first opaque layer
210*b* first opaque metal layer
211, 1811 first optically variable structure
211*a* optically variable reflective layer
211*b* varnish layer
211*c* first matte structure
212 reflective layer
212*a* opaque, translucent or transparent reflective layer
213, 313, 413, 613, 713, 813, 913, 1013, 1313, 1713, 1813, 2113, 2313, 2413, 2513, 2813, 3013, 3713, 4113 first color layer
213*a* optional first color layer
214 transparent or translucent replication layer
214*a* optically active relief structure
214*b* opaque metallic reflective layer
215 first opening
215*a* first rasterization
216 first replication layer
217, 317, 417, 417*a*, 517, 617, 717, 817, 917, 1017, 1317, 1717, 1817, 2117, 2317, 2517, 3017, 3917, 4117 first metal layer and/or metallization
218 photoresist
22 second layer
220 opaque layer
220*a* second opaque layer
220*b* second opaque metal layer
221, 1721, 1821 second optically variable structure
221*c* second matte structure
223, 323, 823, 923, 1023, 2123, 2223, 2323, 2423, 2523, 2823, 3023, 3523, 3723 second color layer
224 transparent or translucent replication layer
224*a* optically active relief structure
224*b* reflective layer
225 second opening
225*a* second rasterization
226, 326, 426, 1026, 1326, 1726, 1826, 2126, 3026, 3626 second replication layer
227, 327, 427, 827, 1027, 1327, 1727, 2127, 2227, 2327, 2527, 3027, 3527, 3627, 4127 second metal layer
23 replication layer
233, 933, 1033 third color layer
243, 1043 fourth color layer
417*f* non-metallized and/or non-metallic areas
418*f* metallized and/or metallic areas
1318 negative photoresist
3411*c*, 3421*c* raster element

3113 background
3123 lettering
4127 microstructures
3513, 3517 three-dimensional star
4113, 4117 star-shaped motifs
30 area
31 first area
32 second area
a step
b step

The invention claimed is:

1. A security element with a front side and a rear side lying opposite the front side, wherein the security element has two or more security features, wherein a first security feature of the two or more security features comprises one or more layers and a second security feature of the two or more security features comprises one or more layers, wherein the first security feature generates at least one optically variable effect and the second security feature generates at least one optically variable effect, wherein the at least one optically variable effect generated by the first security feature has a first color and the at least one optically variable effect generated by the second security feature has a second color, wherein the first color and the second color differ from each other, wherein the first security feature is visible in one or more areas of the security element and the second security feature is visible in one or more areas of the security element when observed in reflected light and/or when observed in transmitted light from the front side and/or the rear side, and wherein the first security feature is formed opaque in the one or more areas in which the first security feature is visible and is formed transparent or translucent in the one or more areas in which the second security feature is visible.

2. The security element according to claim 1, wherein the one or more layers of the first security feature and/or the one or more layers of the second security feature are arranged next to each other, in one plane, or are arranged one underneath the other, in different respective planes.

3. The security element according to claim 1, wherein the one or more layers of the first security feature are arranged above the one or more layers of the second security feature when the security element is observed from the front side or from the rear side and the one or more layers of the second security feature completely overlap, partially overlap or do not overlap the one or more layers of the first security feature when the security element is observed from the front side or from the rear side.

4. The security element according to claim 1, wherein at least one first layer of the one or more layers of the first security feature is formed as a first color layer and/or wherein at least one second layer of the one or more layers of the second security feature is formed as a second color layer.

5. The security element according to claim 4 wherein the first color layer is provided in the one or more areas in which the first security feature is visible, but is not provided in the one or more areas in which the second security feature is visible.

6. The security element according to claim 4, wherein the second color layer is provided in the one or more areas in which the second security feature is visible and is not provided in the one or more areas in which the first security feature is visible.

7. The security element according to claim 4, wherein the first color layer and the second color layer have different colors.

8. The security element according to claim 4, wherein the first color layer and/or the second color layer are formed as a transparent or a translucent layer.

9. The security element according to claim 1, wherein the first security feature and the second security feature are arranged in register with each other.

10. A security element with a front side and a rear side lying opposite the front side, wherein the security element has two or more security features, wherein a first security feature of the two or more security features comprises one or more layers and a second security feature of the two or more security features comprises one or more layers, wherein the first security feature generates at least one optically variable effect and the second security feature generates at least one optically variable effect, wherein the at least one optically variable effect generated by the first security feature has a first color and the at least one optically variable effect generated by the second security feature has a second color, wherein the first color and the second color differ from each other, wherein the first security feature is visible in one or more areas of the security element and the second security feature is visible in one or more areas of the security element when observed in reflected light and/or when observed in transmitted light from the front side and/or the rear side, and wherein the first security feature is formed opaque in the one or more areas in which the second security feature is visible and is formed opaque, transparent or translucent in the one or more areas in which the first security feature is visible.

11. The security element according to claim 10, wherein one or more layers of the one or more layers of the first security feature form and/or have a first optically variable structure and/or wherein one or more layers of the one or more layers of the second security feature form and/or have a second optically variable structure.

12. The security element according to claim 11, wherein the first optically variable structure is provided in the one or more areas in which the first security feature is visible, but is not provided in the one or more areas in which the second security feature is visible.

13. The security element according to claim 11, wherein the first optically variable structure and/or the second optically variable structure comprises a volume hologram and/or an optically active relief structure, selected from: mirror, diffraction grating, hologram, kinoform, asymmetrical diffraction structure, matte structure, anisotropic matte structure, blazed grating, zero-order diffraction structure, Fresnel freeform surface, refractive structure, micromirror arrangement, light-refracting or focusing structure, microlens arrangement.

14. The security element according to claim 11, wherein the first optically variable structure differs from the second optically variable structure in alignment, grating period, grating depth, randomness of structure parameters, and/or are allocated to different classes of optically variable structures.

15. A security element with a front side and a rear side lying opposite the front side, wherein the security element has two or more security features, wherein a first security feature of the two or more security features comprises one or more layers and a second security feature of the two or more security features comprises one or more layers, wherein the first security feature generates at least one optically variable effect and the second security feature generates at least one optically variable effect, wherein the at least one optically variable effect generated by the first security feature has a first color and the at least one optically variable effect generated by the second security feature has a second color, wherein the first color and the second color differ from each other, wherein one or more layers of the one or more layers of the first security feature form and/or have a first optically variable structure and/or wherein one or more layers of the one or more layers of the second security feature form and/or have a second optically variable structure, and wherein the first optically variable structure is formed as an optically variable relief structure, which is molded into a replication layer, and wherein the optically variable relief structure is not molded into the replication layer in the one or more areas in which the second security feature is visible and/or is optically obliterated by applying a varnish layer with a refractive index which differs from the refractive index of the replication layer by not more than 0.3.

16. The security element according to claim 15, wherein the first security feature is visible in one or more areas of the security element and the second security feature is visible in one or more areas of the security element when observed in reflected light and/or when observed in transmitted light from the front side and/or the rear side.

17. The security element according to claim 16 wherein the one or more areas in which the first security feature is visible and/or the one or more areas in which the second security feature is visible are adjacent to one another, at least in sections, for an observer who detects the security element from the front side and/or from the rear side.

18. The security element according to claim 15, wherein the varnish layer is made up of a second layer of the one or more layers of the second security feature, wherein the varnish layer partially optically obliterates the first optically variable relief structure molded into the replication layer.

19. The security element according to claim 15, wherein at least one first layer of the one or more layers of the first security feature is formed as a first color layer and/or wherein at least one second layer of the one or more layers of the second security feature is formed as a second color layer and wherein the varnish layer is made up of the second color layer or a replication layer of the second optically variable structure, wherein the varnish layer partially optically obliterates the first optically variable relief structure molded into the replication layer.

20. A security element with a front side and a rear side lying opposite the front side, wherein the security element has two or more security features, wherein a first security feature of the two or more security features comprises one or more layers and a second security feature of the two or more security features comprises one or more layers, wherein the first security feature generates at least one optically variable effect and the second security feature generates at least one optically variable effect, wherein the at least one optically variable effect generated by the first security feature has a first color and the at least one optically variable effect generated by the second security feature has a second color, wherein the first color and the second color differ from each other, wherein at least one first layer of the one or more layers of the first security feature is formed as a first color layer and/or wherein at least one second layer of the one or more layers of the second security feature is formed as a second color layer, and wherein the second color layer is provided both in the one or more areas in which the first security feature is visible and in the one or more areas in which the second security feature is visible.

21. A security element with a front side and a rear side lying opposite the front side, wherein the security element has two or more security features, wherein a first security feature of the two or more security features comprises one or more layers and a second security feature of the two or more security features comprises one or more layers, wherein the first security feature generates at least one optically variable effect and the second security feature generates at least one optically variable effect, wherein the at least one optically variable effect generated by the first security feature has a first color and the at least one optically variable effect generated by the second security feature has a second color, wherein the first color and the second color differ from each other, and wherein at least one layer of the one or more layers of the first security feature has one or more openings and/or wherein at least one second layer of the one or more layers of the second security feature has one or more openings, wherein the openings of the first security feature and/or the openings of the second security feature have a transmittance of greater than 50%.

22. The security element according to claim 21, wherein the one or more openings of the first security feature and/or the one or more openings of the second security feature are provided as first rasterizations and/or as second rasterizations, wherein the first rasterizations and/or of the second rasterizations have spacings that are less than or equal to 300 μm from each other.

23. The security element according to claim 22, wherein at least one first area of the one or more areas in which the first security feature is visible has a first rasterization and at least one second area of the one or more areas in which the second security feature is visible overlaps such that the at least one first optically variable effect and the at least one second optically variable effect is detectable by an observer from the front side in reflected light and/or in transmitted light, wherein the first optically variable effect is detectable in the first color and the second optically variable effect is detectable in the second color.

24. The security element according to claim 22, wherein at least one first area of the one or more areas in which the first security feature is visible and at least one second area of the one or more areas in which the second security feature is visible having a second rasterization overlaps such that the at least one first optically variable effect and the at least one second optically variable effect is detectable by an observer from the front side in reflected light and/or in transmitted light.

25. A method for producing a security element with a first area and a second area, wherein the method comprises the following steps:

a) applying a first security feature comprising one or more layers to a carrier ply, wherein the first security feature generates at least one first optically variable effect, wherein the at least one first optically variable effect has a first color; and b) applying a second security feature comprising one or more layers to the carrier ply and/or the first security feature, wherein the second security feature generates at least one second optically variable effect, wherein the at least one second optically variable effect has a second color, and wherein the first color and the second color differ from each other, wherein, in step a), at least one replication layer is applied, over a whole surface or in areas of the carrier ply, as one of the layers of the first security feature and wherein, in step a), a relief structure is molded into the at least one replication layer as a optically variable structure.

26. The method according to claim 25, wherein, in step a), at least one first color layer and/or one or more layers which form and/or have one or more optically variable structures are applied to the carrier ply.

27. The method according to claim 26, wherein the one or more optically variable structures are formed in the first area, but are not formed in the one or more second area.

28. The method according to claim 25, wherein, in step a), at least one first opaque layer, is applied to the replication layer as a layer.

29. The method according to claim 25, wherein, in step b), at least one second color layer and/or one or more layers which form and/or have one or more optically variable structures are applied to the carrier ply.

30. The method according to claim 29, wherein, in step b), the at least one second color layer is applied in the second area and is not applied in the first area.

31. The method according to claim 25, wherein the first security feature is arranged in register with the second security feature.

32. A method for producing a security element with a first area and a second area, wherein the method comprises the following steps:

a) applying a first security feature comprising one or more layers to a carrier ply, wherein the first security feature generates at least one first optically variable effect, wherein the at least one first optically variable effect has a first color; and b) applying a second security feature comprising one or more layers to the carrier ply and/or the first security feature, wherein the second security feature generates at least one second optically variable effect, wherein the at least one second optically variable effect has a second color, and wherein the first color and the second color differ from each other, wherein, in step b), at least one second color layer and/or one or more layers which form and/or have one or more optically variable structures are applied to the carrier ply, and wherein, in step b), the at least one second color layer is applied in the second area and in the first area.

33. A method for producing a security element with a first area and a second area, wherein the method comprises the following steps:

a) applying a first security feature comprising one or more layers to a carrier ply, wherein the first security feature generates at least one first optically variable effect, wherein the at least one first optically variable effect has a first color; and b) applying a second security feature comprising one or more layers to the carrier ply and/or the first security feature, wherein the second security feature generates at least one second optically variable effect, wherein the at least one second optically variable effect has a second color, and wherein the first color and the second color differ from each other, wherein, in step a), and/or b), one or more openings are introduced into at least one replication layer and/or at least one opaque layer and/or the color layers and/or at least one translucent or transparent layer and/or at least one reflective layer, wherein the one or more openings have a transmittance of greater than 50%.

* * * * *